US007003803B1

(12) United States Patent
Lyden

(10) Patent No.: US 7,003,803 B1
(45) **Date of Patent: *Feb. 28, 2006**

(54) SHIN-GUARD, HELMET, AND ARTICLES OF PROTECTIVE EQUIPMENT INCLUDING LIGHT CURE MATERIAL

(76) Inventor: Robert M. Lyden, 18261 SW. Fallatin Loop, Aloha, OR (US) 97007

( * ) Notice: Subject to any disclaimer, the term of this patent is extended or adjusted under 35 U.S.C. 154(b) by 124 days.

This patent is subject to a terminal disclaimer.

(21) Appl. No.: 10/704,992

(22) Filed: Nov. 10, 2003

Related U.S. Application Data

(63) Continuation-in-part of application No. 10/213,843, filed on Aug. 7, 2002, now Pat. No. 6,681,403, which is a continuation-in-part of application No. 09/523,851, filed on Mar. 13, 2000, now Pat. No. 6,490,730.

(51) Int. Cl.
*A41D 13/00* (2006.01)

(52) U.S. Cl. ..... 2/22

(58) Field of Classification Search ..... 2/22, 2/24, 455, 69, 463–467, 2.5, 267, 410–415, 2/911, 918, DIG. 3; 128/882, DIG. 20; 36/93; 602/5–8, 20, 23, 41, 60, 62
See application file for complete search history.

(56) References Cited

U.S. PATENT DOCUMENTS

| | | | | |
|---|---|---|---|---|
| 2,982,968 | A | 5/1961 | Groot | 2/22 |
| 3,613,675 | A | 10/1971 | Larsen | 128/90 |
| 3,866,243 | A | 2/1975 | Morgan | 2/3 R |
| 3,874,376 | A | 4/1975 | Dart et al. | 128/90 |
| 3,905,376 | A | 9/1975 | Johnson et al. | 128/595 |
| 4,071,424 | A | 1/1978 | Dart et al. | 204/159.19 |
| 4,183,156 | A | 1/1980 | Rudy | 36/44 |
| 4,217,705 | A | 8/1980 | Donzis | 36/29 |
| 4,219,945 | A | 9/1980 | Rudy | 36/29 |
| 4,235,686 | A | 11/1980 | Dart et al. | 204/159.19 |
| 4,271,606 | A | 6/1981 | Rudy | 36/29 |
| 4,287,250 | A | 9/1981 | Rudy | 428/166 |
| 4,287,613 | A | 9/1981 | Schultz | 2/413 |
| 4,292,263 | A | 9/1981 | Hanrahan et al. | 264/46.5 |
| 4,306,315 | A | 12/1981 | Castiglia | 2/22 |
| D264,140 | S | 5/1982 | Jenkins | D2/27 |
| 4,340,626 | A | 7/1982 | Rudy | 428/35 |
| 4,344,189 | A | 8/1982 | Futere et al. | 2/16 |
| 4,370,754 | A | 2/1983 | Donzis | 2/2 |
| D269,134 | S | 5/1983 | Buring et al. | D2/27 |
| D269,920 | S | 8/1983 | Buring et al. | D2/27 |

(Continued)

FOREIGN PATENT DOCUMENTS

| | | | |
|---|---|---|---|
| DE | 3011566 | A1 | 11/1980 |

(Continued)

OTHER PUBLICATIONS

Frank H. Netter, M.D., *Atlas of Human Anatomy*, 1989, Plate No. 491 Abstract, *Neurology*, Sep. 1998; 51(3): 791-6, "Chronic Traumatic Brain Injury in Professional Soccer Players".

(Continued)

*Primary Examiner*—Tejash Patel
(74) *Attorney, Agent, or Firm*—Westerman, Champlin & Kelly, P.A.

(57) ABSTRACT

The present invention teaches articles of apparel and protective equipment including light-cure materials having a permanent memory capability. Accordingly, the present invention can be used to make shin guards, knee pads, thigh pads, hip pads, rib guards, shoulder pads, elbow pads, biceps pads, forearm pads, gloves, neck guards, face guards, chin straps, wrist guards, helmets, prosthetic devices, body armor, splints and casts.

28 Claims, 46 Drawing Sheets

U.S. PATENT DOCUMENTS 4,441,211 A 4/1984 Donzis ..... 2/2
4,453,271 A 6/1984 Donzis ..... 2/2
4,484,360 A 11/1984 Leighton et al. ..... 2/22
4,486,901 A 12/1984 Donzis ..... 2/2
D278,470 S 4/1985 Eghamn ..... D2/27
4,512,340 A 4/1985 Buck ..... 128/90
4,513,449 A 4/1985 Donzis ..... 2/2
D284,038 S 6/1986 Eghamn et al. ..... D2/27
4,646,368 A 3/1987 Infusino et al. ..... 2/421
4,667,661 A 5/1987 Scholtz et al. ..... 128/90
4,669,126 A 6/1987 Jones ..... 2/22
4,674,206 A 6/1987 Lyden ..... 36/88
4,683,877 A 8/1987 Ersfeld et al. ..... 128/90
4,756,026 A 7/1988 Pierce, Jr. ..... 2/16
4,774,937 A 10/1988 Scholz et al. ..... 128/90
4,831,668 A 5/1989 Schultz ..... 2/414
4,856,502 A 8/1989 Ersfeld et al. ..... 128/90
4,872,216 A 10/1989 Wingo ..... 2/2
4,874,640 A 10/1989 Donzis ..... 427/421
4,888,225 A 12/1989 Sandvig et al. ..... 428/71
4,903,350 A 2/1990 Gentes et al. ..... 2/421
4,906,502 A 3/1990 Rudy ..... 428/69
4,926,501 A 5/1990 Goosen ..... 2/22
4,926,503 A 5/1990 Wingo ..... 2/267
4,936,029 A 6/1990 Rudy ..... 36/29
D310,278 S 8/1990 Quinlan ..... D29/10
4,946,726 A 8/1990 Sandvig et al. ..... 428/76
D311,977 S 11/1990 Eghamn ..... D29/10
4,970,807 A 11/1990 Anderie et al. ..... 36/28
4,985,931 A 1/1991 Wingo ..... 2/2
4,993,082 A 2/1991 Gentes et al. ..... 2/410
4,999,847 A 3/1991 Barcelo ..... 2/24
5,002,047 A 3/1991 Sandvig et al. ..... 128/90
5,014,689 A 5/1991 Meunchen et al. ..... 128/77
5,029,341 A 7/1991 Wingo ..... 2/2
5,035,009 A 7/1991 Wingo ..... 2/414
5,036,761 A 8/1991 Wingo ..... 101/148
5,040,795 A 8/1991 Sonntag ..... 273/58
5,042,176 A 8/1991 Rudy ..... 36/29
5,042,464 A 8/1991 Skwor et al. ..... 128/80 C
5,083,361 A 1/1992 Rudy ..... 29/454
5,101,580 A 4/1992 Lyden ..... 36/93
5,118,722 A 6/1992 Wollmann et al. ..... 521/137
5,175,889 A 1/1993 Infusino ..... 2/413
5,181,717 A 1/1993 Donntag et al. ..... 273/58 BA
5,190,802 A 3/1993 Pilato ..... 428/111
5,203,793 A 4/1993 Lyden ..... 36/88
5,235,715 A 8/1993 Donzis ..... 12/142 R
5,263,203 A 11/1993 Kraemer et al. ..... 2/413
5,297,294 A 3/1994 Washick ..... 2/22
5,301,370 A 4/1994 Henson ..... 2/22
5,378,531 A 1/1995 Larson et al. ..... 12/142 N
5,381,560 A 1/1995 Halstead ..... 2/421
5,384,913 A 1/1995 Hendry ..... 2/22
5,405,312 A 4/1995 Jacobs ..... 602/5
5,406,719 A 4/1995 Potter ..... 36/28
5,435,007 A 7/1995 Kalvestram et al. ..... 2/16
5,437,112 A 8/1995 Johnston ..... 36/128
D362,087 S 9/1995 Anson ..... D29/120
5,454,780 A 10/1995 Duback et al. ..... 602/8
5,456,658 A 10/1995 Duback et al. ..... 602/8
5,477,559 A 12/1995 Clement ..... 2/22
5,480,376 A 1/1996 Duback et al. ..... 602/8
5,481,762 A 1/1996 Gentes et al. ..... 2/411
5,491,840 A 2/1996 Yen ..... 2/2
5,543,194 A 8/1996 Rudy ..... 428/69
5,544,663 A 8/1996 Duback ..... 128/846
5,572,804 A 11/1996 Skaja et al. ..... 36/29
5,575,017 A 11/1996 Hefling et al. ..... 2/418
5,581,817 A 12/1996 Hicks ..... 2/239
5,592,706 A 1/1997 Pearce ..... 5/654
D378,624 S 3/1997 Chartrand ..... D29/106
5,611,080 A 3/1997 Skottheim ..... 2/16
5,625,896 A 5/1997 LaBarbera et al. ..... 2/22
5,626,657 A 5/1997 Pearce ..... 106/122
5,632,057 A 5/1997 Lyden ..... 12/146 B
5,637,077 A 6/1997 Parker ..... 602/8
D381,131 S 7/1997 Duback et al. ..... D29/120
5,659,900 A 8/1997 Arney et al. ..... 2/417
D389,959 S 1/1998 Collins et al. ..... D29/120
5,711,028 A 1/1998 Bourque et al. ..... 2/22
5,732,411 A 3/1998 Coleman et al. ..... 2/22
5,732,713 A 3/1998 Duback et al. ..... 128/846
5,742,938 A 4/1998 Winningham et al. ..... 2/22
5,742,945 A 4/1998 Lindaman ..... 2/239
D394,110 S 5/1998 Duback et al. ..... D24/192
D394,112 S 5/1998 Duback et al. ..... D24/192
5,755,001 A 5/1998 Potter et al. ..... 12/142 P
D394,905 S 6/1998 Duback et al. ..... D24/192
D395,158 S 6/1998 Lindaman ..... D2/986
5,766,141 A 6/1998 Gould ..... 602/21
5,769,804 A 6/1998 Harris et al. ..... 602/21
5,775,678 A 7/1998 Ferland ..... 602/6
5,778,449 A 7/1998 Oetting et al. ..... 2/16
5,794,272 A 8/1998 Workman et al. ..... 2/421
5,794,274 A 8/1998 Kraemer ..... 2/421
5,802,739 A 9/1998 Potter et al. ..... 36/29
5,813,050 A 9/1998 Popowski ..... 2/16
5,829,055 A 11/1998 Collins et al. ..... 2/22
5,832,630 A 11/1998 Potter ..... 36/29
5,842,475 A 12/1998 Duback et al. ..... 128/846
5,868,693 A 2/1999 Duback et al. ..... 602/27
5,890,224 A 4/1999 Clark ..... 2/22
5,911,310 A 6/1999 Bridgers ..... 2/22
5,926,844 A 7/1999 Bear ..... 2/22
5,952,078 A 9/1999 Park ..... 428/105
5,976,451 A 11/1999 Skaja et al. ..... 264/516
5,979,078 A 11/1999 McLaughlin ..... 36/29
5,993,585 A 11/1999 Goodwin et al. ..... 156/145
6,013,340 A 1/2000 Bonk et al. ..... 428/35.2
6,020,055 A 2/2000 Pearce ..... 428/323
6,029,962 A 2/2000 Shorten et al. ..... 267/145
6,065,152 A 5/2000 Parker ..... 2/22
6,082,025 A 7/2000 Bonk et al. ..... 36/29
6,098,313 A 8/2000 Skaja ..... 36/28
6,105,164 A 8/2000 Huang ..... 2/22
6,119,371 A 9/2000 Goodwin et al. ..... 36/29
6,126,626 A 10/2000 Duback et al. ..... 602/27
6,127,026 A 10/2000 Bonk et al. ..... 428/213
6,128,777 A 10/2000 Foreman ..... 2/16
6,131,195 A 10/2000 Foreman ..... 2/22
6,134,720 A 10/2000 Foreman ..... 2/455
6,152,892 A 11/2000 Masini ..... 602/6
6,161,240 A 12/2000 Huang ..... 5/710
6,178,556 B1 1/2001 Foreman et al. ..... 2/22
6,202,223 B1 3/2001 Chartrand ..... 2/410
6,205,583 B1 3/2001 Beland ..... 2/16
6,226,795 B1 5/2001 Winningham ..... 2/20
6,226,797 B1 5/2001 Tollini ..... 2/22
6,247,188 B1 6/2001 Beland ..... 2/461
D445,221 S 7/2001 Foreman et al. ..... D29/120.1
6,258,421 B1 7/2001 Potter ..... 428/35.2
6,269,485 B1 8/2001 Foreman ..... 2/22
6,298,484 B1 10/2001 Beckman ..... 2/22
6,321,465 B1 11/2001 Bonk et al. ..... 36/28
6,374,514 B1 4/2002 Swigart ..... 36/35 B
6,385,864 B1 5/2002 Sell, Jr. et al. ..... 36/29
6,391,405 B1 5/2002 Bonk et al. ..... 428/35.2
6,402,879 B1 6/2002 Tawney et al. ..... 156/292
6,430,843 B1 8/2002 Potter et al. ..... 36/29
6,457,262 B1 10/2002 Swigart ..... 36/29
6,490,730 B1 12/2002 Lyden ..... 2/22
6,681,403 B1 * 1/2004 Lyden ..... 2/22

FOREIGN PATENT DOCUMENTS

| | | | |
|---|---|---|---|
| DE | 4403390 | A1 | 4/1994 |
| GB | 1512553 | | 6/1978 |
| WO | WO 0170061 | A2 | 9/2001 |
| WO | WO 0170062 | A2 | 9/2001 |
| WO | WO 0170063 | A2 | 9/2001 |
| WO | WO 0170064 | A2 | 9/2001 |
| WO | WO 0178539 | A2 | 10/2001 |
| WO | WO 0170060 | A2 | 11/2001 |

OTHER PUBLICATIONS

Abstract, *Tidsskr Nor Laegeforen*, Apr. 10, 1992; 112 (10) : 1268-71, "Head and Neck Injuries Among Norwegian Soccer Players. A Neurological, Electroencephalographic, Radiologic and Neuropsychological Evaluation".

* cited by examiner

FIG. 15
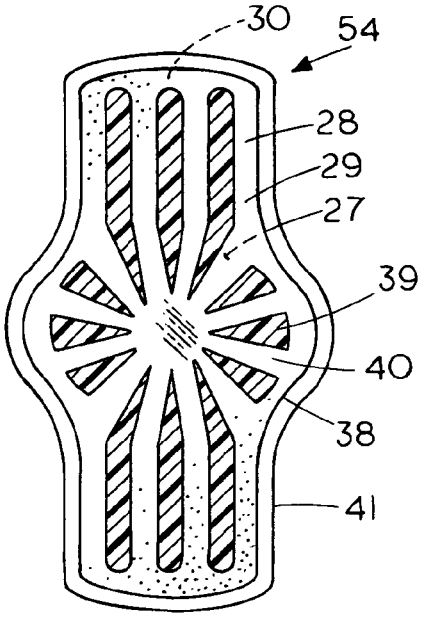
FIG. 16.1
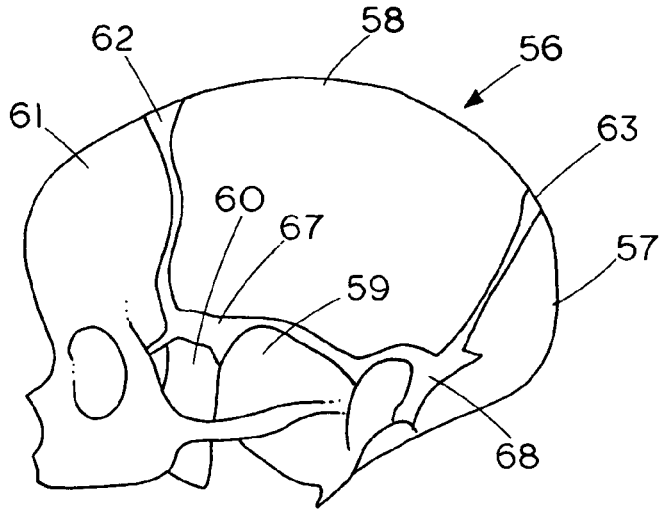
FIG. 16.2
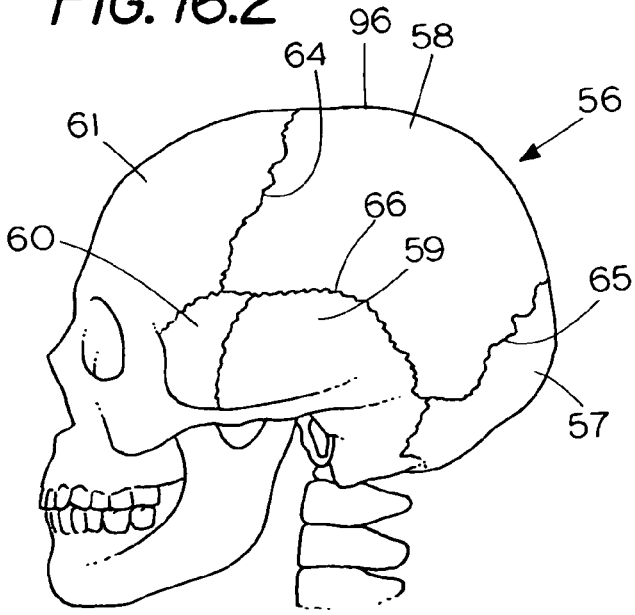

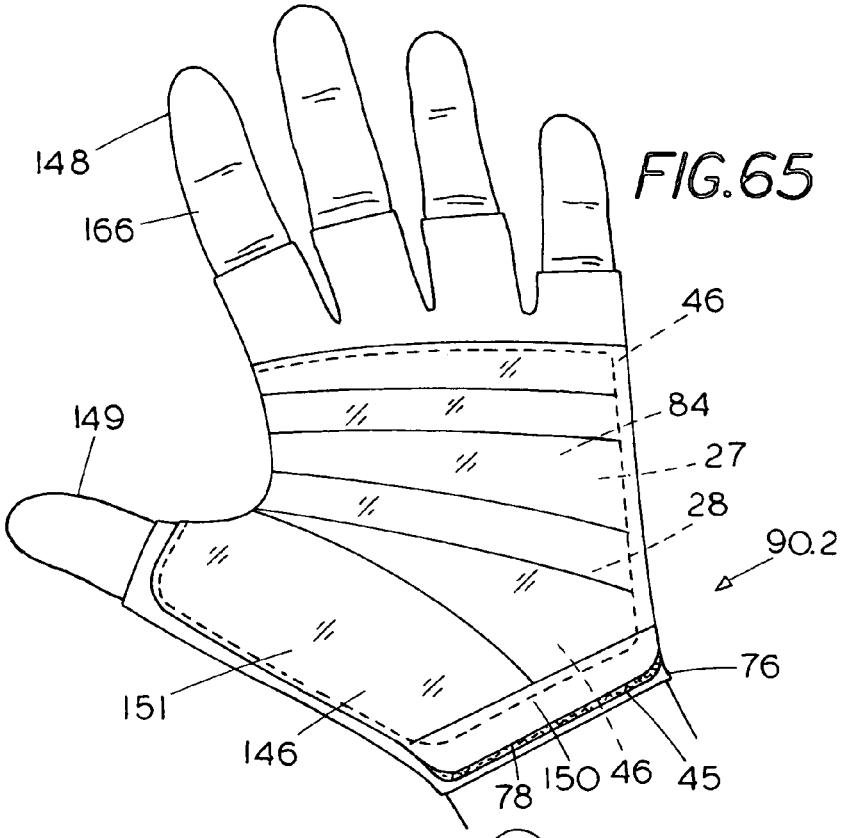
FIG. 65
FIG. 66
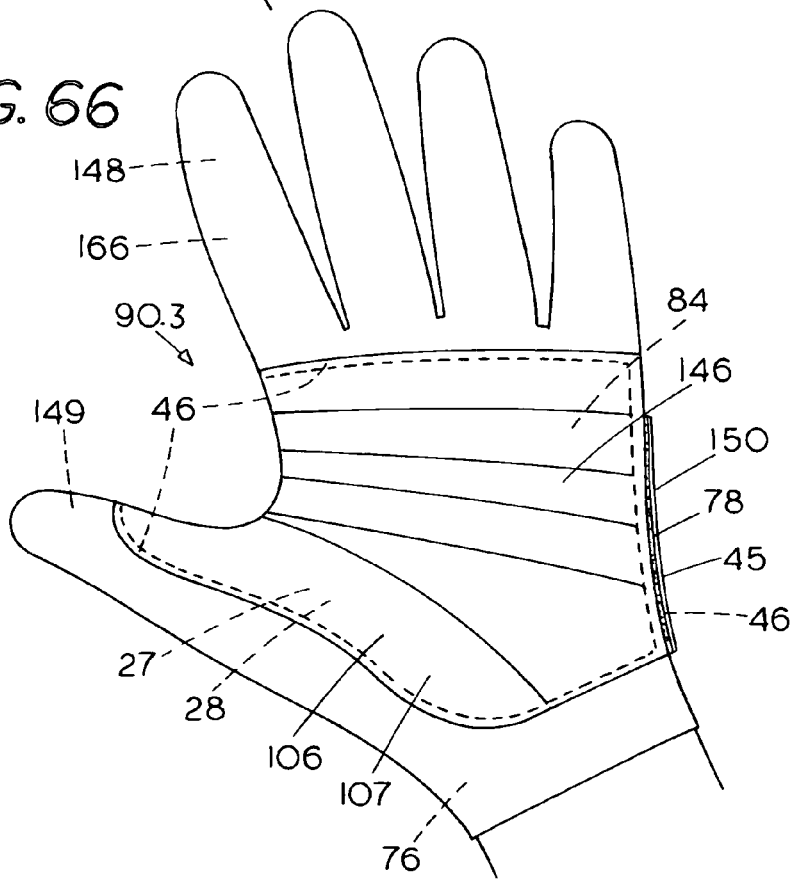

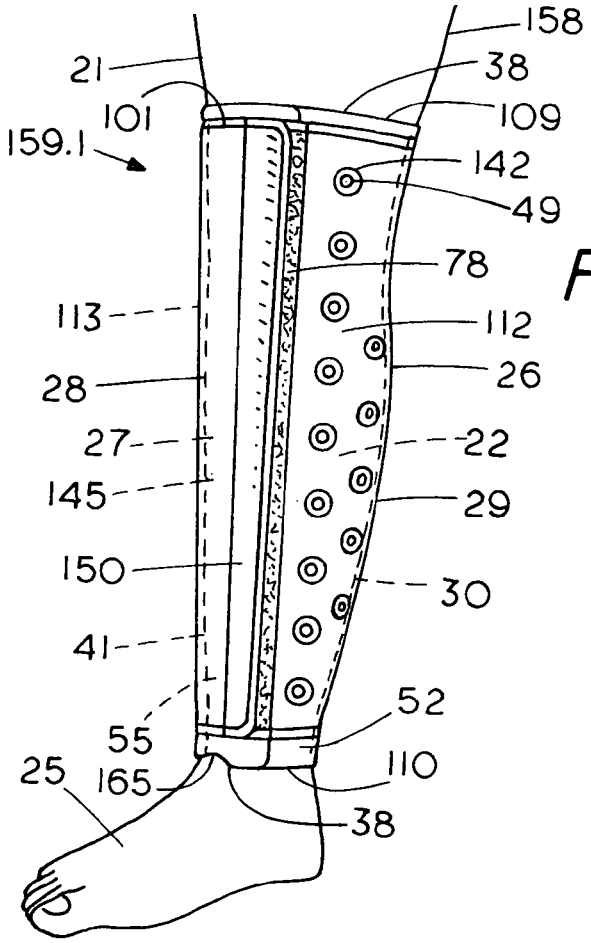
FIG. 72
FIG. 73
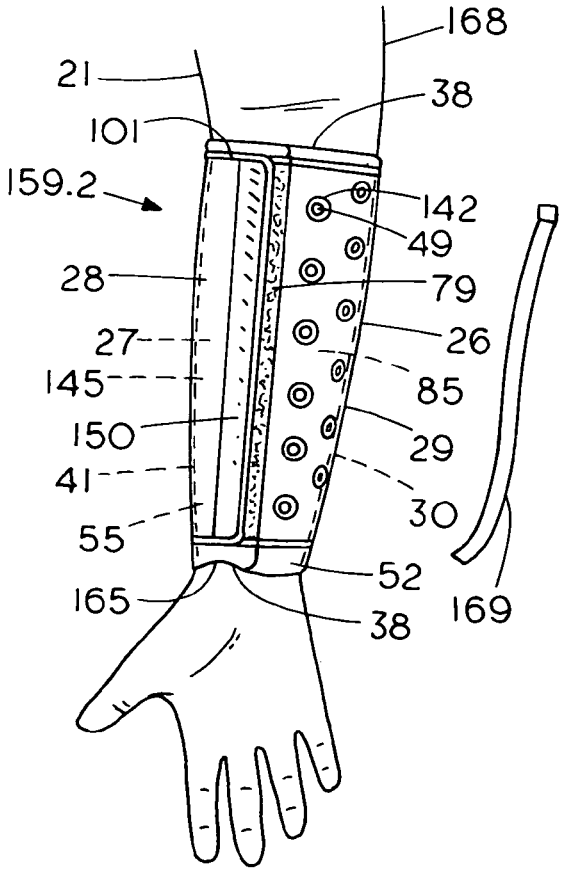

SHIN-GUARD, HELMET, AND ARTICLES OF PROTECTIVE EQUIPMENT INCLUDING LIGHT CURE MATERIAL

RELATED U.S. APPLICATION DATA

This application is a continuation-in-part of U.S. patent application Ser. No. 10/213,843, filed Aug. 7, 2002 now U.S. Pat. No. 6,681,403, which was a continuation-in-part of U.S. patent application Ser. No. 09/523,851 filed on Mar. 13, 2000, now U.S. Pat. No. 6,490,730, and priority on both applications is hereby claimed.

FIELD OF THE INVENTION

The present invention relates to the field of apparel, and in particular, to custom articles of protective equipment which include light cure materials, and methods of making the same.

BACKGROUND OF THE INVENTION

The use of shin guards, knee pads, thigh pads, hip pads, rib guards, shoulder pads, elbow pads, biceps pads, forearm pads, gloves, neck guards, face guards, chin straps and guards, wrist guards, braces, and helmets is prevalent in a large number of contact and non-contact sports including soccer, football, hockey, baseball, volleyball, and in-line skating. Protective knee pads and helmets also enjoy widespread use in the construction industry, military, and in the field of transportation including bicycle, motorcycle, and sports automobile operation. Prosthetic devices such as back supports and wrist guards which can include conforming shields or pads are also widely used. Moreover, splints and casts are also sometimes used to stabilize and protect a portion of a wearer's anatomy.

Many articles of athletic and protective equipment include a hard outer shell made of leather, natural or synthetic rubber, glass or carbon fiber composites, thermoplastics, metal, and the like. Often, such articles will include a relatively soft inner liner of padding material which is made, e.g., of cotton, wool, natural or synthetic rubber, thermoplastic material, foam material, gas filled bladders, flowable solids or liquids, bladders including a moldable and curable material, or various textile materials. Most of these articles of protective equipment have relied upon the incorporation of generic norms or average shapes with regards to those surfaces contacting the anatomy in order to provide limited accommodation to the unique anatomical features and characteristics of an individual wearer. However, pre-formed structures of various kinds imperfectly accommodate a greater or lesser number of individuals depending upon the incorporation of characteristic norms in their design and fabrication. As every individual has different anatomical features and characteristics, a pre-formed structure will not accommodate every individual to the same degree.

Moreover, recent research has revealed that soccer players are at risk of chronic traumatic brain injury due to repeated heading of the soccer ball. The cumulative trauma has a degenerative effect similar to that which has been observed in boxers. It should be recognized that a soccer ball can travel at approximately 60 miles per hour and impact the head with a force of 175 pounds. The following studies have documented this phenomenon:

J. T. Maser et al., "Chronic Traumatic Brain Injury In Professional Soccer Players," *Neurology,* 1998, September; 51 (3): pages 791–796.

A. T. Tysvaer et al., "Head and Neck Injuries Among Norwegian Soccer Players. A Neurological, Electroencephalographic, Radiologic and Neuropsychological Evaluation," *Tidsskr Nor Laegeforen,* 1992, April, 10; 112 (10): pages 1268–1271.

A. T. Tysvaer, "Head and Neck Injuries In Soccer. Impact of Minor Trauma," *Sports Medicine,* 1992, September; 14(3): pages 200–213.

A. T. Tysvaer et al., "Soccer Injuries to the Brain. A Neuropsychological Study of Former Soccer Players," *American Journal of Sports Medicine,* 1991, January–February; 19 (1): pages 56–60.

A. T. Tysvaer et al., "Soccer Injuries to the Brain. A Neurologic and Electroencephalographic Study of Active Football Players." *American Journal of Sports Medicine,* 1989, July–August; 17 (4): pages 573–578.

O. Sortland, et al., "Brain Damage in Former Association Football Players. An Evaluation by cerebral Computed Tomography," *Neuroradiology,* 1989; 31 (1): pages 44–48.

B. P. Boden, et al., "Concussion Incidence in Elite College Soccer Players," *American Journal of Sports Medicine,* 1998, March–April; 26 (2): pages 238–241.

There is then a need for a novel protective helmet for use in soccer which will at least partially attenuate the impact that takes place when a soccer ball is headed. Further, it can be readily understood that it would be advantageous that such a helmet closely conform to the anatomical features of the wearer's head and permit control of the soccer ball while heading.

There have been attempts to made custom molded articles of protective equipment having a permanent memory capability, in particular, U.S. Pat. No. 5,454,780, U.S. Pat. No. 5,456,658, U.S. Pat. No. 5,480,376, U.S. Pat. No. 5,544,663, D381,131, D394,110, D394,112, D394,905, U.S. Pat. No. 5,637,077, U.S. Pat. No. 5,732,713, U.S. Pat. No. 5,755,678, U.S. Pat. No. 5,842,475, U.S. Pat. No. 5,868,693, U.S. Pat. No. 6,065,152, U.S. Pat. No. 6,126,626, U.S. Pat. No. 6,128,777, U.S. Pat. No. 6,131,195, U.S. Pat. No. 6,134,720, U.S. Pat. No. 6,152,892, U.S. Pat. No. 6,178,556, U.S. Pat. No. 6,226,795, D445,221, and U.S. Pat. No. 6,269,485 assigned to Parker Medical Associates LLC and/or Parker Athletic Products, LLC of Charlotte, N.C., all of these patents hereby being incorporated by reference herein.

U.S. Pat. No. 4,292,263 granted to James Hanrahan, et al. is directed to the making of protective padding. U.S. Pat. No. 6,065,152 assigned to Adidas, and also DE 3011566 A1 and DE 4403390 A1 assigned to Karl Uhl GmbH, are directed to making shin guards, and all of these patents are hereby incorporated by reference herein. Further, there are numerous patents directed towards the making of casts or braces held by 3M, that is, Minnesota Mining and Manufacturing Company of St. Paul, Minn., e.g., U.S. Pat. No. 4,667,661, U.S. Pat. No. 4,683,877, U.S. Pat. No. 4,774,937, U.S. Pat. No. 4,856,502, U.S. Pat. No. 4,888,225, U.S. Pat. No. 4,946,726, U.S. Pat. No. 5,002,047, and U.S. Pat. No. 5,042,464.

In addition, the present inventor's U.S. Pat. No. 4,674,206, U.S. Pat. No. 5,101,580, U.S. Pat. No. 5,203,793, and in particular, U.S. Pat. No. 5,632,057, include teachings relating to the customization of footwear components, all of these patents hereby being incorporated by reference herein. The present application is a Continuation-In-Part of U.S. patent application Ser. No. 10/213,843, filed Aug. 7, 2002, which was a Continuation-In-Part of U.S. patent application Ser. No. 09/523,851 filed on Mar. 13, 2000, now U.S. Pat. No. 6,490,730 granted Dec. 10, 2002, which was a Continuation-In-Part of Ser. No. 08/862,598 filed on May 23, 1997, which was a Continuation of U.S. Pat. No. 5,632,057 which was granted on May 17, 1997. It was anticipated in the applicant's U.S. Pat. No. 5,632,057, column 37, lines 33–46, that the teachings contained therein with respect to the use of light-cure materials could be applied to the general subject matter of the present application. U.S. Pat. No. 3,905,376, granted to Amos Johnson et al., hereby incorporated by reference herein, teaches various custom prosthetic devices including light cure material having permanent memory. U.S. Pat. No. 4,512,340, granted to Carl Buck, hereby incorporated by reference herein, teaches the use of light cure materials in making casts.

The procedures and methods associated with many previous attempts to make custom molded articles of protective equipment having a permanent memory capability have been relatively complex, time consuming, expensive, or otherwise not amenable to mass production and use by the general public. Accordingly, it is an object of the present invention to provide a fast, easy, effective and inexpensive method of making custom molded articles of protective equipment having a permanent memory capability.

SUMMARY OF THE INVENTION

The present invention teaches a device for protecting a portion of a wearer's anatomy, and a method of making the same. The device comprises a bladder containing a light cure material which can be caused to set and cure when exposed to light having a wavelength in the range between 280–780 nanometers. The device can permanently retain the shape imparted thereto when the light cure material is caused to set and cure, and thus provide a wearer with a custom fit. Accordingly, the present invention can be used to make a wide variety of guards and pads for protecting a wearer from impact events and possible injury. For example, the present invention can be used to make custom protective equipment including but not limited to shin guards, knee pads, elbow pads, helmets, body armor, and prosthetic devices. The present invention can be also used to make splints and casts for stabilizing and protecting a portion of a wearer's anatomy.

The device for protecting a portion of a wearer's anatomy according to the present invention comprises a bladder containing a light cure material including a fiber filler material, said light cure material being caused to set and cure when exposed to light having a wavelength in the range between 280–780 nanometers.

The fiber filler material can comprise a fiber filler material taken from the select group of fiber filler materials consisting of aramid fiber, boron fiber, carbon fiber, glass fiber, polyester fiber, and polyethylene fiber. A preferred fiber filler material for use in the present invention comprises glass fiber. It can be advantageous that the fiber filler material comprise in the range between ten and ninety percent of the volume of the mixture comprising the light cure material and the fiber filler material contained within a bladder.

The device for protecting a portion of a wearer's anatomy can further include a non-woven, woven, or knitted textile material in contact with the light cure material which is contained in a bladder. The textile material can consist of glass, aramid, carbon fiber, polyester, polyethylene, or boron materials. The preferred textile material is made of a fiberglass material. Accordingly, the textile material can be substantially inelastic. Alternatively, the textile material can be made of stretchable and elastic materials.

The light cure material can comprise a polyurethane material. Alternatively, the light cure material can comprise an epoxy material. The light cure material can be contained in a bladder to prevent oxygen inhibition, contamination, and contact with a wearer during the curing process. The light cure material can be caused to cure using visible light and/or ultraviolet light.

The bladder can be made of a thermoplastic film Alternatively, the bladder can be made in part by a thermoplastic film comprising the outer layer of the bladder which can be affixed to a foam material. The thermoplastic film can be substantially transparent. The thermoplastic film can comprise polyurethane.

The device for protecting a portion of a wearer's anatomy can further comprise a foam material. The foam material can be made of ethylene vinyl acetate, polyurethane, or polyethylene. The foam material can further comprise a plurality of peaks and valleys. The foam material can be secured in functional relation to the exterior of a bladder to comprise a pad for use in the present invention. Alternatively, the foam material can be impregnated or in contact with the light cure material and be contained within a bladder.

The device for protecting a portion of a wearer's anatomy can further comprise a fluid filled bladder. The fluid can comprise a gas. Alternatively, the gas can comprise a mixture of gases. The gas can be pressurized at atmospheric pressure. Alternatively, the gas can be pressurized above atmospheric pressure. The gas can be contained within the bladder.

The device for protecting a portion of a wearer's anatomy can comprise an anterior bladder and a posterior bladder, said anterior bladder containing a light cure material including a fiber filler material said light cure material being caused to set and cure when exposed to light having a wavelength in the range between 280–780 nanometers, and said posterior bladder containing a gas, said anterior bladder and said posterior bladder configured in an overlapping relationship.

The device for protecting a portion of a wearer's anatomy can comprise three layers of thermoplastic film affixed together in functional relation thereby forming an anterior bladder and a posterior bladder, said anterior bladder containing a light cure material including a fiber filler material said light cure material being caused to set and cure when exposed to light having a wavelength in the range between 280–780 nanometers, said posterior bladder containing a gas.

The device for protecting a portion of a wearer's anatomy can include a bladder which is affixed to a foam material, and the bladder can comprise the anterior side and the foam material can comprise the posterior side of the device.

The device for protecting a portion of a wearer's anatomy can comprise a bladder containing a light cure material including a fiber filler material, said light cure material being caused to set and cure when exposed to light having a wavelength in the range between 280–780 nanometers, said device further comprising an anterior side, a posterior side, and a foam material, said bladder secured to said foam material and substantially comprising said anterior side, and said foam material substantially comprising said posterior side of said device.

The device for protecting a portion of a wearer's anatomy can comprise an anterior bladder and a posterior bladder configured in an overlapping relationship.

The device for protecting a portion of a wearer's anatomy can comprise at least two bladders configured in a side-by-side relationship.

The device for protecting a portion of a wearer's anatomy can comprise a reflective material.

The device for protecting a portion of a wearer's anatomy can comprise a plurality of openings for ventilation.

The device for protecting a portion of a wearer's anatomy can comprise a plurality of channels for ventilation.

The device for protecting a portion of a wearer's anatomy can comprise a pressure sensitive adhesive.

The device for protecting a portion of a wearer's anatomy can comprise at least one strap.

The device for protecting a portion of a wearer's anatomy can comprise hook and pile.

The device for protecting a portion of a wearer's anatomy can comprise a guard for protecting a portion of a wearer's anatomy.

The device for protecting a portion of a wearer's anatomy can comprise a guard for protecting a portion of a wearer's anatomy taken from the select group of guards consisting of finger guards, hand guards, glove guards, wrist guards, forearm guards, elbow guards, arm guards, biceps guards, shoulder guards, head guards, helmets, neck guards, back guards, hip guards, torso guards, rib guards, leg guards, thigh guards, knee guards, shin guards, ankle guards, foot guards, splints, casts, and body armor.

The device for protecting a portion of a wearer's anatomy can comprise a pad for protecting a portion of a wearer's anatomy.

The device for protecting a portion of a wearer's anatomy can comprise a pad for protecting a portion of a wearer's anatomy taken from the select group of pads consisting of finger pads, hand pads, glove pads, wrist pads, forearm pads, elbow pads, arm pads, biceps pads, shoulder pads, head pads, helmet pads, chin strap pads, neck pads, back pads, hip pads, torso pads, rib pads, leg pads, thigh pads, knee pads, shin pads, ankle pads, foot pads, prosthesis pads, splint pads, cast pads, and body armor pads.

The device for protecting a portion of a wearer's anatomy according to the present invention can comprise a shin guard comprising a superior side, inferior side, medial side, lateral side, anterior side, and posterior side, said shin guard comprising a bladder containing a light cure material including a fiber filler material which can be caused to set and cure when exposed to light having a wavelength in the range between 280–780 nanometers.

The shin guard can comprise an asymmetrical shape as between the medial side and the lateral side.

The shin guard can comprise a superior guard portion for protecting a wearer's lower leg including a first strap near the superior side for affixing about the wearer's lower leg, and an inferior guard portion for protecting the wearer's medial and lateral malleoli including a second strap for affixing under the plantar side of the wearer's foot.

The shin guard can comprise a superior guard portion, and said inferior guard portion which are detachable.

The shin guard can comprise a posterior guard for protecting a wearer's Achilles tendon.

The shin guard can comprise one or more side guards for protecting a wearer's medial malleolus and lateral malleolus.

The shin guard can comprise a flex notch on the medial side.

The shin guard can comprise a first strap near the superior side, and a second strap near the inferior side.

The shin guard can be secured upon a wearer with the use of a sock. Alternatively, the shin guard can be secured upon a wearer with the use a sleeve. Alternatively, the shin guard can be secured upon a wearer with the use of at least one strap. Alternatively, the shin guard can be inserted into the pocket of a pocket sock and donned on a wearer.

The device for protecting a portion of a wearer's anatomy can comprise a glove.

The device for protecting a portion of a wearer's anatomy can comprise a splint.

The device for protecting a portion of a wearer's anatomy can comprise a cast.

The device for protecting a portion of a wearer's anatomy can comprise body armor.

The device for protecting a portion of a wearer's anatomy can comprise a helmet. The helmet can include a plurality of segments comprising at least a temporal and sphenoidal segment for protecting the sides of the head proximate the temple and ear, an occipital segment for protecting the back of the head, a parietal segment for protecting the top of the head, and a frontal segment for protecting the front of the head. Alternatively, the parietal bladder and frontal bladder can both be made in two generally opposing bladders or chambers each protecting their respective medial or lateral aspect of the head. The helmet can comprise an outer surface which is textured, tactified, and includes raised grip elements, whether in partial or complete combination.

A preferred method of making a device for protecting a portion of a wearer's anatomy comprising a bladder containing a light cure material including a fiber filler material said light cure material being caused to set and cure when exposed to light having a wavelength in the range between 280–780 nanometers, comprising:

a) Opening a package which is substantially impenetrable to said light and removing said device;

b) Placing said device in position upon a wearer; and, c) Exposing said device to said light causing said light cure material to set and cure.

BRIEF DESCRIPTION OF THE DRAWINGS

FIG. 15 is a top plan view of an elbow pad including a light cure material.

FIG. 16.1 is a perspective view of the bones of an infant skull.

FIG. 16.2 is a perspective view of the bones of an adult skull.

FIG. 65 is a perspective view of the palm side of a glove generally similar to that shown in FIG. 63, but including an alternate access point to an interior pocket.

FIG. 66 is a perspective view of the palm side of a full-fingered glove.

FIG. 72 is a perspective view of a splint or cast for stabilizing and protecting a portion of a wearer's anatomy.

FIG. 73 is a perspective view of an alternate splint or cast for stabilizing and protecting a portion of a wearer's anatomy.

DETAILED DESCRIPTION OF THE PREFERRED EMBODIMENTS

The present invention teaches a device for protecting a portion of a wearer's anatomy, and a fast, easy and inexpensive method of making the same. The device consists of a bladder containing a light cure material which can be caused to set and cure when exposed to light having a wavelength in the range between 280–780 nanometers which corresponds to a substantial portion of the ultraviolet and visible light spectrums. The device can permanently retain the shape imparted thereto when the light cure material is caused to set and cure, and thus provide a wearer with a custom fit. Accordingly, the present invention can be used to make a wide variety of guards and pads for protecting a wearer from impact events and possible injury. For example, the present invention can be used to make custom protective equipment including but not limited to shin guards, knee pads, elbow pads, helmets, and body armor. The present invention can be also used to make splints and casts for stabilizing and protecting a portion of a wearer's anatomy.

Figure 1:
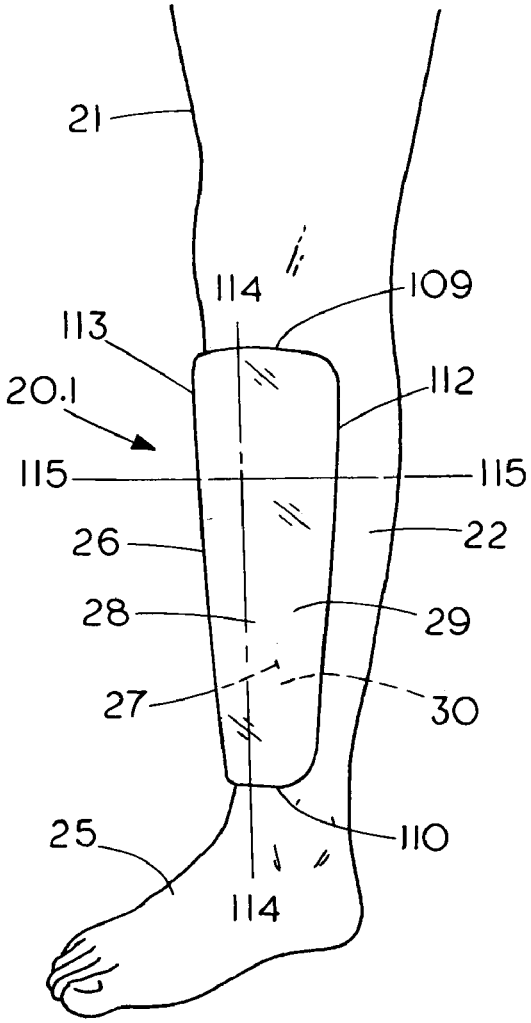
FIG. 1 is a perspective view of a shin guard including a bladder containing light cure material positioned on a wearer.

FIG. 1 is a perspective view of a preferred shin guard 20.1 including a light cure material 27 positioned on the lower leg 22 of a wearer 21. Shin guard 20.1 can be made of a thermoplastic material such as a thin flexible plastic film 26 which is sealed about any mating edges so as to create a bladder 28. The preferred film 26 for a bladder 28 can be made of polyurethane and can range in thickness between 5–50 mils, depending upon the particular application. Suitable polyurethane films include MP 1880AE and MP 1890 AE having a thickness of 0.02 inches and having a Shore A hardness of 80–90, which are made by Deerfield Urethane, Inc. of Deerfield, Mass., but other materials can be suitable for use including those taught in the patents assigned to Nike, Inc. which have been recited and incorporated by reference later in this specification. Two or more layers of film 26 can be affixed and sealed to form a bladder 28 by radio frequency welding, heat and pressure welding, adhesive, and the like. The film can also be formed to a desired more complex three dimensional shape by vacuum molding, or alternatively by blow-molding or other conventional means known in the art. The outer layer 29 of the bladder 28 faces generally opposite the inner layer 30 of the bladder 28, the former being more distant and the latter being closest to the wearer's body. Preferably, at least the outer layer 29 of the bladder 28 is made of a substantially transparent film 26 that permits the transmission of light therethrough. A light-cure material 27 in a substantially liquid or viscous state is contained within bladder 28. The shin guard 27 can be contained in a closed container for storage or shipping such as a jar, box, bag, package or sealed pouch, and the like, that does not substantially permit the transmission of ultraviolet and visible light. Such a container can be said to be substantially impermeable or impenetrable to ultraviolet and visible light. A package or sealed pouch including a thin plastic film including metallic foil can be advantageous for use. In particular, the preferred package can be made using a flexible plastic thin film-including metallic foil which is identified as PAKVf56T by IMPAK, Corporation of 2460 East 57th Street, Los Angeles, Calif. When shin guard 20.1 is removed from a closed container or package and donned by a wearer 21, exposure of the shin guard 20.1 to a visible or ultraviolet light source such as sunlight, or a suitable man-made light source will cause the light cure material 27 contained within the bladder 28 to cure and form substantially solid matter.

Light is herein defined as electromagnetic radiation having a wavelength between 280 and 780 nanometers, thus includes a substantial portion of the ultraviolet and visible light spectrum. It can be advantageous to use natural sunlight or artificial visible light having a wavelength between 400 and 780 nanometers, since it is possible for exposure to artificial ultraviolet light to cause injury to skin and eye tissue.

One manufacturer of visible light photoinitiators, and in particular, of a blue light photoinitiator known as H-NU 470, is Spectra Group Limited of Maumee, Ohio. Another manufacturer of visible light photoinitiators is Ciba Specialty Chemicals of Tarrytown, N.Y. The preferred Ciba visible light photoinitiators include IRGACURE® 184, and in particular, IRGACURE® 784. Suitable Ciba ultraviolet light photoinitiators include IRGACURE® 369, and 819.

Suitable man-made or artificial light sources for curing include, but are not limited to fluorescent lamps. When a natural light photoinitiator which is especially sensitive to the blue portion of the light spectrum such as H-NU 470 made by Spectra Group Limited of Maumee, Ohio, or alternatively, IRGACURE® 784 made by Ciba Specialty Chemicals of Tarrytown, N.Y. is used to trigger the light cure reaction, fluorescent lamps having substantial power in the blue portion of the visible light spectrum can be advantageous for use, such as "Daylight/6500K," "Colortone 50/5000K," "Colortone 75/7500K," those identified as "Actinic" or "SuperActinic," and in particular, "Special Blue," made by the Phillips Lighting Company of Somerset, N.J. Similar florescent lamps are also made by General Electric, Westinghouse, and Osram/Sylvania. In particular, a preferred fluorescent lamp for use having exceptional brightness and sufficient spectral power in the blue portion of the visible light spectrum is General Electric's BIAX® F40/30BX/SPX50, and the like.

Suitable light cure materials having a wide range of physical and mechanical characteristics are made, e.g., by Dow Corning Corporation of Midland, Mich., UVEX, Inc. of Sunnyvale, Calif., Sartomer, Inc. of Exton, Pa., 3M Minnesota Mining Company of St. Paul, Minn., Loctite Corporation of Rocky Hill, Conn., and Borden, Inc. of Columbus, Ohio. For example, Q3-6696 made by Dow Corning Corporation, or 3584 made by Loctite Corporation, and the like, can be suitable for use as a relatively soft, flexible, and shock absorbing light cure material, whereas 3102 or 3106 made by Loctite Corporation can be suitable for use as relatively rigid and non-flexible light cure material. Another major manufacturer of light cure materials known by the EBERCRYL® trademark is UCB Radcure of Smyrna, Ga. A ultraviolet light cure polyester resin and also a light cure epoxy known by the trade name SOLAREZ that are made by Wahoo International, in Oceanside, Calif. can be used to make a relatively rigid light cure material. When used alone, this polyester resin is relatively brittle when flexed, but when it is used to impregnate a textile material such as fiberglass, the resulting product is relatively robust. The preferred light cure materials for use are made by San Rafael Coating of 700 Hawthorne Street, #A, Glendale, Calif. In particular, a material made of an acrylated urethane and monomer blend known as SRC A-3, and another material made of an acrylic oligomer and monomer blend epoxy known as SRC A-8 have been developed for use with the present invention.

Figure 2:
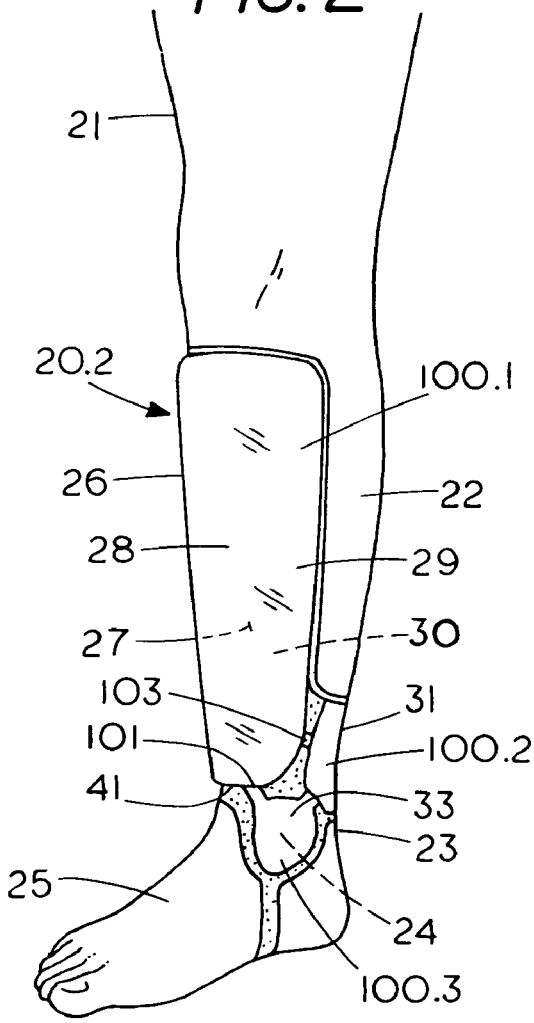
FIG. 2 is a perspective view of an alternate shin guard including a bladder containing light cure material positioned on a wearer.

FIG. 2 is a perspective view of an alternate preferred shin guard 20.2 including a light cure material 27 positioned on the lower leg 22 of a wearer 21. Alternate shin guard 20.2 can include a posterior guard 31 for protecting a portion of the Achilles tendon 23, and/or side guards 33 for protecting the malleoli 24. As shown in FIG. 2, shin guard 20.2 can include separate chambers, such as chambers 100.1, 100.2, and 100.3, connected by passages 103 which can be sealed off by welds 101, as desired. Alternatively, shin guard 20.2 including posterior guard 31 and side guard(s) 33 can consist of completely separate bladders.

Figure 3:
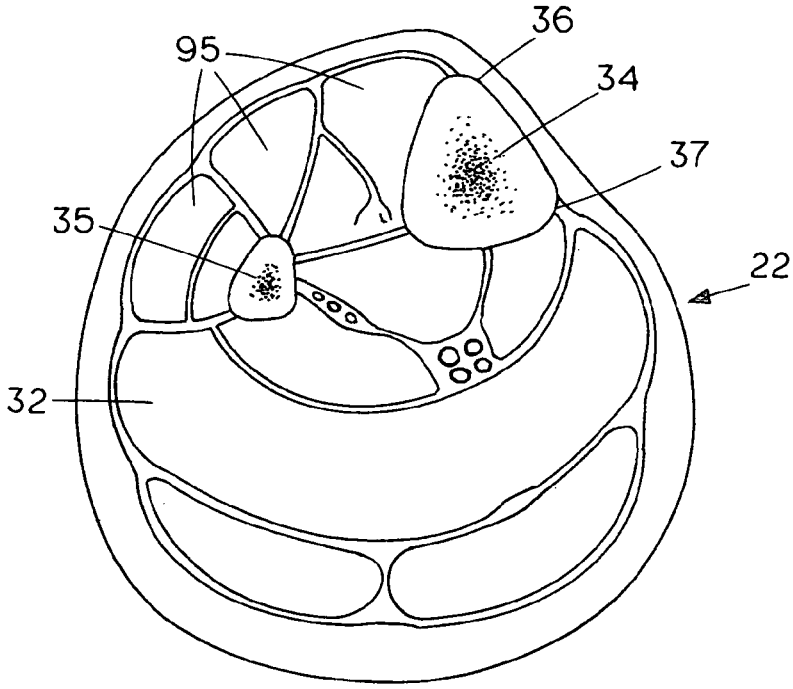
FIG. 3 is a cross-sectional view of the lower left leg of a wearer, taken along the transverse axis.

FIG. 3 is a cross-sectional view taken along the transverse plane of a wearer's left lower leg 22 adapted from *Atlas of Human Anatomy*, by Frank H. Netter, M.D., 1989, plate 491, showing the asymmetrical shape of the lower leg 22. Also shown is the location of the tibia 34, fibula 35, and a plurality of muscles 32 of the lower leg 22. A preferred shin guard 20 can provide protection for the tibia 34, in particular along the vulnerable anterior edge 36 and medial edge 37, and to the anterior muscles 95 of the lower leg 22.

Figure 4:
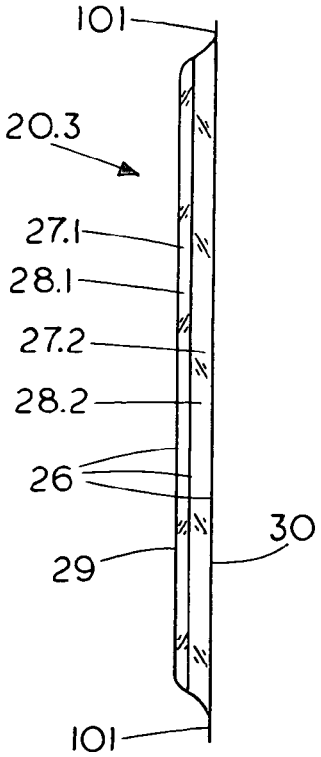
FIG. 4 is a cross-sectional side view of a shin guard including two bladders configured in an overlapping relationship containing two light cure materials having different physical and mechanical properties.

FIG. 4 is a cross-sectional side view of an alternate shin guard 20.3 including a first light cure material 27.1 contained in outer bladder 28.1, and a second light cure material 27.2 having different physical and mechanical properties contained in inner bladder 28.2. The bladders are configured in a overlapping relationship. Light cure material 27.1 contained in outer bladder 28.1 can form a relatively rigid material, and light cure material 27.2 contained in inner bladder 28.2 can form a relatively soft, flexible and resilient material when cured. As shown, shin guard 20.3 can be formed by three layers of film 26 which are affixed together using radio frequency welding, or alternatively, can be formed in two separate bladder portions. When shin guard 20.3 consists of a single integral unit, it can be advantageous that the light cure material 27.1 used in outer bladder 28.1 not cure prior to the cure of the light cure material 27.2 used in inner bladder 28.2, and/or the light cure material 27.1 should be substantially transparent or otherwise permit adequate light energy to reach light cure material 27.2 in order to cause it to cure. When shin guard 20.3 is formed in two separate bladder portions, the inner bladder 28.2 can be donned by a wearer and cured, then the outer bladder 28.1 be donned and secured in functional relation thereto and cured. The two separate bladder portions can be affixed to one another with the used of a self-adhesive material, light cure adhesive material, snap, friction fit, VELCRO® hook an pile, or other conventional mechanical means, and the like.

Figure 5:
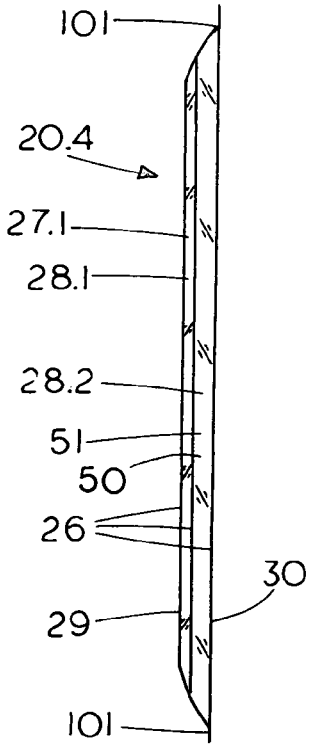
FIG. 5 is a cross-sectional side view of a shin guard including a bladder containing a gas.

FIG. 5 is a cross-sectional view of a shin guard 20.4 including an inner bladder 28.2 containing a void 50 that is filled with a gas 51. Other articles of protective equipment such as guards, pads, and helmets can include a bladder 28 containing a light cure material 27 and a gas 51, or a mixture of gases such as air. A captive gas 51 or a mixture of gases can be pressurized above or at atmospheric pressure. As shown in FIG. 5, the outer bladder 28.1 and inner bladder 28.2 are configured in an overlapping relationship. Shin guard 20.4 can be formed by three layers of thermoplastic film 26 which are affixed together using radio frequency welding, or alternatively, a shin guard can be formed in two separate bladder portions. The light cure material 27.1 contained in bladder 28.1 can form a relatively rigid material when cured.

Textile materials such as woven, non-woven, or knitted textiles made of glass, aramid, polyethylene, polyester, or carbon fiber materials, and the like, can also be included within bladder 28.1. Filler materials consisting of fine particles or flakes can also be included within a light cure material, and such particulate filler materials can consist of clay, talc, mica, soda lime borosilicate, sodium borosilicate, silica, aluminosilicate, fly ash, perlite, organic or inorganic microspheres, metal, steel, aluminum, titanium, zirconia, ceramics, boron carbide, silicone carbide, silicon nitride, aluminum nitride, and the like. Fiber filler materials such as short or long glass fibers, carbon fibers, aramid fibers, polyethylene fibers, polyester fibers or boron fibers, and the like, can also be included with a light cure material 27.1 in a bladder 28.1. In particular, chopped strand glass fibers identified as product type 3075 made by PPG Industries of Shelby, N.C. having a length of approximately 3.2 mm or ⅛ths inch can be used.

In the present invention, the addition of a glass fiber filler material can be used to cause the stiffness and hardness of the mixture consisting of the light cure material and fiber filler material contained in a bladder to increase as desired, that is, after the light cure material has been caused to set and cure. Generally, in order to effect a significant difference in the exhibited physical and mechanical properties of a device of the present invention the volume of fiber filler material used should be at least ten percent of the total volume of the mixture of the light cure material and fiber filler material. However, over-loading the light cure material with fiber filler material such that the latter constitutes over 90 percent of the total volume of the mixture of the light cure material and fiber filler material can result in a decrease in exhibited stiffness and hardness. Accordingly, the use of a fiber filler material in the range between ten and ninety percent of the volume of the mixture consisting of the light cure material and fiber filler material contained within a bladder is normally preferred. The specific proportions of light cure material and fiber filler material which are advantageous for use can vary depending upon the light cure material and fiber filler material being used, and also the particular application.

Figure 6:
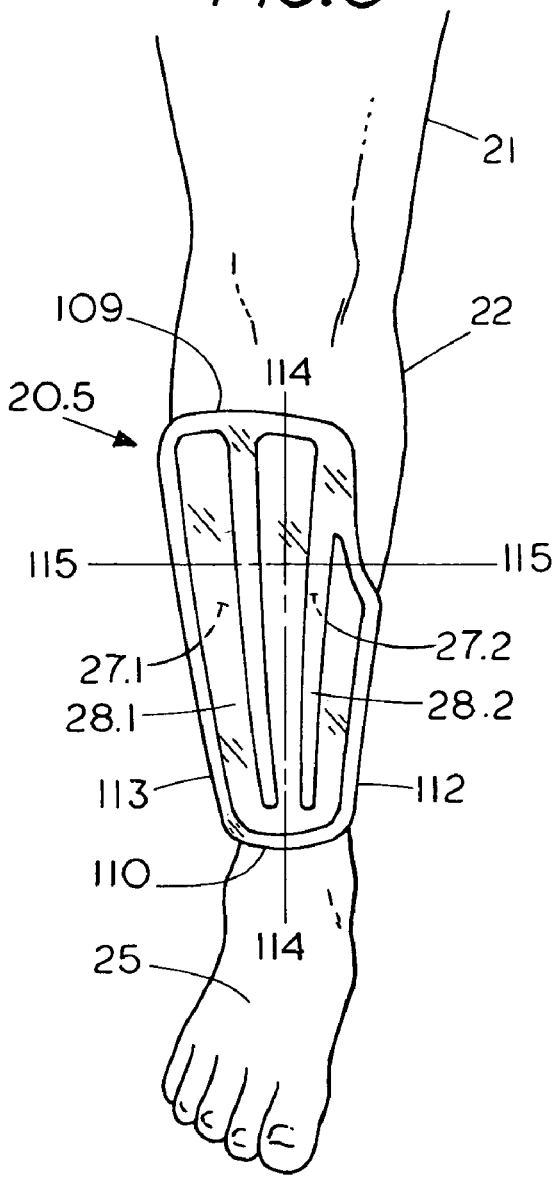
FIG. 6 is a front perspective view of a shin guard including two bladders configured in a side-by-side relationship containing two light cure materials having different physical and mechanical properties.

Gas filled bladders taught by Marion F. Rudy and licensed to Nike, Inc. include U.S. Pat. No. 5,543,194, U.S. Pat. No. 5,083,361, U.S. Pat. No. 5,042,176, U.S. Pat. No. 4,936,029, U.S. Pat. No. 4,906,502, U.S. Pat. No. 4,340,626, U.S. Pat. No. 4,287,250, U.S. Pat. No. 4,271,606, U.S. Pat. No. 4,219,945, and U.S. Pat. No. 4,183,156, all of these patents being hereby incorporated by reference herein. Other patents relating to thermoplastic film for use in fluid filled bladders and/or the structure of fluid filled bladders which are believed to be assigned or licensed to Nike, Inc. include U.S. Pat. No. 5,406,719, U.S. Pat. No. 5,592,706, U.S. Pat. No. 5,626,657, U.S. Pat. No. 5,755,001, U.S. Pat. No. 5,802,739, U.S. Pat. No. 5,832,630, U.S. Pat. No. 5,979,078, U.S. Pat. No. 5,993,585, U.S. Pat. No. 6,013,340, U.S. Pat. No. 6,020,055, U.S. Pat. No. 6,082,025, U.S. Pat. No. 6,119,371, U.S. Pat. No. 6,127,026, U.S. Pat. No. 6,258,421, U.S. Pat. No. 6,321,465, U.S. Pat. No. 6,571,490, U.S. Pat. No. 6,457,262, U.S. Pat. No. 6,385,864, U.S. Pat. No. 6,374,514, U.S. Pat. No. 6,402,879, and U.S. Pat. No. 6,430,843, all of these patents being hereby incorporated by reference herein. A Gas filled bladder for making a shock absorbing cushion is taught in U.S. Pat. No. 6,161,240 granted to Ing-Jing Huang, this patent being hereby incorporated by reference herein. Gas filled bladders or other cushioning mediums granted to Martyn Shorten and/or Joseph Skaja include U.S. Pat. No. 5,572,804, U.S. Pat. No. 5,976,451, U.S. Pat. No. 6,029,962, and U.S. Pat. No. 6,098,313, all of these patents being hereby incorporated by reference herein. Gas filled bladders or pads taught by Byron Donzis include U.S. Pat. No. 5,235,715, U.S. Pat. No. 4,874,640, U.S. Pat. No. 4,513,449, U.S. Pat. No. 4,486,901, U.S. Pat. No. 4,453,271, U.S. Pat. No. 4,441,211, U.S. Pat. No. 4,370,754, and U.S. Pat. No. 4,217,705, all of these patents being hereby incorporated by reference herein. Teachings related to athletic equipment by J. C. Wingo include U.S. Pat. No. 5,036,761, U.S. Pat. No. 5,035,009, U.S. Pat. No. 5,029,341, U.S. Pat. No. 4,985,931, U.S. Pat. No. 4,926,503, and U.S. Pat. No. 4,872,216, all of these patents being hereby incorporated by reference herein FIG. 6 is a front perspective view of a shin guard 20.5 including two bladders 28.1, and 28.2, configured in a side-by-side relationship, and containing light cure materials having different physical and mechanical properties. Light cure material 27.1 contained in bladder 28.1 can form a relatively rigid material, and light cure material 27.2 contained in bladder 28.2 can form a relatively soft, flexible and resilient material when cured. The shin guard 20.5 can be characterized by alternating areas of relative rigidity and flexibility, thus permitting the shin guard 20.5 to easily conform to the anatomy of a wearer, and to accommodate the flexion of lower leg muscles associated with movement.

In addition, a shin guard can be combined with a knee guard and then be formed as an integral unit. A flexible light cure material can be used in the area between the shin guard and knee guard so as to permit flexion. Nevertheless, the knee and shin can be substantially protected by rigid material. Accordingly, it can be readily understood that the present invention can be used to make articulating body armor, and like guards and pads. An example of a combination batter's shin and ankle guard is taught in U.S. Pat. No. 5,742,938 assigned to Rawlings, Inc., and hand and lower leg protectors are also taught in U.S. Pat. No. 6,131,195, U.S. Pat. No. 6,226,795 and U.S. Pat. No. 6,269,485, respectively, all of these patents hereby being incorporated by reference herein.

Figure 7:
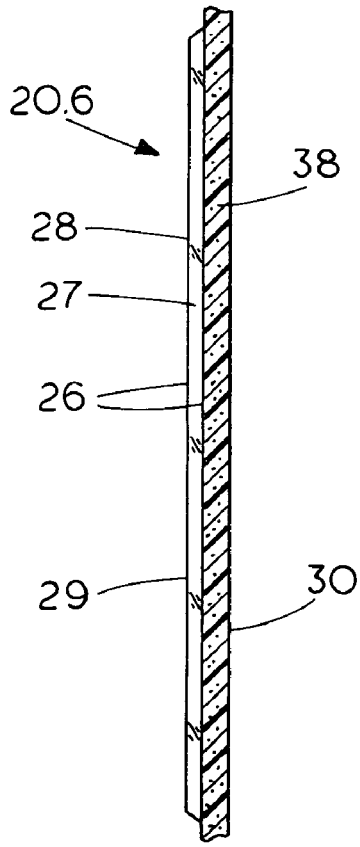
FIG. 7 is a side cross-sectional view of a shin guard including a bladder containing a light cure material that is affixed to a foam material.

FIG. 7 is a side cross-sectional view of a shin guard 20.6 having a bladder 28 including a light cure material 27. The bladder 28 consists of a relatively thin and substantially transparent film 26 that is affixed to a different material, such as a textile material 41, or as shown, a foam material 38. The foam material 38 can consist of an open or closed cell foam, but a closed cell foam is generally advantageous for use when the foam material will also serve as a portion of the wall of a bladder 28, and also to prevent the absorption of sweat and moisture. The preferred foam material 38 can be made of polyethylene, ethylene vinyl acetate, polyurethane, and the like, or a natural or synthetic foam rubber material. The bladder 28 can be affixed to the foam material 38 by sewing, adhesive means, or by radio frequency, microwave, ultrasound, or heat and pressure welding, or other conventional means. A foam material 38 can be made in a complex and generally anatomically conforming shape, including, but not limited to the method taught in U.S. Pat. No. 5,118,722 assigned to Illbruck GmbH, hereby incorporated by reference herein.

Figure 8:
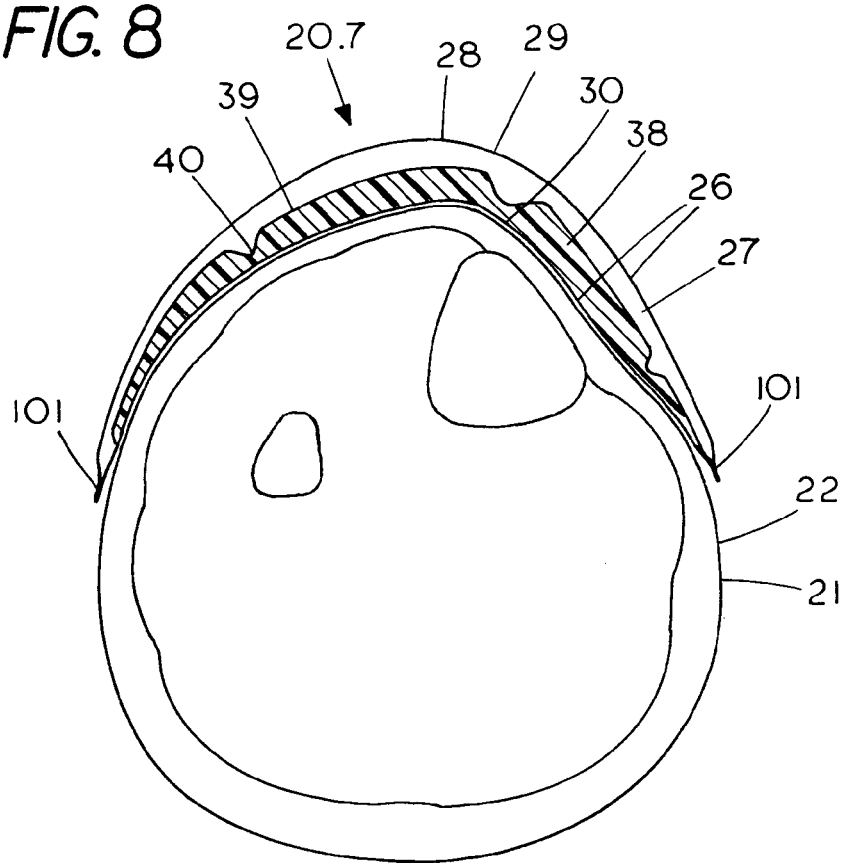
FIG. 8 is a transverse cross-sectional view of a shin guard including a bladder containing light cure material and a foam material.

FIG. 8 is a transverse cross-sectional view of a shin guard 20.7 including a bladder 28 containing light cure material 27 and a foam material 38. The foam material 38 is preferably made of a substantially closed cell or microcellular foam material. The foam material 38 can be characterized by various contours and features such as peaks 39 and valleys 40, thus the relative proportion of foam material 38 and light cure material 27 can be engineered to vary in any given portion of the shin guard 20.7, as desired. The resulting shin guard 20.7 will then be heterogeneous, that is, be characterized by different physical and mechanical properties in different select locations, as desired. The foam material 38 can be affixed to the outer side of the film 26 used on the inner layer 30 of the bladder 28 by adhesive means, or by radio frequency, microwave, ultrasound, or heat and pressure welding, or other conventional means. As shown, the film 26 forming the both the inner layer 30 of the bladder 28 and the outer layer 29 of the bladder 28 can be affixed at mating edges by welds 101.

Figure 9:
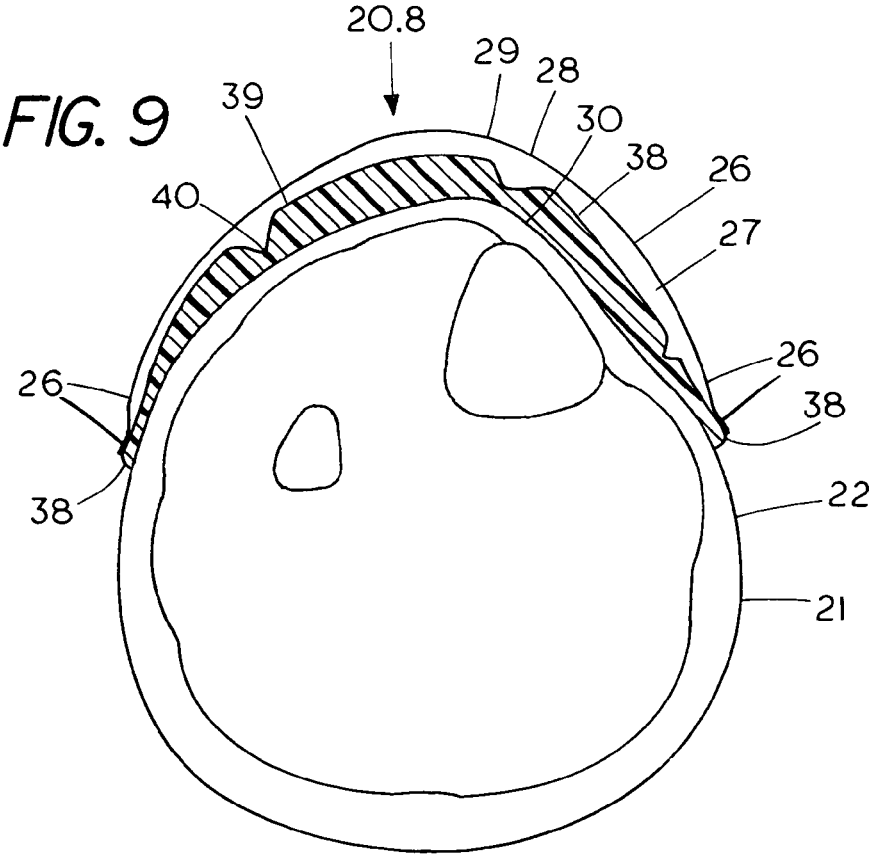
FIG. 9 is a transverse cross-sectional view of a shin guard including a bladder made from a substantially transparent film material affixed to a foam material, and containing a light cure material

FIG. 9 is a transverse cross-sectional view of a shin guard 20.8 including light cure material 27 within a bladder 28 that is made of a substantially transparent material affixed to a relatively non-transparent material. The non-transparent material can be made of a substantially closed cell or microcellular foam material 38, a natural or synthetic fiber material a textile material 41, a thermoplastic material, a thermoset material or a natural or synthetic rubber, and the like. The relatively non-transparent material, e.g., a foam material 38, can be characterized by various contours and features such as peaks 39 and valleys 40, thus the proportion of foam material 38 and light cure material 27 can be engineered to vary in any given portion of the shin guard 20.8, as desired. The resulting shin guard 20.8 will then be heterogeneous, that is, characterized by different physical and mechanical properties in different select locations, as desired. The substantially transparent film 26 can be affixed to the outer side of the foam material 28 by adhesive means, or alternately by radio frequency, microwave, ultrasound, or heat and pressure welding, and the like. As shown, the film 26 forming the both the inner layer 30 of the bladder 28 and the outer layer 29 of the bladder 28 can be affixed at mating edges by welds 101.

Figure 10:
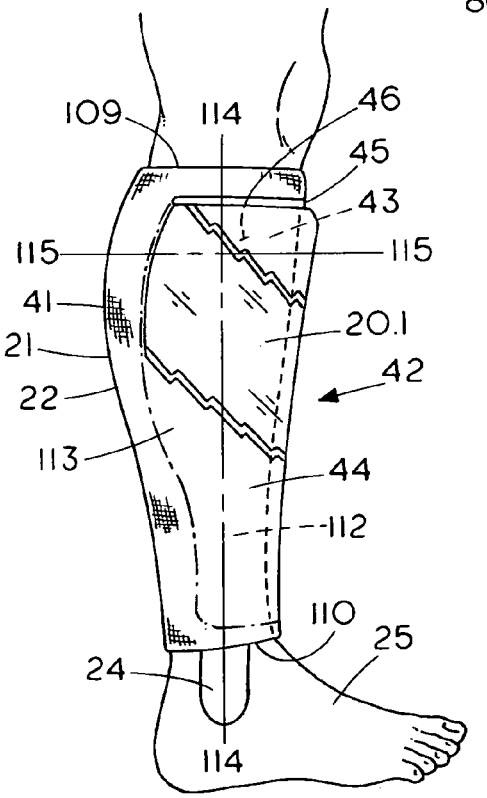
FIG. 10 is a front perspective view of a pocket sock made of textile material, with parts broken away, and including means for securing a shin guard.

FIG. 10 is a perspective view of a sock having a pocket therein, hereinafter referred to as a pocket sock 42 made of textile material 41 with parts broken away, including means for securing a shin guard 20.1 in functional relation thereto. The pocket sock 42 can include an inside layer 43 and an outside layer 44 and have an access point 45 to a sleeve or pocket 46 in which the shin guard 20.1 can be positioned. The inside layer 43 and outside layer 44 of the pocket sock 42 can be affixed together by conventional means at an inferior portion near the malleoli 24, or alternatively, near the superior portion of the pocket sock 42. In the first case, the outside layer 44 can be rolled down in order to secure the shin guard 20.1 in place, and in the second case, the outside layer 44 can be rolled up in order to accomplish the same. Alternatively, the inside layer 43 and outside layer 44 of the pocket sock 42 can consist of a single component which forms two or more layers by simply folding and doubling the pocket sock 42 over upon itself. The shin guard 20.1 can be positioned and held in place in relation to the pocket sock 42 with the use of friction fit, snaps, straps, VELCRO® hook and pile, zipper, self-adhesive, adhesive, or other conventional means.

When it is desired to form an new shin guard 20.1 in conformance with a wearer's anatomy, the shin guard 20.1 including light-cure material 27 can be removed from a container in which it is stored and shipped that does not permit the passage of substantial ultraviolet or visible light therethrough, and then placed in position on the wearer's lower leg 22 with or without the presence of pocket sock 42. Exposure of the shin guard 20.1 to sunlight or a suitable man-made light source can cause the shin guard 20.1 to cure in less than 5 minutes. Depending upon the configuration of the shin guard 20.1, it can sometimes be advantageous for the wearer to engage in movement while the light cure material 27 is being caused to cure in order to better accommodate the flexion of the wearer's muscles. When the shin guard 20.1 has been positioned in functional relationship to a pocket sock 42, and the like, the outside layer 44 of the pocket sock 42 can be rolled up or down, the light cure material 27 be caused to cure, and then the outside layer 44 of the pocket sock 42 can simply be rolled back up or down and into place. Essentially, all that a consumer or wearer has to do is to put the shin guard 20.1 on and go out and play. The technology associated with the creation of a customized shin guard having a permanent memory capability thus largely takes care of itself. The process is quick, clean, easy, effective, and inexpensive.

Figure 11:
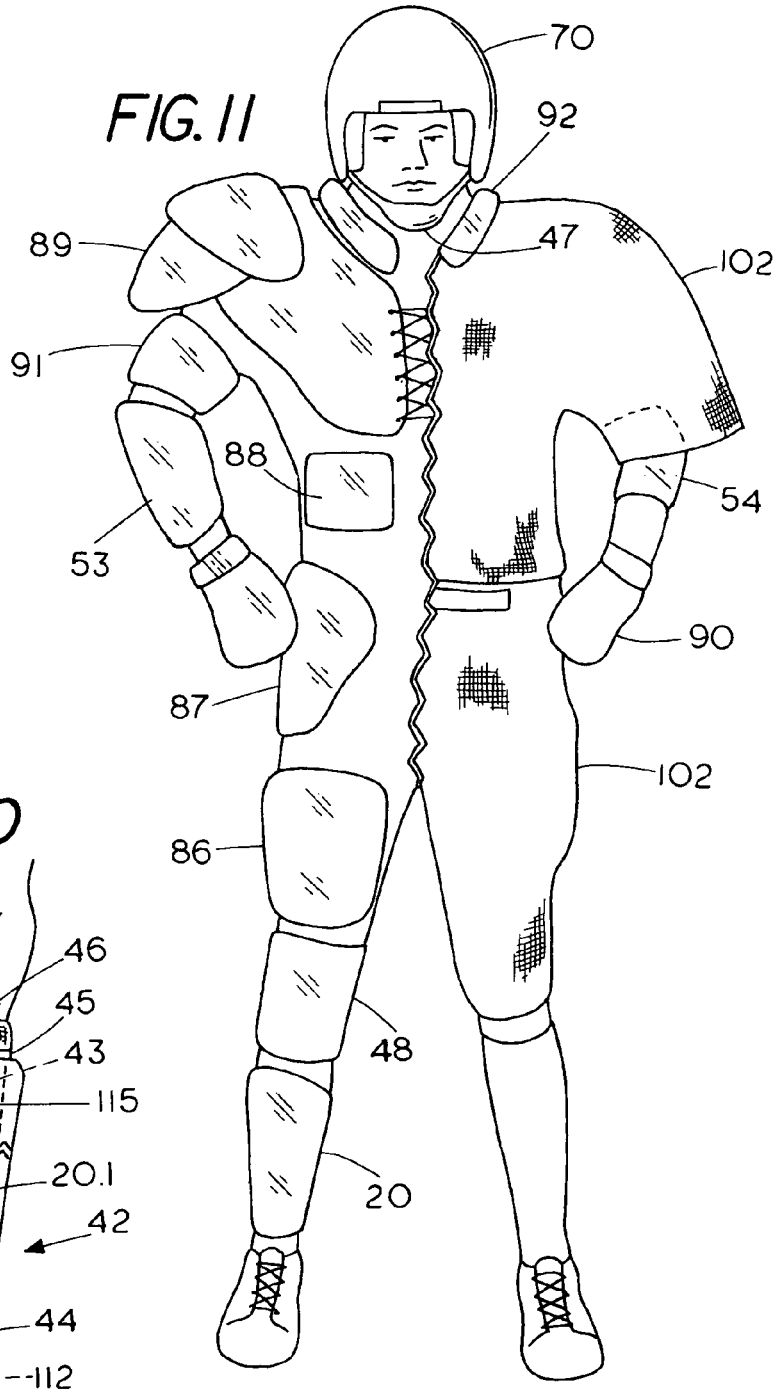
FIG. 11 is a front view of a football player wearing a plurality of pads, with parts of his uniform broken away.

FIG. 11 is a front or anterior view of a football player wearing a helmet 70, a uniform 102 with parts broken away, and a plurality of guards or pads. Shown are shin guard 20, knee pad 48, thigh pad 86, hip pad 87, rib pad 88, shoulder pad 89, elbow pad 54, glove 90, forearm pad 53, biceps pad 91, neck pad 92, helmet 70, and chin strap 47. All of the aforementioned guards, pads, and other articles of apparel and protective equipment can be made to include a light cure material for effecting a custom fit.

Accordingly, the device taught in the present invention can be used to make guards for protecting a portion of a wearer's anatomy including but not limited to finger guards, hand guards, glove guards, wrist guards, forearm guards, elbow guards, arm guards, biceps guards, shoulder guards, head guards, helmets, neck guards, back guards, hip guards, torso guards, rib guards, leg guards, thigh guards, knee guards, shin guards, ankle guards, foot guards, splints, casts, and body armor. Further, the device taught in the present invention can be used to make pads for protecting a portion of a wearer's anatomy including but not limed to finger pads, hand pads, glove pads, wrist pads, forearm pads, elbow pads, arm pads, biceps pads, shoulder pads, head pads, helmet pads, chin strap pads, neck pads, back pads, hip pads, torso pads, rib pads, leg pads, thigh pads, knee pads, shin pads, ankle pads, foot pads, prosthesis pads, splint pads, cast pads, and body armor pads.

So-called soft body armor can be made with the use of glass, polyester, aramid or KEVLAR®, and polyethylene or SPECTRA® textile materials, and the like. An aramid material known by the tradename GOLDFLEX®, and also the polyethylene material known by the tradename SPECTRA® are made by Honeywell International Inc. of Colonial Heights, Va., whereas KEVLAR® is a tradename of Du Pont de Nemours & Company of Wilmington, Del. Hard body armor can be made with the use of ballistic steel titanium, and hard ceramic materials such as alumina, zirconia, boron carbide, silicon carbide, silicon nitride, aluminum nitride, and the like. Ceramic materials for use in body armor are made by Ceradyne, Inc. of Costa Mesa, Calif.

When one or more of the aforementioned materials used to make soft or hard body armor are included in a bladder containing a light cure material or alternatively, when one or more of these materials are secured in functional relation to a device of the present invention including a bladder containing light cure material the present invention can be used to make customized body armor.

Figure 12:
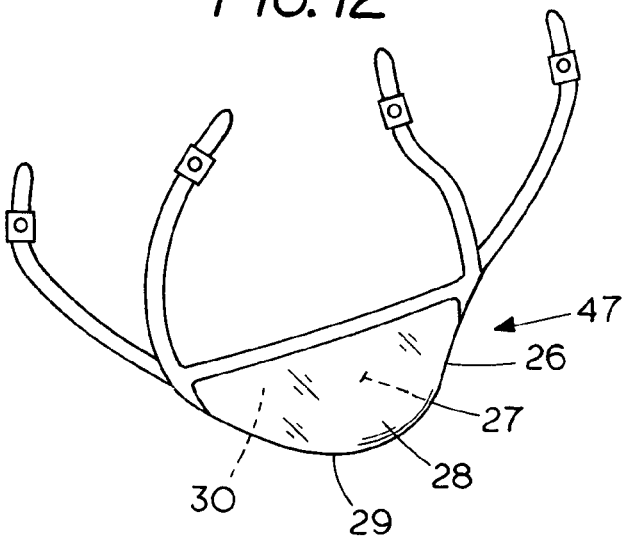
FIG. 12 is a perspective view of a chin-strap including a light cure material.

FIG. 12 is a perspective view of a chin-strap 47 including light cure material 27. Examples of chin guards and straps that are known in the art include U.S. Pat. No. 5,794,274, and U.S. Pat. No. 4,646,368 assigned to Riddell, Inc. As shown, the chin strap 47 can include a flexible bladder 28 including light cure material 27, and the outer layer 29 of the bladder 28 can include a substantially transparent material. Alternatively, the chin strap 47 can include a textile material which is impregnated with a light cure material. Accordingly, when it is desired to form a chin strap 47 in conformance with a wearer's anatomy, the chin strap 47 including light cure material 27 can be removed from a container in which it is stored and shipped that does not permit the passage of substantial ultraviolet or visible light therethrough, and the wearer can simply attach and use the chin strap 47. In the presence of sunlight or ambient light conditions the light cure material 27 can be caused to cure and capture the anatomical features of the wearer. It can be advantageous that the inner layer 30 of the bladder of chin strap 47 be made of a stretchable and elastic or otherwise flexible material capable of elongation and distention so as to accommodate the anatomical features of the wearer.

Figure 13:
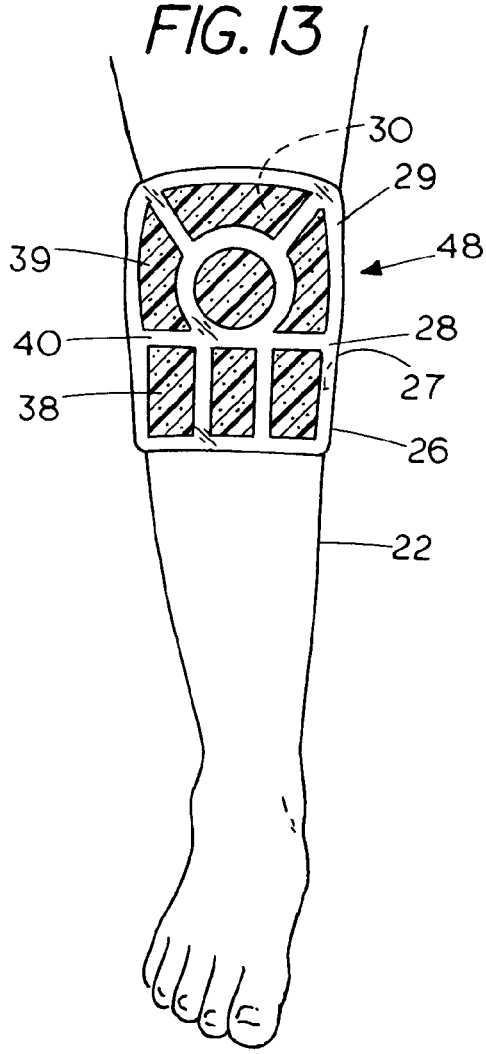
FIG. 13 is a perspective view of knee pad including a light cure material.

FIG. 13 is a perspective view of a preferred knee pad 48 including a bladder 28 containing a light cure material 27. The material used as the inner layer 30 of the bladder 28 of knee pad 48 can include peaks 39 and valleys 40 which can be substantially encapsulated by the light cure material 27. The inner layer 30 of the knee pad 48 can be made of a foam material 38. The preferred foam material 38 is made of a substantially closed cell or microcellular foam. The foam material 38 can be characterized by various contours and features such as peaks 39 and valleys 40, thus the proportion of foam material 38 and light cure material 27 can be engineered to vary in any given portion of the knee pad 48. The resulting knee pad 48 will then be heterogeneous, that is, characterized by different physical and mechanical properties in different select locations, as desired. Alternatively, the inner layer of the knee pad can be made of a natural or synthetic fiber material, a textile material, a thermoplastic material, a thermoset material, a natural or synthetic rubber, and the like. It can be advantageous that the inner layer 30 of the bladder 28 of knee pad 48 be made of a stretchable and elastic material 93 or otherwise flexible material capable of elongation and distention so as to accommodate the anatomical features of the wearer 21. The substantially transparent film 26 can be affixed to the outer side of the foam material 38 or other material used to make the inner layer 30 of the bladder 28 by adhesive means, or alternately by radio frequency, microwave, ultrasound, or heat and pressure welding, and the like.

Figure 14:
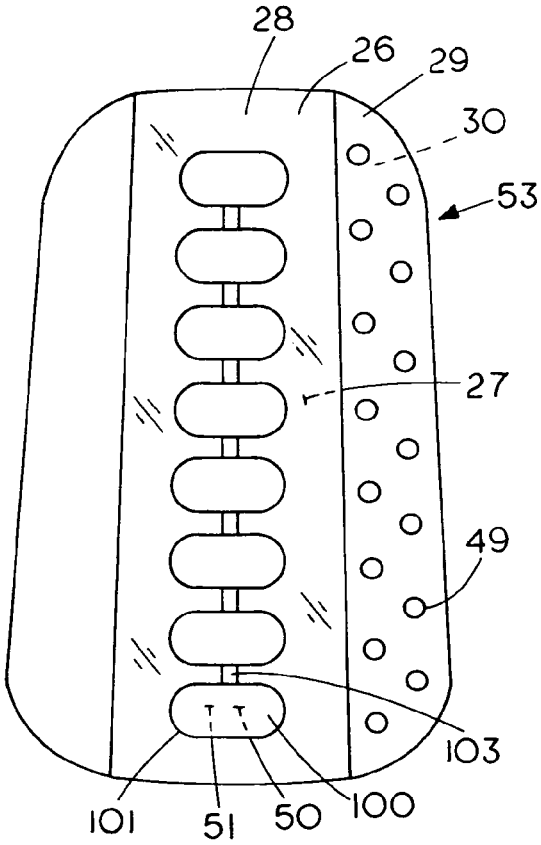
FIG. 14 is a top plan view of a forearm pad including a light cure material.

FIG. 14 is a top plan view of a forearm pad 53 including light cure material 27. Shown on the right side of the forearm pad 53 are openings 49 for permitting heat dissipation and evaporation of sweat. Shown in the middle portion of the forearm pad 53 is a plurality of voids 50 filled with a gas 51 for attenuating force applications. The captive gas can be at atmospheric pressure, or greater than atmospheric pressure. The voids 26 can constitute chambers 100 which are at least initially interconnected by passages 103. The chambers 100 and passages 103 can be formed by radio frequency welding of the film 26 which forms at least the outer layer 29 of the bladder 28. The chambers 100 can be filled with a gas and then isolated by welds 101 made to block passages 103, as desired.

FIG. 15 is a top plan view of an elbow pad 54 including a bladder 28 containing light cure material 27. The material used in the inner layer 30 of elbow pad 54 includes peaks 39 and valleys 40 which permit the light cure material 27 to substantially encapsulate the inner layer 30 of the elbow pad 54. The inner layer 30 of the elbow pad 54 can be made of a foam material 38. The foam material 38 is preferably a substantially closed cell or microcellular foam. The foam material 38 can be characterized by various contours and features such as peaks 39 and valleys 40, thus the proportion of foam material 38 and light cure material 27 can be engineered to vary in any given portion of the elbow pad 54. The resulting elbow pad 54 can then be heterogeneous, that is, characterized by different physical and mechanical properties in different select locations, as desired. Alternatively, or in addition to inclusion of a foam material 38, the inner layer 30 of the elbow pad 54 can be made of a natural or synthetic fiber material, a textile material, a thermoplastic material, a thermoset material, a natural or synthetic rubber, and the like. It can be advantageous that the inner layer 30 of the elbow pad 54 be made of a stretchable and elastic 93 or otherwise flexible material capable of elongation and distention so as to accommodate the anatomical features of the wearer. The substantially transparent film 26 can be affixed in function relation to the outer side of the foam material 38 or other material used to make the inner layer 30 of the bladder 28 by adhesive means, or alternately by radio frequency, microwave, ultrasound, or heat and pressure welding, and the like.

FIG. 16.1 and 16.2 are perspective views showing the bones of the skull 56 of a newborn in FIG. 16.1 and a mature adult in FIG. 16.2. Shown are the skull 56, occipital bone 57, parietal bone 58, temporal bone 59, sphenoid bone 60, frontal bone 61, anterior fontanelle 62, posterior fontanelle 63, sagittal suture 96, coronal suture 64, lambdoid suture 65, squamous suture 66, sphenoidal fontanelle 67 and mastoid fontanelle 68. By adulthood, the various fonanelles of the skull are normally transformed into bone and disappear, and the sutures of the skull will close.

However, some individuals consider that the sphenoid and temporal bones can be capable of limited articulation even in an adult. In fact, it is believed that this portion of the skull 56 pulses several times per minute in connection with the circulation of cerebral-spinal fluid in the brain and spine, and serves to drive the large reservoirs of cerebral-spinal fluid that are contained within the brain cavity. Immobilization of these bones of the skull can then lead to headaches and mental disturbance, such as a diminished ability to concentrate. The tendency of individuals to rub their temples in order to relieve a headache is then an appropriate therapy, as prolonged muscle tension can have the effect of immobilizing or hindering normal articulation. In the field of physical therapy, treatment based upon this phenomenon is known as craniosacral therapy. It can therefore be readily understood that a helmet which places significant pressure on the areas of the temporal or sphenoid bones, or about the base of the skull proximate the first vertebra can prove dysfunctional for use by a wearer.

Helmets known in the football prior art include U.S. Pat. No. 5,263,203, U.S. Pat. No. 5,175,889, U.S. Pat. No. 5,035,009, U.S. Pat. No. 4,831,668, U.S. Pat. No. 4,287,613, U.S. Pat. No. 3,866,243, assigned to Riddell, Inc. An adjustable baseball batter's helmet is taught in U.S. Pat. No.

Figure 17:
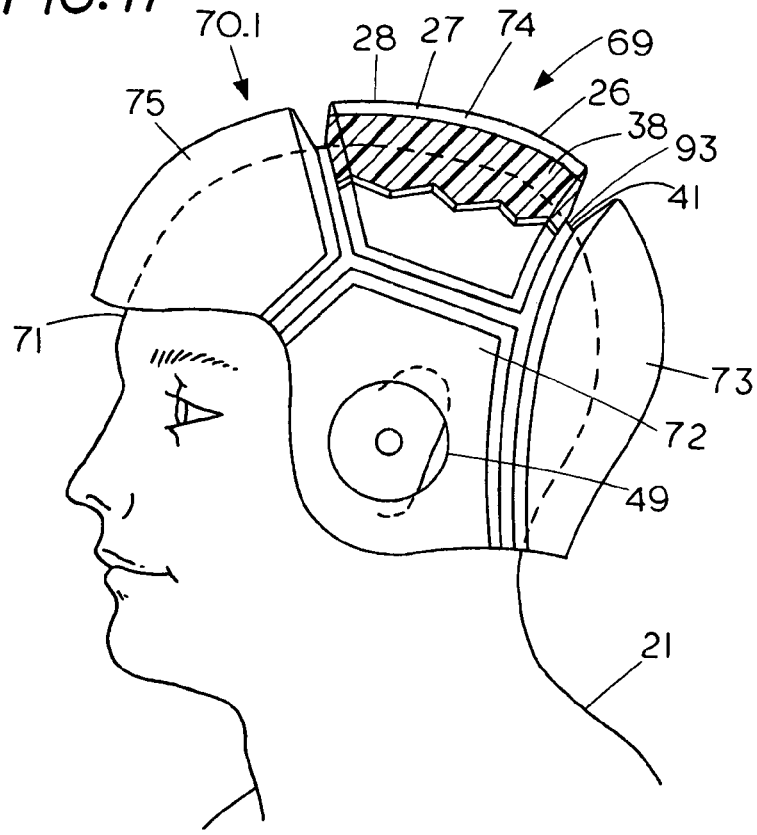
FIG. 17 is a perspective view of helmet liner including a light cure material, with parts broken away, positioned upon a wearer.

5,575,017 assigned to Rawlings, Inc. An adjustable hockey helmet is taught in U.S. Des. 378,624 assigned to Canstar Sports Inc. Bicycle helmets made by Specialized Bicycle Components, Inc., PDH Corporation, Bell Sports, Inc., and Giro Sport Design, Inc., include U.S. Pat. No. 5,794,272, U.S. Pat. No. 5,381,560, U.S. Pat. No. 5,659,900, U.S. Pat. No. 5,481,762, U.S. Pat. No. 4,993,082, and U.S. Pat. No. 4,903,350. All of the U.S. Patents cited in this paragraph are hereby incorporated by reference herein FIG. 17 is a perspective view of helmet liner 69 including a bladder 28 containing light cure material 27 positioned upon a wearer's head 71. The material used in that portion of the helmet liner 69 positioned against the head 71 can be substantially encapsulated by the light cure material 27. The material used proximate the head 71 can be a foam material 38. The foam material 38 is preferably a substantially closed cell or microcelluar foam. The foam material 38 can be characterized by various contours and features such as peaks 39 and valleys 40, thus the proportion of foam material 38 and light cure material 27 can be engineered to vary in any given portion of the helmet liner 69. The resulting helmet liner 69 can then be heterogeneous, that is, characterized by different physical and mechanical properties in different select locations, as desired. Alternatively, or in addition, a the inner layer 30 of the helmet liner 69 can be made of a natural or synthetic fiber material, a textile material, a thermoplastic material, a thermoset material, a natural or synthetic rubber, and the like. It can be advantageous that the inner layer 30 of the helmet liner 69 be made of a stretchable and elastic 93 or otherwise flexible material capable of elongation and distention so as to accommodate the anatomical features of the wearer. The substantially transparent film 26 can be affixed to the foam material 38 or other material used to make the inner layer 30 of the bladder 28 by adhesive means, or alternately by radio frequency, microwave, ultrasound, or heat and pressure welding, and the like.

It can be advantageous that the helmet liner 69 be made having several different bladders 28, or several different chambers 100 which generally imitate the position of the major bones of the skull 56, that is, two opposing temporal and sphenoidal bladders 72 protecting the sides of the head proximate the temple and ear, an occipital bladder 73 protecting the back of the head 71, a parietal bladder 74 protecting the top of the head 71, and a frontal bladder 75 protecting the front of the head 71. Alternatively, the parietal bladder 74 and frontal bladder 75 can be made in two generally opposing bladders or chambers 100 each protecting their respective medial or lateral aspect of the head 71. Many other configurations for a helmet liner 69 can be used. When the helmet liner 69 extends near or below the position of the ear, it can sometimes be advantageous that an aperture or opening 49 be provided so that the wearer's 21 hearing will not be significantly impaired. The aforementioned configuration of the helmet liner 69 facilitates conformance to the unique anatomical features of a wearer's head 71, due to the fact that the junction points between the respective bladders 28 or chambers 100 are located proximate the various sutures of the skull 56, and these areas of the helmet liner 69 are characterized by relatively thin cross-sections and resulting flexibility. Alternatively, a helmet liner can be made without including various segments corresponding to the bones of a wearer's skull, but rather the helmet liner can be made substantially continuous in order to provide maximal protection to potentially vulnerable areas when and where the sutures of an individual's skull of have not yet substantially fused, as is normally the case with young children, as shown in FIG. 16.2.

Figure 21:
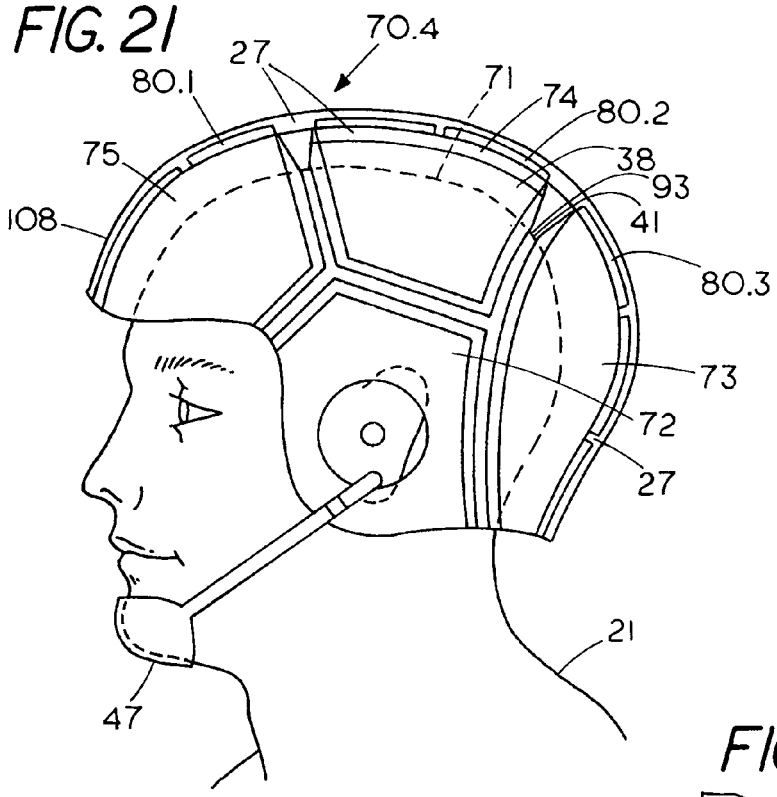
FIG. 21 is perspective view of a helmet including a plurality of segments that are substantially encapsulated by a light cure material, with parts broken away.

The wearer 21 can remove the helmet liner 69 including light cure material 27 from the container or package in which it is stored and shipped that does not permit the passage of substantial ultraviolet and visible light therethrough. When the various bladder 28 or chambers 100 are affixed in functional relation to a stretchable and elastic material 93, such as a closed cell foam material, or a stretchable and elastic textile material 41 which is used at least at the junction points between respective bladders 28 or chambers 100, the wearer 21 can simply don the helmet liner 69 and it will be caused to conform to their particular anatomical conformance, that is, the size and shape of their head 71. In the presence of sunlight or a suitable man-made light source, the light cure material 27 contained within helmet liner 69 can be caused to cure, thereby retaining a custom fit and permanent memory. As shown in FIG. 21, a helmet 70.4 or helmet liner 69 can include retaining means such as a chin strap 47. Further, in some applications, it can be readily understood that the so-called helmet liner 69 shown in FIG. 17 can also constitute a suitable helmet 70.1 for use by a wearer 21. For this reason, drawing FIG. 17 has been identified as both a helmet liner 69, and a helmet 70.1.

Figure 18:
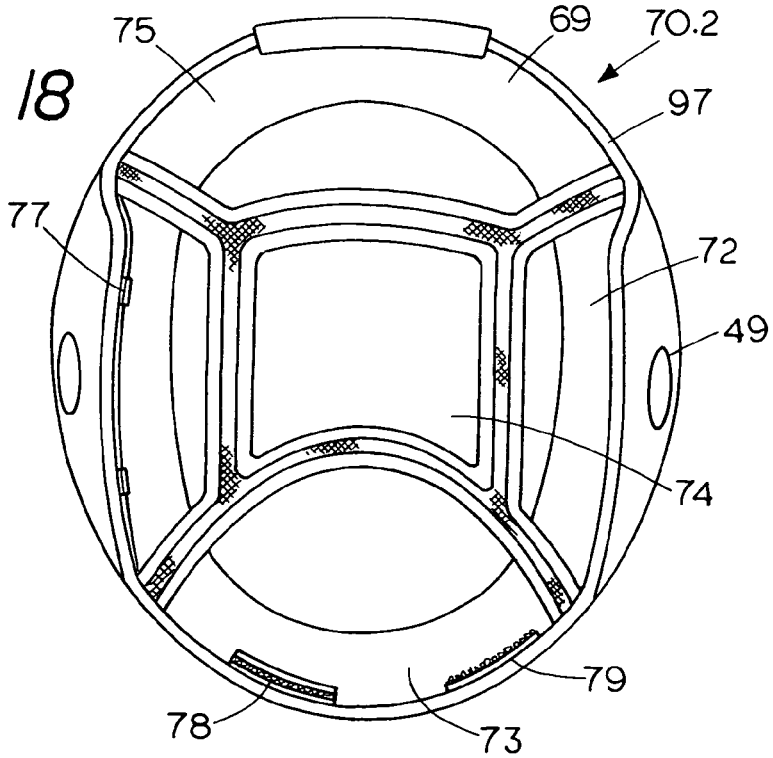
FIG. 18 is a bottom perspective view of a helmet liner secured in function relation to a helmet.

FIG. 18 is a bottom perspective view of a helmet liner 69 secured in function relation to a relatively rigid outer shell 97 of a helmet 70.2 Shown are two opposing temporal and sphenoidal bladders 72 for protecting the sides of the head proximate the temple and ear, an occipital bladder 73 for protecting the back of the head, a parietal bladder 74 for protecting the top of the head 71, and a frontal bladder 75 for protecting the front of the head 71. Alternatively, the parietal bladder 74 and frontal bladder 75 can both be made in two generally opposing bladders 28 or chambers 100 each protecting their respective medial or lateral aspect of the head 71. The aforementioned configuration of the helmet liner 69 facilitates conformance to the unique anatomical features of a wearer's head 71, due to the fact that the junction points between the respective bladders 28 or chambers 100 are located proximate the various sutures of the skull 56, and these areas of the helmet liner 69 are characterized by relatively thin cross-sections and resulting flexibility. The helmet liner 69 can include a single bladder 28 having a plurality of chambers 100, a plurality of bladders 28, or a plurality of bladders 28 which include a plurality of chambers 100. When the helmet liner 69 extends near or below the position of the ear, it can sometimes be advantageous that an aperture or opening 49 be provided so that the wearer's 21 hearing will not be significantly impaired. The helmet liner 69 can be secured to the helmet 70.2 by snaps 77, VELCRO® hook and pile 78, adhesive, self-adhesive 79, straps, and other conventional means, whether in partial or complete combination.

Figure 19:
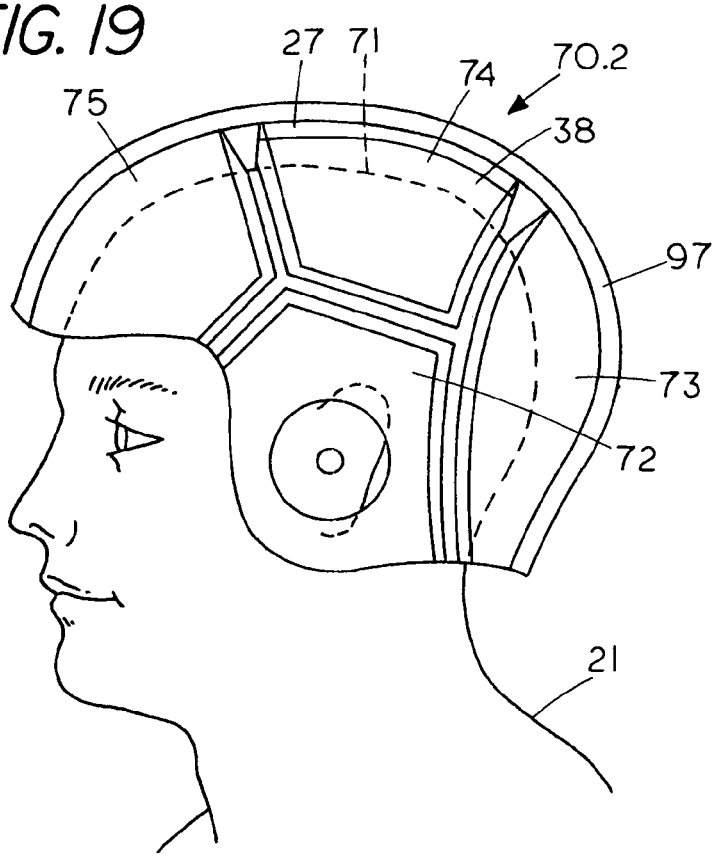
FIG. 19 is a perspective view of a helmet, with parts broken away, positioned on a wearer.

FIG. 19 is a side perspective view of a helmet 70.2 Helmet 70.2 can be substantially made of a single material, or a plurality of materials. The outer shell 97 of helmet 70.2 can be made of a metal such as aluminum, steel, or titanium, a carbon fiber or glass composite material, a thermoplastic material such as polycarbonate or nylon, or a foam material such as a rigid foam. Various laminate helmet constructions are taught in U.S. Pat. No. 5,190,802, this patent hereby being incorporated by reference herein, and also the prior art patents recited therein. Alternatively, the outer shell 97 of a helmet 70.2 can be made of a light cure material 27.

Figure 20:
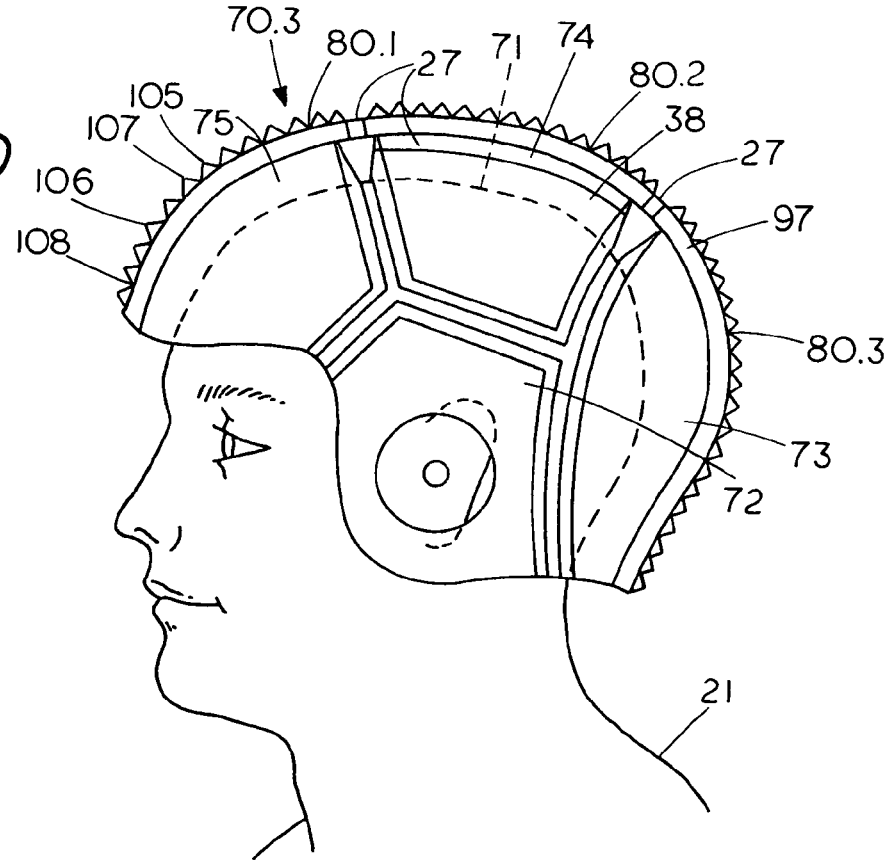
FIG. 20 is a perspective view of a helmet having a plurality of segments including light cure material therebetween, with parts broken away, positioned on a wearer.

Alternatively, as shown in FIG. 20, a helmet 70.3 can be made of a plurality of segments 80 having light cure material 27 positioned therebetween. Further, the outer surface 108 of the outer shell 97 of a helmet 70.3 for use in soccer can include a tactified outer surface 106, a textured outer surface 107, and an outer surface 108 including raised grip elements 105, whether in partial or complete combination, for facilitating and possibly enhancing a wearer's ability to play a soccer ball when heading the ball, as desired. The outer shell 97 of the helmet 70.3 can include an elastomeric coating, such as polyurethane, and/or a thermoset or thermoplastic material such as natural or synthetic rubber. Suitable hybrid thermoplastic and rubber combinations can be used, including dynamically vulcanized alloys which can be injection molded such as those produced by Advanced Elastomer Systems, 338 Main Street, Akron, Ohio 44311, e.g., SANTOPRENE®, VYRAM®, GEOLAST®, and TREFSIN®. SANTOPRENE® is known to consist of a combination of butyl rubber and ethylene-propylene. Some of the elastomeric thermoplastic materials made by Advanced Elastomer Systems, such as SANTOPRENE®, can be bonded to relatively rigid thermoplastic materials, such as nylon, for making the outer shell 97 of a helmet 70.3. Another suitable material for use in making the outer shell 97 of a helmet 70.3 is polycarbonate. Soccer balls having advantageous geometry and tactified surfaces are taught in U.S. Pat. No. 5,040,795, and U.S. Pat. No. 5,181,717, assigned to Adidas, International. Soccer shoes having a textured and tactified outer surface including raised grip elements are taught in U.S. Pat. No. 5,437,112, granted to Craig Johnson, a technology which is licensed and commercialized by Adidas, International under the PREDATOR® tradename. It can be readily understood that any or all of the alternate embodiments of a helmet taught herein can include a tactified outer surface, textured outer surface, or an outer surface including raised grip elements 105, in partial or complete combination. Moreover, regardless of whether a helmet be customized with the use of light cure material as recited herein, it can be readily understood that it can possibly be advantageous to use of helmet including a tactified outer surface, textured outer surface, or an outer surface including raised grip elements 105, in partial or complete combination.

Alternatively, as shown in FIG. 21, a helmet 70.4 can be made of a plurality of segments 80 which are substantially encapsulated by light cure material 27. Further, it can be readily understood that a helmet liner can be formed integrally with the outer shell of a helmet. A wearer 21 can remove the helmet including light cure material from a container or package in which it is stored and shipped that does not permit the passage of substantial ultraviolet and visible light therethrough, and the wearer can simply attach the helmet in the presence of sunlight or a suitable man-made light source, and the light cure material can be caused to cure while conforming to the anatomical features of the wearer, thereby retaining a custom fit and permanent memory.

Figure 22:
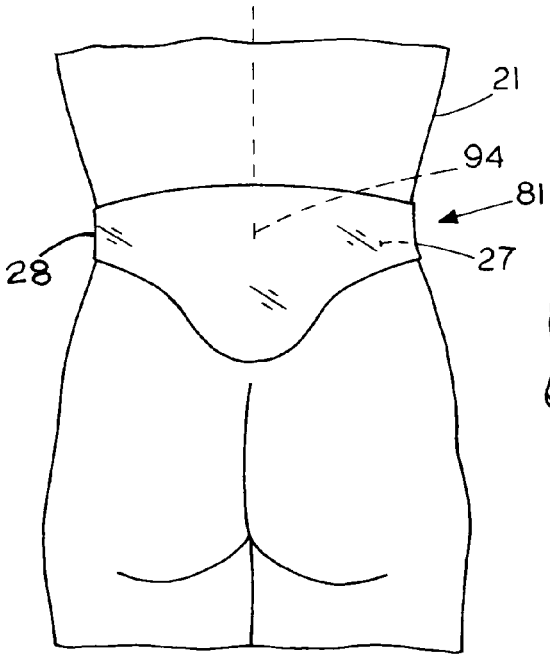
FIG. 22 is a perspective view of a back support including light cure material.

FIG. 22 is a perspective view of a back support 81 for supporting the lower back 94 of a wearer 21. A physical therapist can remove the back support 81 including light cure material 27 from a container or package in which it is stored and shipped that does not permit the passage of substantial light energy therethrough, and can place the patient's back and hips in a neutral or other desired position, then position the back support 81 in functional relation to the patient. In the presence of sunlight or a suitable man-made light source the light cure material 27 contained in the bladder 28 can be caused to cure while conforming to the anatomical features of the wearer 21, thereby retaining a custom permanent memory.

Figure 23:
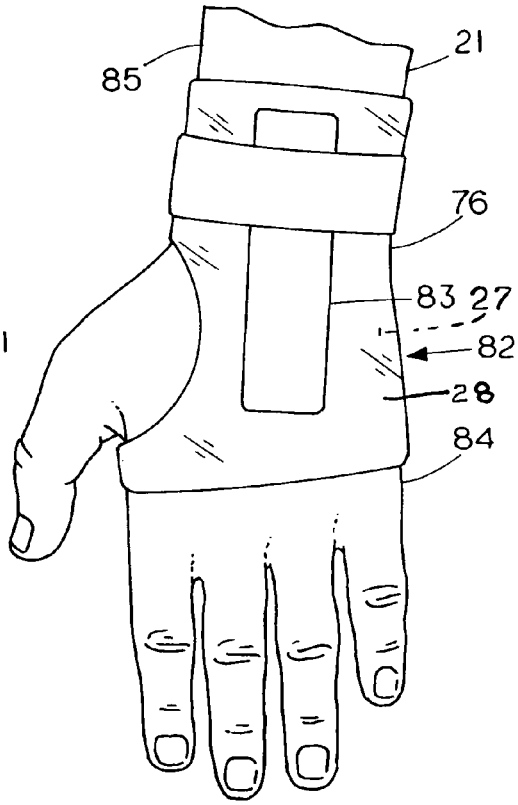
FIG. 23 is a perspective view of a wrist guard including light cure material positioned on a wearer.

FIG. 23 is a perspective view of a hand 84 and wrist 76 having a wrist guard 82, such as a brace, splint, or support affixed in position upon a wearer 21. The wrist support 82 can include a light cure material 27 contained in at least one bladder 28. The wrist support 82 can include a foam material 38, or other material. The foam material 38 is preferably a substantially closed cell or microcellular foam. The foam material 38 can be characterized by various contours and features such as peaks 39 and valleys 40, thus the proportion of foam material 38 and light cure material 27 can be engineered to vary in any given portion of the wrist support 82. The resulting wrist guard 82 can then be heterogeneous, that is, characterized by different physical and mechanical properties in different select locations, as desired. Alternatively, the inner layer 30 of the hand and wrist support 82 can be made of a natural or synthetic fiber material, a textile material, a thermoplastic material, a thermoset material, a natural or synthetic rubber, and the like. It can be advantageous that the inner layer 30 of the wrist guard 82 be made of a stretchable and elastic or otherwise flexible material capable of elongation and distention so as to accommodate the anatomical features of the wearer. The substantially transparent film 26 can be affixed to the outside of the foam material 38 or other material used to make the inner layer 30 of the bladder 28 by adhesive means, self-adhesive, or Alternatively, by radio frequency, microwave, ultrasound, or heat and pressure welding, and the like.

The wrist support 82 can also include a rigid member 83 for substantially preventing flexion of the hand 84 relative to the forearm 85 in one or more directions. This can be advantageous for use with individuals suffering from carpal tunnel syndrome, and can also be used to create a hand and wrist guard 82 suitable for use by in-line skaters. Wrist guards suitable for the treatment of carpal tunnel syndrome include U.S. Pat. No. 5,769,804, U.S. Pat. No. 5,766,141, and U.S. Pat. No. 5,014,689, all of these patents hereby being incorporated by reference herein. Wrist guards suitable for in-line skaters include U.S. Pat. No. 5,813,050, U.S. Pat. No. 5,778,449, and U.S. Pat. No. 5,435,007 assigned to Rollerblade, Inc., all of these patents hereby being incorporated by reference herein.

In alternate embodiments of a device according to the present invention, an impregnated textile material 55, that is, a textile material 41 which is coated or saturated with a light cure material 27 can be further included and contained within a bladder 28. Impregnated textile materials 55 which can be cured using sunlight or a suitable man-made light source to make casts are known in the prior art, e.g., U.S. Pat. No. 4,512,340 granted to Carl Buck. The impregnated textile material 55 can be made of a woven, non-woven, or knitted textile material, and in particular, glass fiber, aramid fiber, or carbon fiber, and the like. A fiberglass material is generally preferred for use due to considerations of weight and cost, but also the ability to use radio frequency welding techniques in order to seal polyurethane film materials to form a bladder in close proximity with fiberglass materials, something which is not advisable to attempt with carbon fiber materials due to their electrical conductivity. The preferred woven fiberglass textile materials for use are VX 171, VX 180, and VX 191 made by V2 Superior Composite Reinforcement Fabrics of 770 Lee Road 191, Auburn, Ala. These fiberglass materials have a biax 45 degree weave and are reinforced with rows of continuous stitching having a separation of less than ⅛ths of one inch, and also have a weight between 17–20 ounces per square yard. VX 191 and VX 171 are generally preferred as the woven fibers included therein measure less than or equal to ⅛th in width. As a result, the individual fibers are less likely to fray and wander when cut, and also the weave of both these materials is relatively tight and cosmetically appealing. It can be advantageous to use a single or double sided adhesive tape applied to the back side of the fiberglass or other textile when cutting the material to made the desired or required pattern, as this can help to maintain the integrity of the material and also prevent cut fiber portions from fraying or wandering. In particular, the wandering of fiber portions can later become a manufacturing problem if and when the textile material is to be inserted into a bladder which is to be sealed using radio frequency welding or other conventional techniques, since the intrusion of fiber portions can sometimes degrade the quality of the resulting weld and fluid integrity of the bladder. Further, the use of a double-sided adhesive tape can be advantageous in properly locating and affixing a textile material in a desired registered position relative to a polyurethane film material which can be used to make a bladder. A suitable double sided pressure sensitive adhesive tape for use is RAP Hold 10 made by Richmond Aircraft Products, Inc. of Norwalk, Calif.

Figure 24:
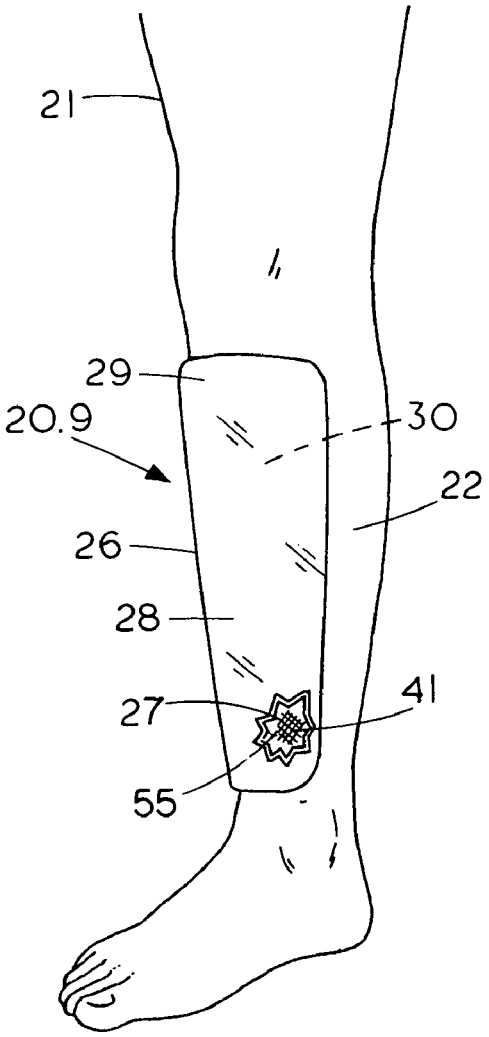
FIG. 24 is a perspective view of a shin guard including a bladder containing an impregnated textile material, with parts broken away, positioned on a wearer.

As shown in FIG. 24, a perspective view of a shin guard 20.9, with parts broken away, it can be advantageous to enclose an impregnated textile material 55 within a bladder 28, as this can both reduce oxygen inhibition with respect to the cure of some light cure materials 27, and also prevent a user or wearer 21 from coming into direct physical contact with uncured light cure material 27. Again, the impregnated textile material 55 can be made of a woven, non-woven, or knit textile material, and in particular, one consisting of glass fiber, aramid fiber, or carbon fiber, and the like. The light cure material 27 used to impregnate the textile material can form a rigid, or alternatively, a non-rigid material when cured, as desired. An impregnated textile material 55 can also be used with other cushioning materials such as foam material, or a fluid filled bladder including a gas.

Figure 25:
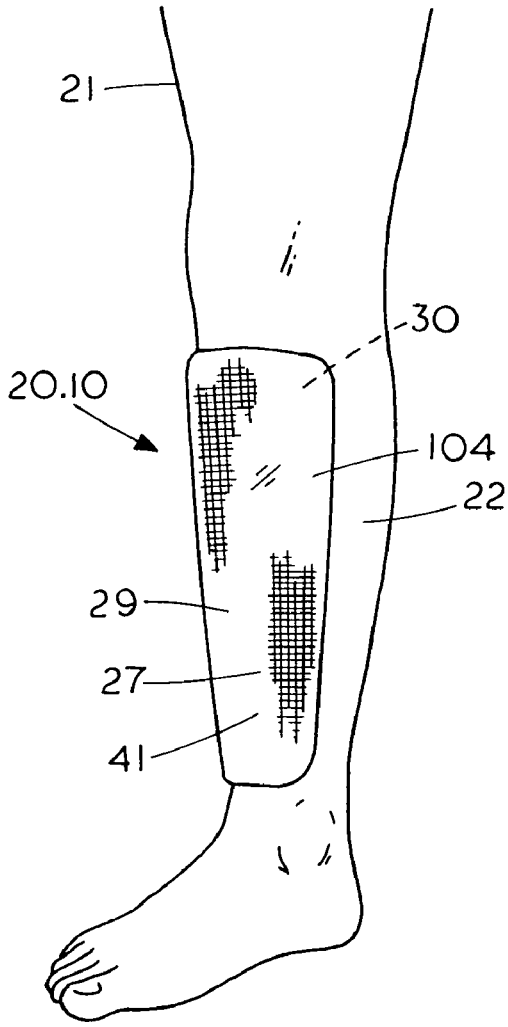
FIG. 25 is a perspective view of shin guard including an impregnated textile material positioned on a wearer.

FIG. 25, is a perspective view of a shin guard 20.10 substantially consisting of an impregnated textile material 55 which forms the exterior portion. An impregnated textile material 55 can be used to make at least a portion of a shin guard, pad, helmet or other article of protective equipment. The impregnated textile material 55 can be made of a woven, non-woven, or knitted textile material, and in particular, glass fiber, aramid fiber, or carbon fiber, and the like. Impregnated textile materials 55 are sometimes identified as "prepreg" materials. The surface of some uncured "prepreg" materials can be only slightly tacky to the touch, thus "prepreg" materials can be relatively easy to handle and manipulate with rubber gloves. Alternatively, a thin layer of substantially transparent protective film 104 such as PVdC, or shrink wrap, can be used to cover the exterior surface of the impregnated textile material 55. After the article including the impregnated textile material 55 is donned by a wearer, and shaped to fit and cured, the thin layer of protective film 104 can possibly be removed. The light cure material 27 used to impregnate the textile material can form a rigid, or alternatively, a non-rigid material when cured, as desired. An impregnated textile material 55 can be used with other cushioning materials such as foam material, or a fluid filled bladder containing a gas.

Figure 26:
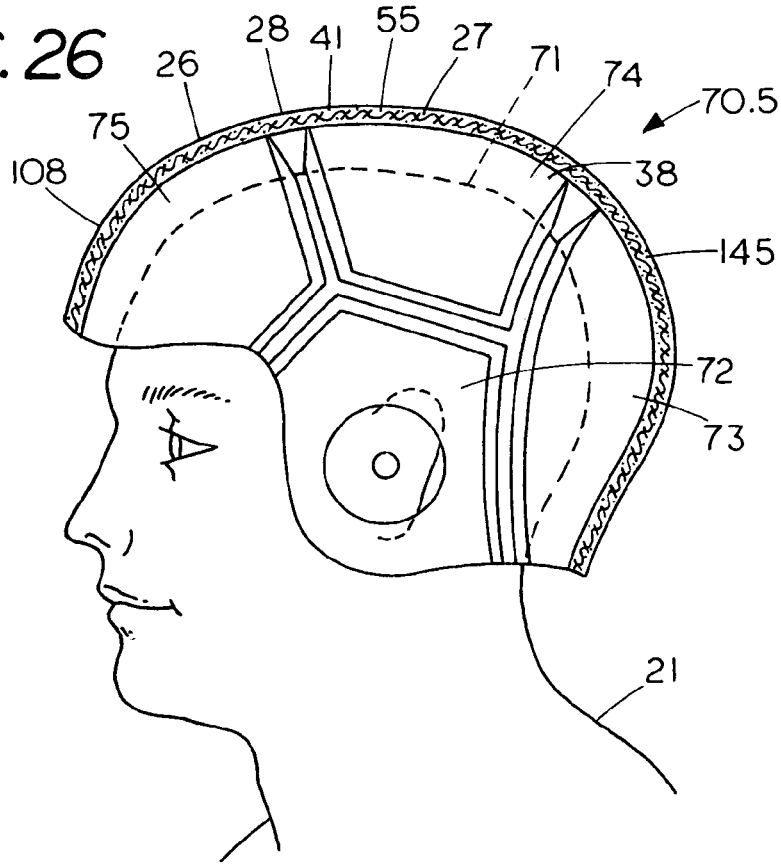
FIG. 26 is a perspective view of a helmet including a bladder containing an impregnated textile material, with parts broken away, positioned on a wearer.

FIG. 26 is a perspective view of an alternate helmet 70.5, with parts broken away, including an impregnated textile 55 within a bladder 28. This configuration can both reduce oxygen inhibition with respect to the cure of some light cure materials 27, and prevent a user or wearer 21 from coming into direct physical contact with uncured light cure material 27. The impregnated textile material 55 can be made of a woven, non-woven, or knitted textile material made of glass, aramid, polyethylene, polyester, or carbon fiber, and the like. The light cure material 27 used to impregnate the textile material can form a rigid, or alternatively, a non-rigid material when cured, as desired. Alternatively, or in addition to the inclusion of an impregnated textile material 55, a bladder 28 can include a light cure material 27 which can further include a fiber filler material 145. Fiber filler materials 145 such as short or long glass fibers, carbon fibers, aramid fibers, polyethylene fibers, polyester fibers, boron fibers, and the like, can be used with a light cure material 27 which is contained in a bladder 28. In particular, chopped strand glass fibers identified as product type 3075 made by PPG Industries of Shelby, N.C. having a length of approximately 3.2 mm or ⅛ths inch can be used. Moreover, filler materials consisting of fine particles or flakes can also be included within a light cure material, and such particulate filler materials can consist of clay, talc, mica, soda lime borosilicate, sodium borosilicate, silica, aluminosilicate, fly ash, perlite, organic or inorganic microspheres, metal, steel, aluminum, titanium, zirconia, ceramics, boron carbide, silicone carbide, silicon nitride, aluminum nitride, and the like. An impregnated textile material 55 and/or a light cure material including a fiber filler material 145 can be used with other cushioning materials such as foam material, or a fluid filled bladder including a gas.

Figure 27:
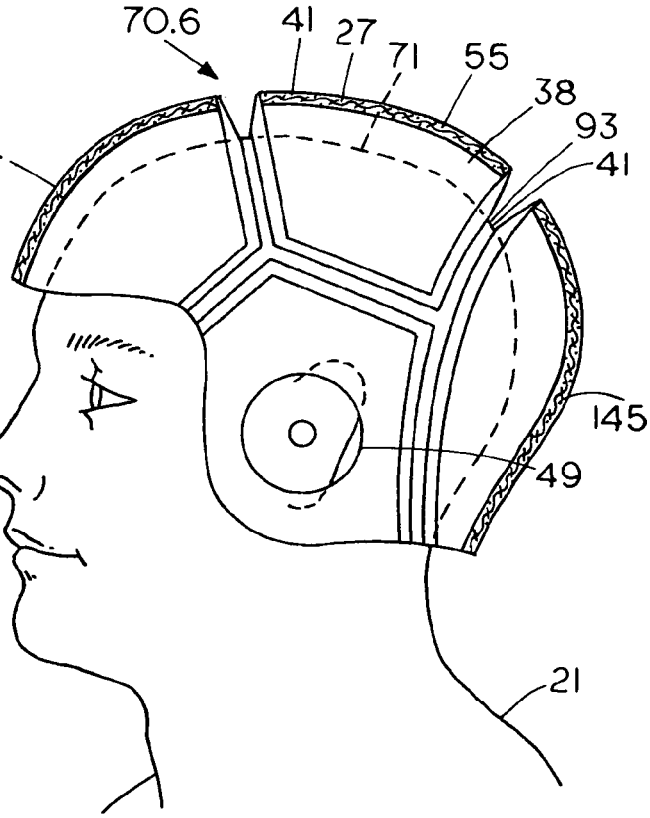
FIG. 27 is a perspective view of helmet including an impregnated textile material, positioned on a wearer.

FIG. 27, is a perspective view of a helmet 70.6 substantially consisting of an impregnated textile material 55 which forms the exterior portion. The impregnated textile material 55 can be made of a woven, non-woven, or knitted textile material made of glass, aramid, polyethylene, polyester, or carbon fiber, and the like. The light cure material 27 used to impregnate the textile material can form a rigid, or alternatively, a non-rigid material when cured, as desired. Impregnated textile materials 55 are sometimes identified as "prepreg" materials. The surface of some uncured "prepreg" materials can be only slightly tacky to the touch, thus "prepreg" materials can be relatively easy to handle and manipulate with rubber gloves. Alternatively, a thin layer of substantially transparent protective film 104 such as PVdC, or shrink wrap, can be used to cover the exterior surface of the impregnated textile material 55. After the article including the impregnated textile material 55 is donned by a wearer, and shaped to fit and cured, the thin layer of protective film 104 can possibly be removed. The light cure material 27 used to impregnate the textile material can form a rigid, or alternatively, a non-rigid material when cured, as desired. Alternatively, or in addition to the inclusion of an impregnated textile material 55, a bladder 28 can include a light cure material 27 which can include a fiber filler material 145. Fiber filler materials 145 such as short or long glass fibers, carbon fibers, aramid fibers, polyethylene fibers, polyester fibers or boron fibers, and the like, can also be included with a light cure material 27 in a bladder 28. For example, chopped strand glass fibers identified as product type 3075 made by PPG Industries of Shelby, N.C. having a length of approximately 3.2 mm or ⅛ths inch can be used. Moreover, filler materials consisting of fine particles or flakes can also be included within a light cure material, and such particulate filler materials can consist of clay, talc, mica, soda lime borosilicate, sodium borosilicate, silica, aluminosilicate, fly ash, perlite, organic or inorganic microspheres, metal steel, aluminum, titanium, zirconia, ceramics, boron carbide, silicone carbide, silicon nitride, aluminum nitride, and the like. An impregnated textile material 55 and/or a light cure material including a fiber filler material 145 can be used in combination with other cushioning materials such as foam material, or a fluid filled bladder including a gas.

Figure 28:
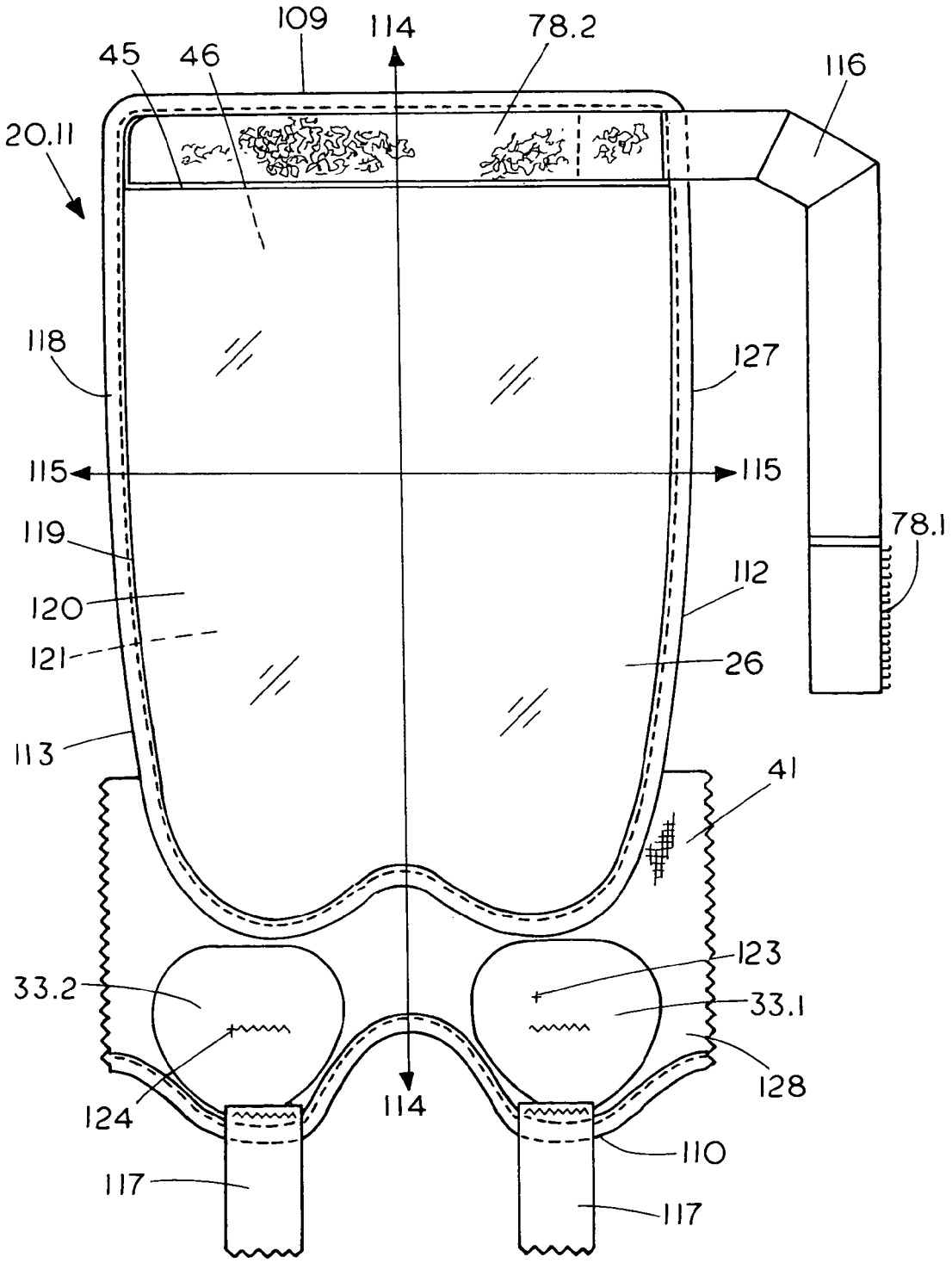
FIG. 28 is an anterior plan view of a shin guard having a symmetrical shape in which both the strap for passing under a wearer's foot, and also the stretchable guard for encompassing a wearer's lower leg and ankles have been cut so that the shin guard can be flattened out and shown with greater accuracy.

FIG. 28 is an anterior plan view of a shin guard 20.11 having a symmetrical shape near the area corresponding to a wearer's medial malleolus 33.1 and lateral malleolus 33.2. The plantar strap 117 for passing under a wearer's foot, and also the stretchable inferior guard 128 for encompassing a wearer's lower leg and ankles have been cut so that the shin guard 20.11 can be flattened out and shown with greater accuracy. The plantar strap 117 measures approximately four inches in length, and one half inch at both ends of the strap 117 overlap a portion of the inferior guard 128 of the shin guard 20.11 and are affixed by stitches 119 near the inferior edge 110. As shown in FIG. 28, a strip of female VELCRO® 78.2 or pile which can measure one inch in width and seven and one half inches in length is affixed by stitches 119 can extend substantially across the shin guard 20.11 near the superior side 109, and a strap 118 having a length of approximately ten inches including a two inch portion of male VELCRO® 78.1 or hook at the distal end can extend from the medial side 112 of the shin guard 20.11. The strap 116 can extend about a wearer's lower leg and the male VELCRO® 78.1 can then be affixed to the female VELCRO® 78.2. The shin guard 20.11 also includes a portion of edge trim 118 that can be affixed by stitches 119 about a plurality of edges for providing cushioning and enhancing comfort. The shin guard 20.11 has an access point 45 to a pocket 46 near the superior edge 109 which extends substantially between the medial side 122 and lateral side 113 and generally parallel to the transverse axis 115. The pocket 46 can possibly measure slightly less than eight inches in width as measured along the transverse axis 115 and less than twelve inches in height as measured along the longitudinal axis 114. A layer of relatively thin plastic film 26 measuring between 10–50 mils in thickness such as a substantially transparent polyurethane film made by Deerfield Urethane, Inc. of Deerfield, Mass. can be used to made the anterior side 120 of the pocket 46, whereas the posterior side 121 of the pocket 46 can be made of a fabric or textile material including one or more layers which can include a foam material and also a plurality of openings 49 therethrough for enhancing ventilation. As shown in FIG. 28, the shin guard 20.11 includes a superior guard 127 portion for protecting the wearer's lower leg, and an inferior guard 128 portion for protecting the wearer's ankles or medial and lateral madeoli. The inferior guard 128 can be made of a stretchable woven or knit fabric such as one made of a blend of 30 percent natural cotton fiber with 60 percent polyester fiber and 10 percent elastic material such as SPANDEX®, or LYCRA®, and the like, made by the DuPont de Nemours company of Wilmington, Del., or alternatively, an elastomeric material such as a foamed neoprene rubber including a stretchable textile laminate. As shown in FIG. 28, the inferior guard 128 measures approximately four inches in height along the area which has been severed, that is, as measured along the longitudinal axis 114, and approximately eight inches in width between the medial side 112 and the lateral side 113. The inferior guard 128 can also include a medial malleolus pad or guard 33.1 and a lateral malleolus pad or guard 33.2 which can be made of a plastic, rubber, or foam material. The approximate position of the most prominent portion of the medial malleolus is indicated by an X and numeral 123, whereas the approximate position of the most prominent portion of the lateral malleolus is indicated by an X and numeral 124.

Figure 29:
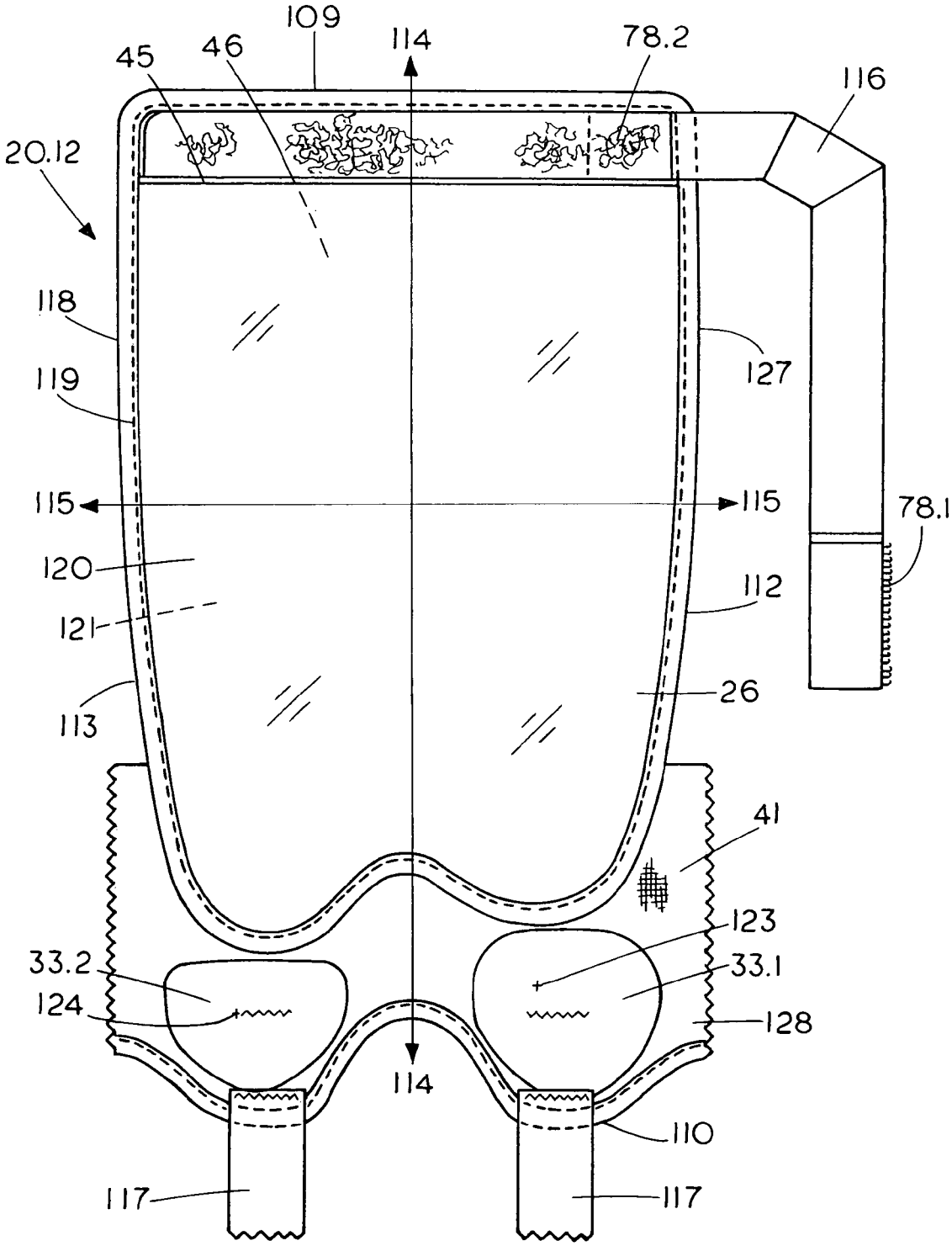
FIG. 29 is an anterior plan view of a shin guard having an asymmetrical shape in which both the strap for passing under a wearer's foot, and also the stretchable guard for encompassing a wearer's lower leg and ankles have been cut so that the shin guard can be flattened out and shown with greater accuracy.

FIG. 29 is an anterior plan view of a shin guard 20.12 having an asymmetrical shape near the area corresponding to a wearer's medial malleolus and lateral malleolus in which both the plantar strap 117 for passing under a wearer's foot, and also the stretchable inferior guard 128 for encompassing a wearer's lower leg and ankles have been cut so that the shin guard 20.12 can be flattened out and shown with greater accuracy. The asymmetrical shape better accommodates for the normal asymmetry that exists between the relative height of the most prominent portion of a wearer's medial malleolus 123 which is commonly at least approximately 10 mm or one half inch more superior and also more anterior relative to the normal position of the most prominent portion of a wearer's lateral malleolus 124.

Figure 30:
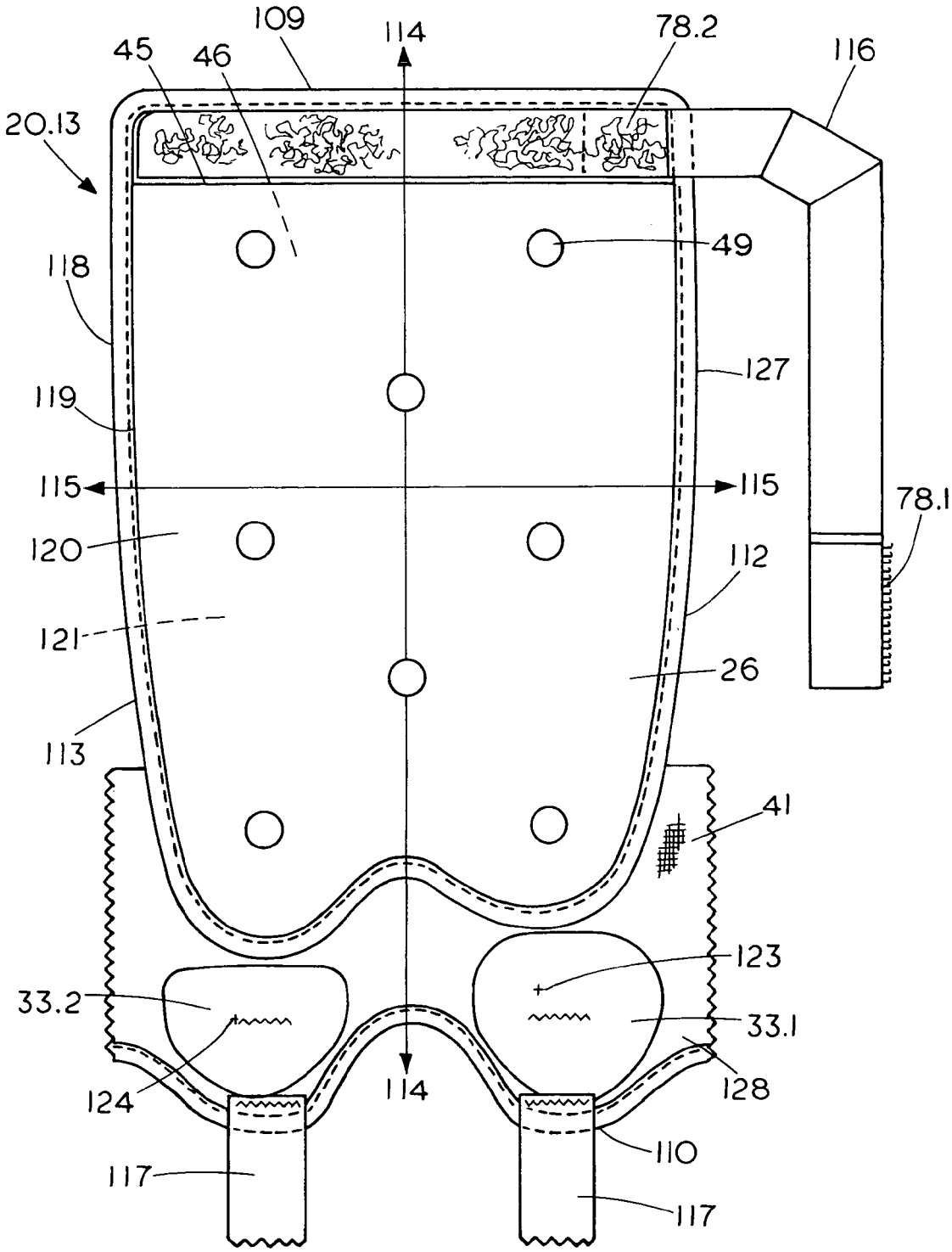
FIG. 30 is an anterior plan view of a shin guard similar to that shown in FIG. 29 having an asymmetrical shape in which both the strap for passing under a wearer's foot, and also the stretchable guard for encompassing a wearer's lower leg and ankles have been cut so that the shin guard can be flattened out and shown with greater accuracy, and also including openings for ventilation.

FIG. 30 is an anterior plan view of a shin guard 20.13 similar to that shown in FIG. 29 having an asymmetrical shape in which both the plantar strap 117 for passing under a wearer's foot, and also the stretchable inferior guard 128 for encompassing a wearer's lower leg and ankles have been cut so that the shin guard 20.13 can be flattened out and shown with greater accuracy. The shin guard 20.13 also includes openings 49 through the film 26 forming the anterior side 120 of the pocket and openings 49 through the material forming the posterior side 121 of the pocket for enhancing ventilation.

Figure 31:
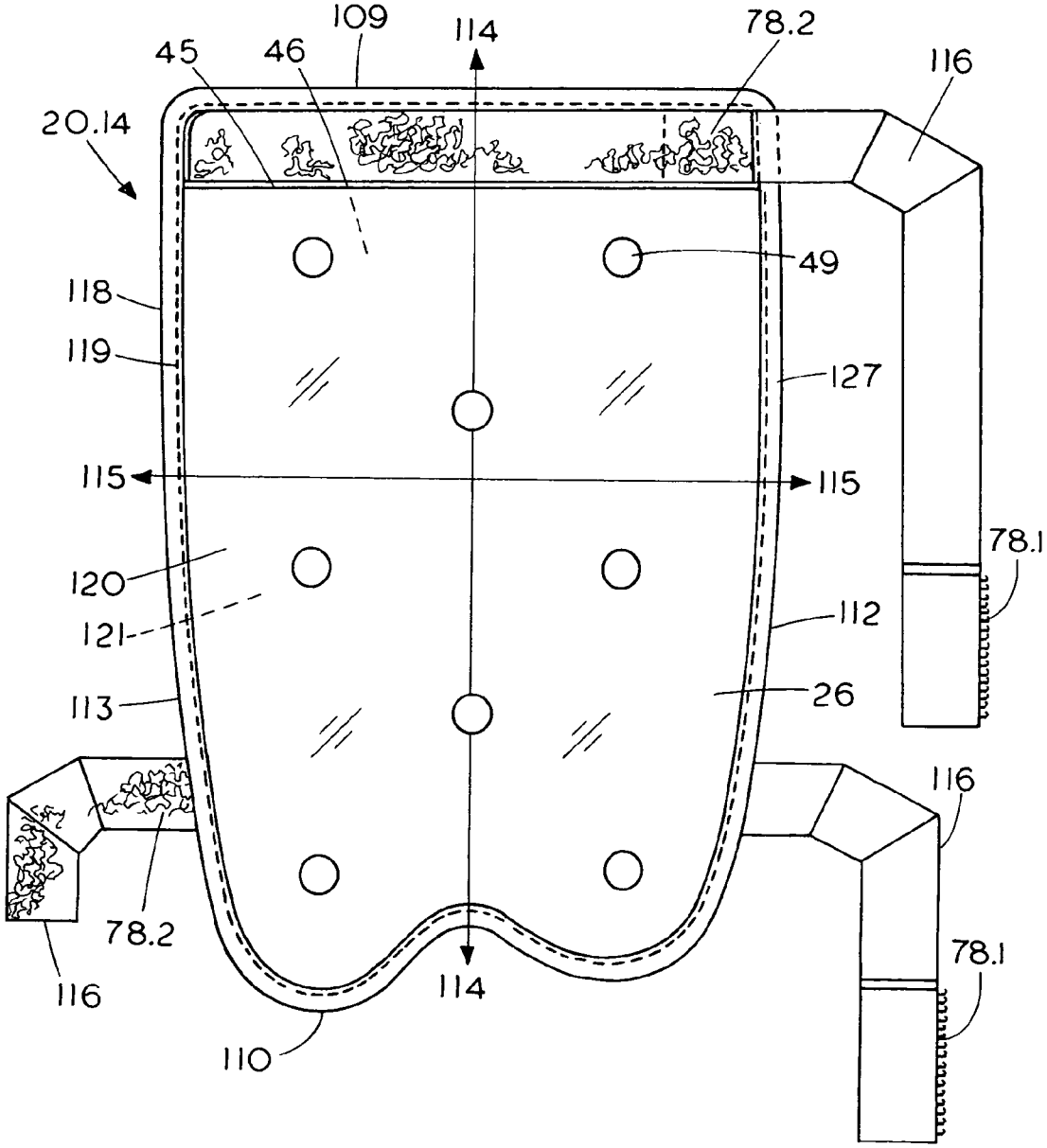
FIG. 31 is an anterior plan view of a shin guard similar to that shown in FIG. 30 having an asymmetrical shape and including openings for ventilation in which the strap for passing under a wearer's foot has been cut so that the shin guard can be flattened out and shown with greater accuracy, but excluding the stretchable guard for encompassing a wearer's lower leg and ankles.

FIG. 31 is an anterior plan view of a shin guard 20.14 including a superior guard 127 generally similar to that shown in FIG. 30 having an asymmetrical shape and including openings 49 for ventilation, but excluding the stretchable inferior guard 128 portion for encompassing a wearer's malleoli. The shin guard 20.14 includes an additional strap 116 that can be affixed by stitches 119 near the inferior side 110.

Figure 32:
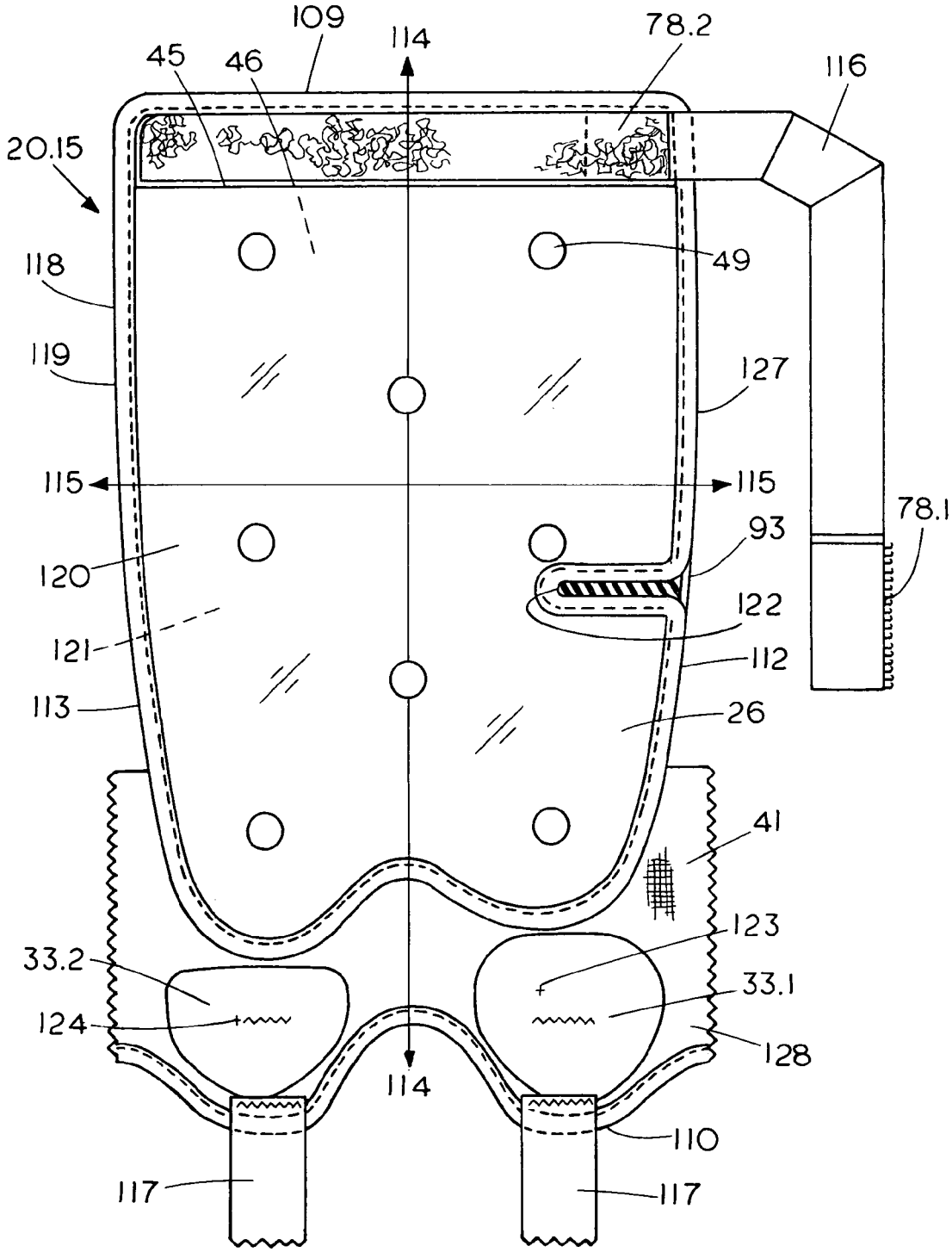
FIG. 32 is an anterior plan view of a shin guard similar to that shown in FIG. 30 having an asymmetrical shape and including openings for ventilation in which both the strap for passing under a wearer's foot, and also the stretchable guard for encompassing a wearer's lower leg and ankles have been cut so that the shin guard can be flattened out and shown with greater accuracy, but also including a flex notch on the medial side.

FIG. 32 is an anterior plan view of a shin guard 20.15 generally similar to that shown in FIG. 30 having an asymmetrical shape and including openings 49 for ventilation in which both the plantar strap 117 for passing under a wearer's foot, and also the stretchable inferior guard 128 for encompassing a wearer's lower leg and ankles have been cut so that the shin guard 20.15 can be flattened out and shown with greater accuracy, but also including a flex notch 122 on the medial side 112. The flex notch 122 can be bridged by a stretchable elastic material 93 which can be affixed by stitches 119, and can possibly enhance accommodation of a wearer's calf muscles on the medial side 112.

Figure 33:
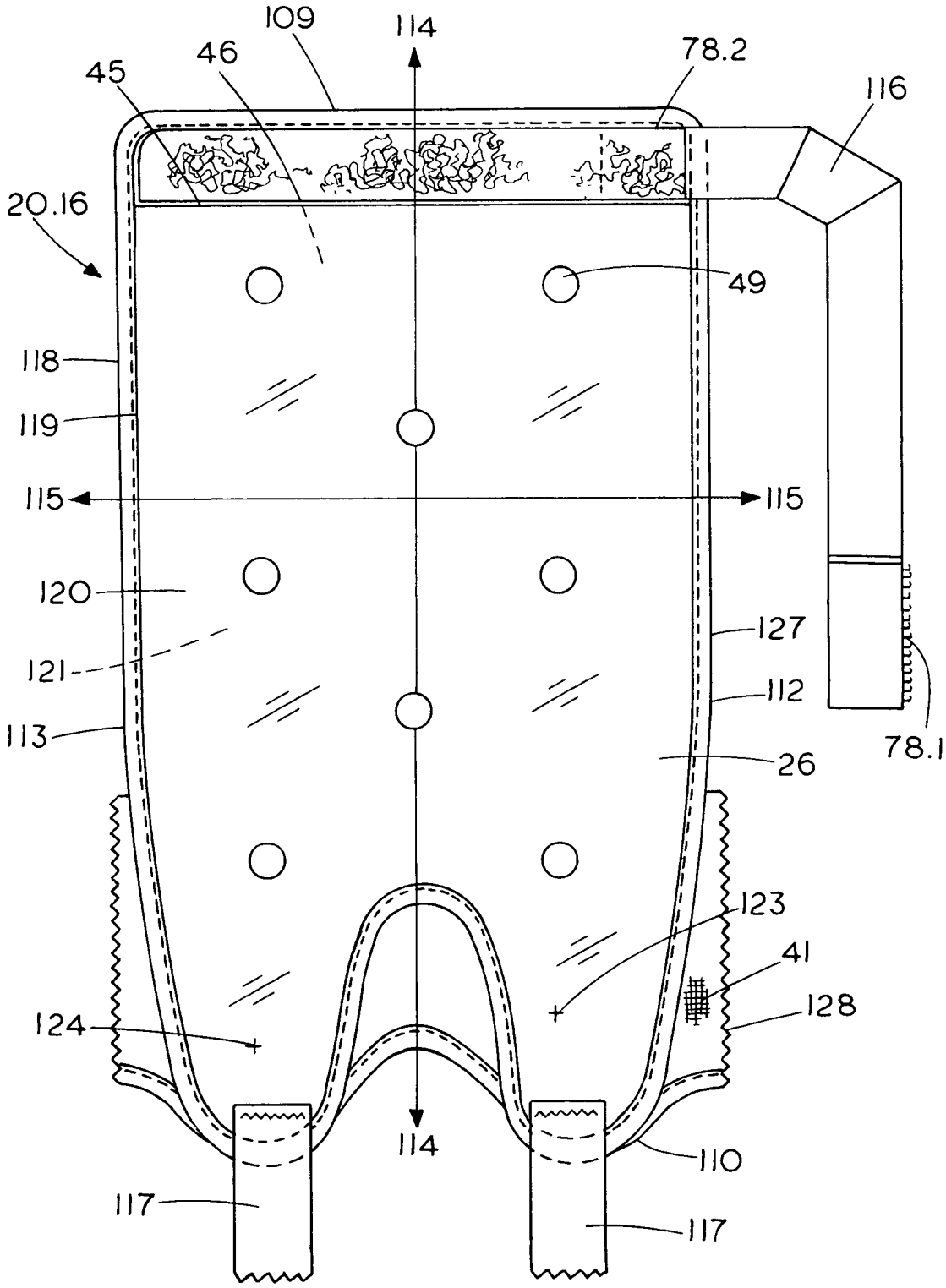
FIG. 33 is an anterior plan view of a shin guard generally similar to that shown in FIG. 30 having an asymmetrical shape and including openings for ventilation in which both the strap for passing under a wearer's foot, and also the stretchable guard for encompassing a wearer's lower leg and ankles have been cut so that the shin guard can be flattened out and shown with greater accuracy, but the pocket extends more inferiorly about the areas corresponding to the medial and lateral malleoli of a wearer.

FIG. 33 is an anterior plan view of a shin guard 20.16 generally similar to that shown in FIG. 30 having an asymmetrical shape and including openings 49 for ventilation in which both the plantar strap 117 for passing under a wearer's foot, and also the stretchable inferior guard 128 for encompassing a wearer's lower leg and ankles have been cut so that the shin guard 20.16 can be flattened out and shown with greater accuracy, but the pocket 46 extends more inferiorly about the areas corresponding to the medial malleolus 123 and lateral malleolus 124 of a wearer.

Figure 34:
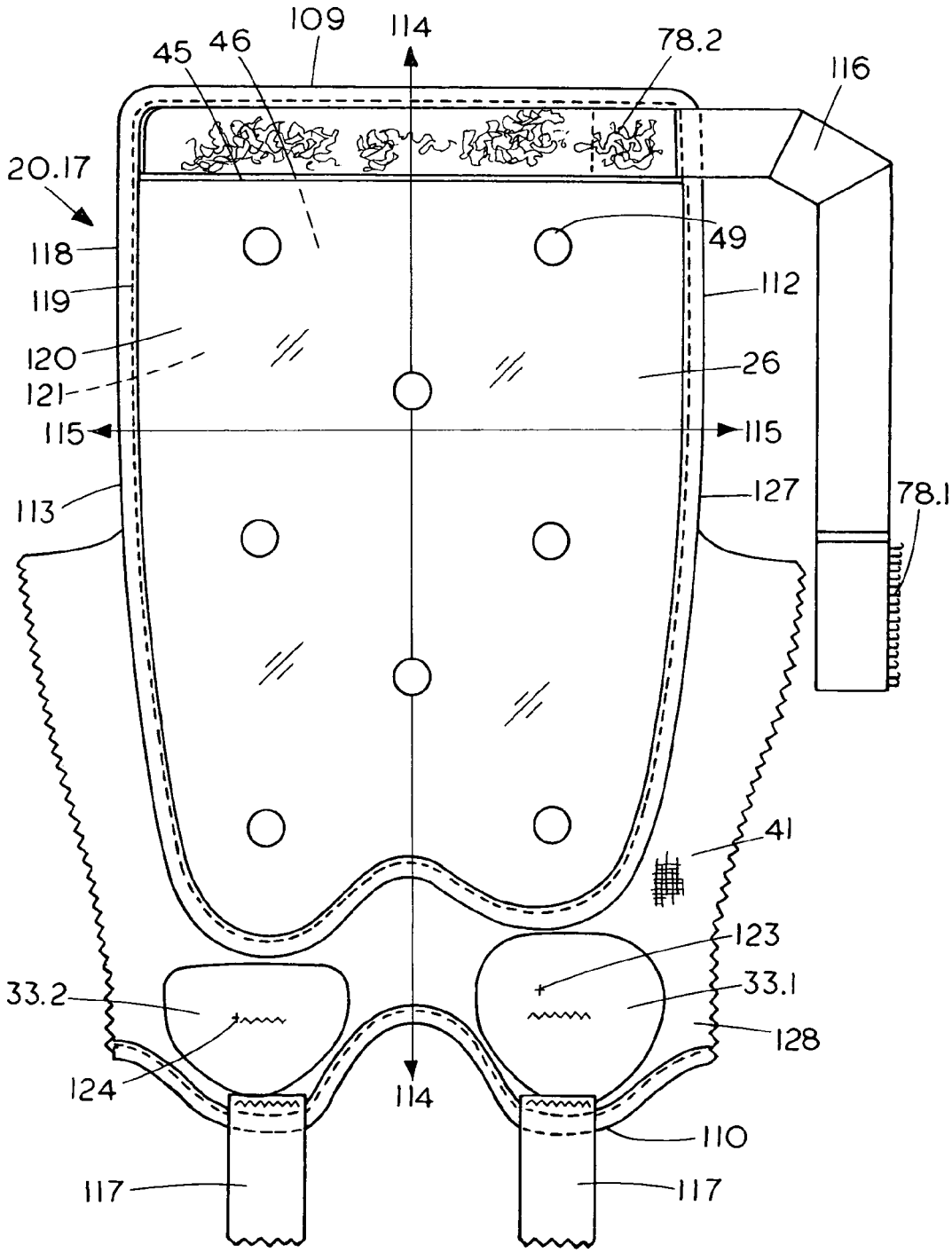
FIG. 34 is an anterior plan view of a shin guard generally similar to that shown in FIG. 30 having an asymmetrical shape and including openings for ventilation in which both the strap for passing under a wearer's foot, and also the stretchable guard for encompassing a wearer's lower leg and ankles have been cut so that the shin guard can be flattened out and shown with greater accuracy, but the stretchable guard portion extends further upwards about an area corresponding to a wearer's lower leg.

FIG. 34 is an anterior plan view of a shin guard 20.17 generally similar to that shown in FIG. 30 having an asymmetrical shape and including openings 49 for ventilation in which both plantar strap 117 for passing under a wearer's foot, and also the stretchable inferior guard 128 for encompassing a wearer's lower leg and ankles have been cut so that the shin guard 20.17 can be flattened out and shown with greater accuracy, but the stretchable inferior guard 128 portion extends approximately three more inches upwards as measured along the longitudinal axis 114.

Figure 35:
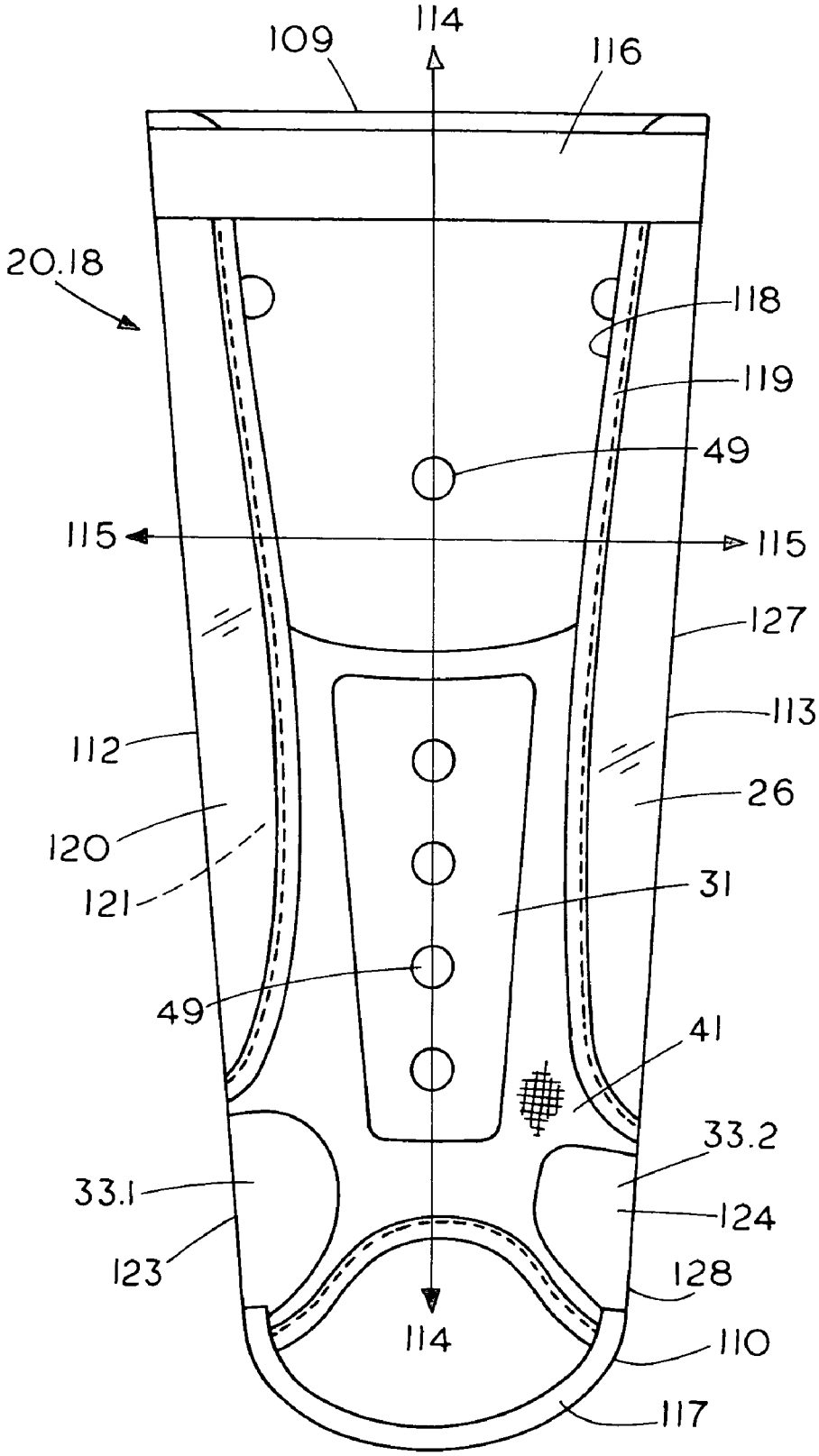
FIG. 35 is a posterior three dimensional perspective view of a shin guard generally similar to that shown in FIG. 34 showing a stretchable guard portion, but also a posterior guard.

FIG. 35 is a posterior three dimensional perspective view of a shin guard 20.18 generally similar to that shown in FIG. 34 showing a stretchable inferior guard 128 portion, but also a posterior guard 31. The posterior guard 31 can be made of a foam material and can provide protection for the wearer's Achilles tendon. The plantar strap 117 and stretchable inferior guard 128 are shown in their intact state in FIG. 35, as opposed to their severed representation in FIG. 34. Openings 49 in the material forming the posterior side 121 of the pocket 46 for enhancing ventilation can also be seen in FIG. 35.

Figure 36:
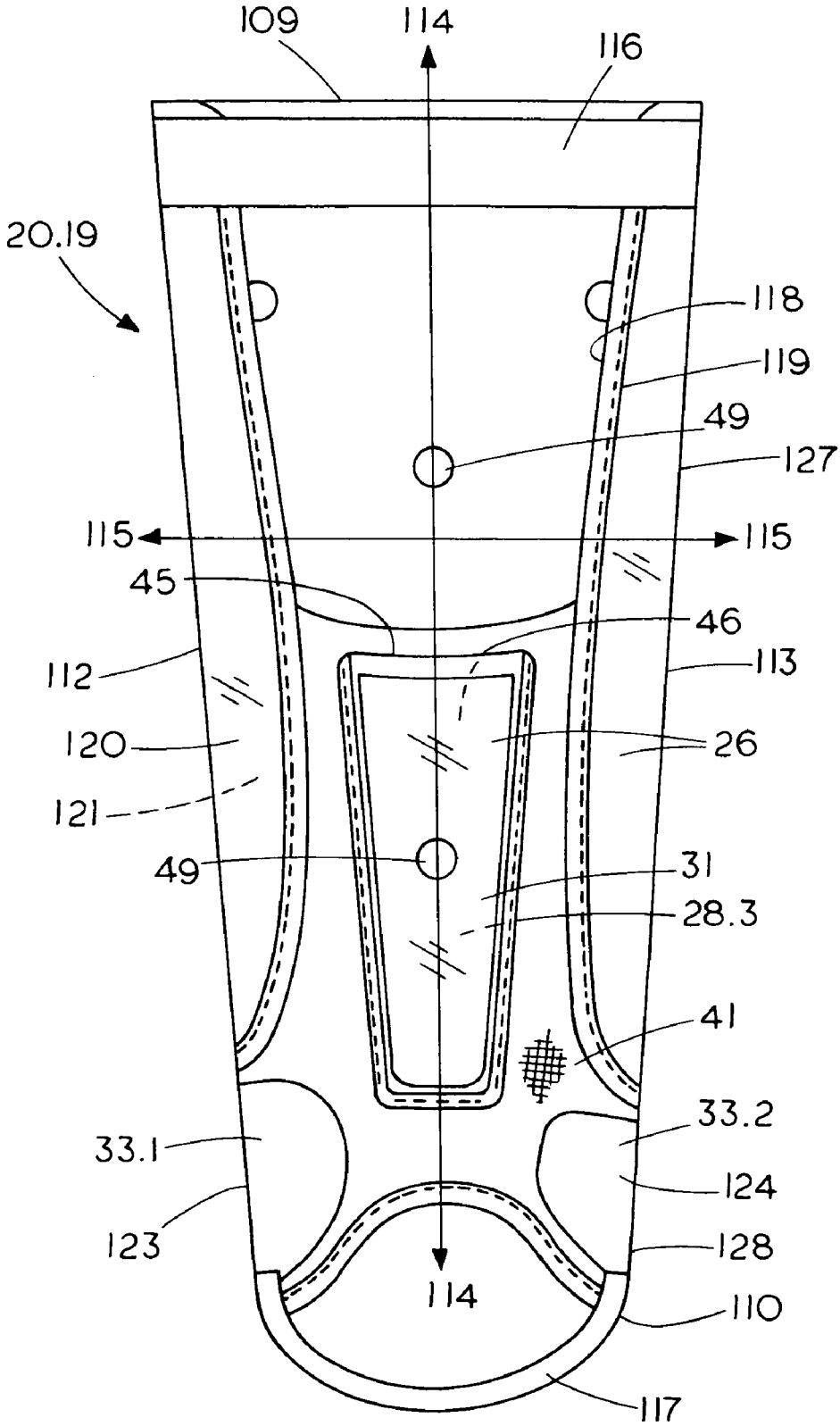
FIG. 36 is a posterior three dimensional perspective view of a shin guard generally similar to that shown in FIG. 35 showing a stretchable guard portion, but also a posterior guard having a pocket for receiving a bladder including light cure material.

FIG. 36 is a posterior three dimensional perspective view of a shin guard 20.19 generally similar to that shown in FIG. 35 showing a stretchable inferior guard 128 portion, but also a posterior guard 31 having a pocket 46 for receiving a bladder 28.3 including light cure material 27, or alternatively, a textile material 41 impregnated with a light cure material 27 forming an impregnated textile material 55. The posterior guard 31 can then provide a permanent custom fit for a individual wearer.

Figure 37:
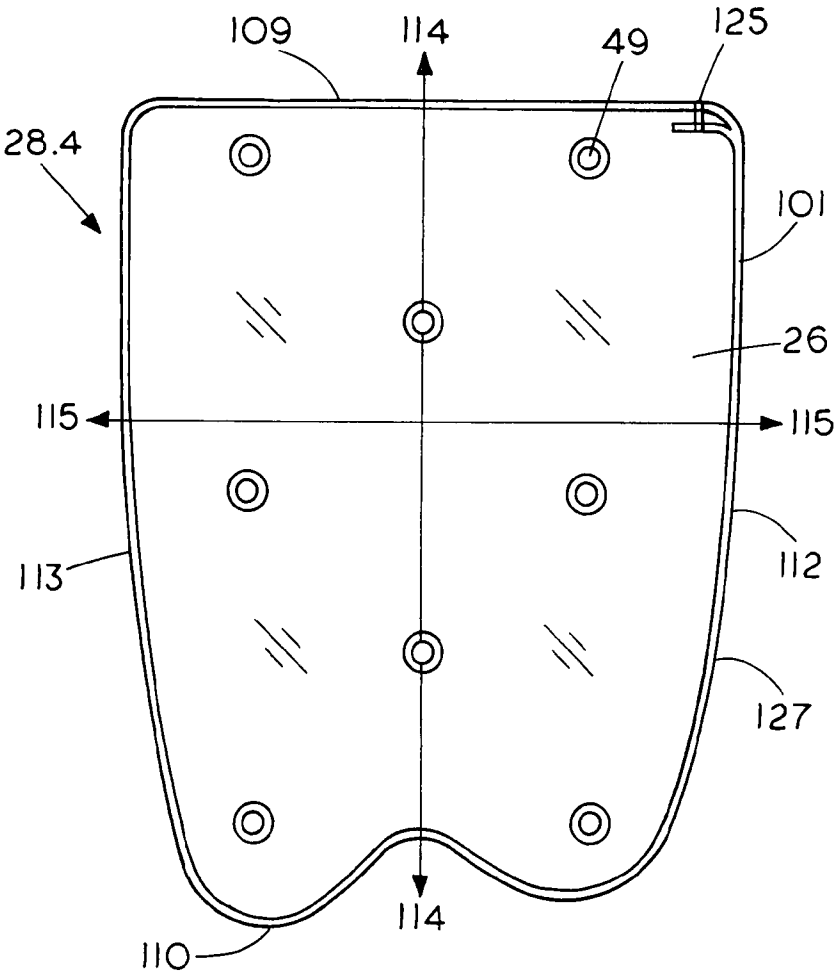
FIG. 37 is an anterior plan view of a bladder for containing light cure material for use with a shin guard having an asymmetrical shape generally similar to that shown in FIG. 30.

FIG. 37 is an anterior plan view of a bladder 28.4 for containing light cure material 27 for use with a shin guard 20.13 having an asymmetrical shape generally similar to that shown in FIG. 30. A bladder 28 can be formed by radio frequency welding together two relatively thin layers of film 26 having a thickness approximately between 5–20 mils. Shown are weld 101 areas including a sealing weld 125, and also a plurality of openings 49 for enhancing ventilation. The anterior side 120 of the bladder 28.4 is made of a substantially transparent film material for transmitting light therethrough. If desired, the posterior side 121 of the bladder 28.4 can include a reflective material 126, and this can serve to reduce the curing time of the light cure material 27.

Figure 38:
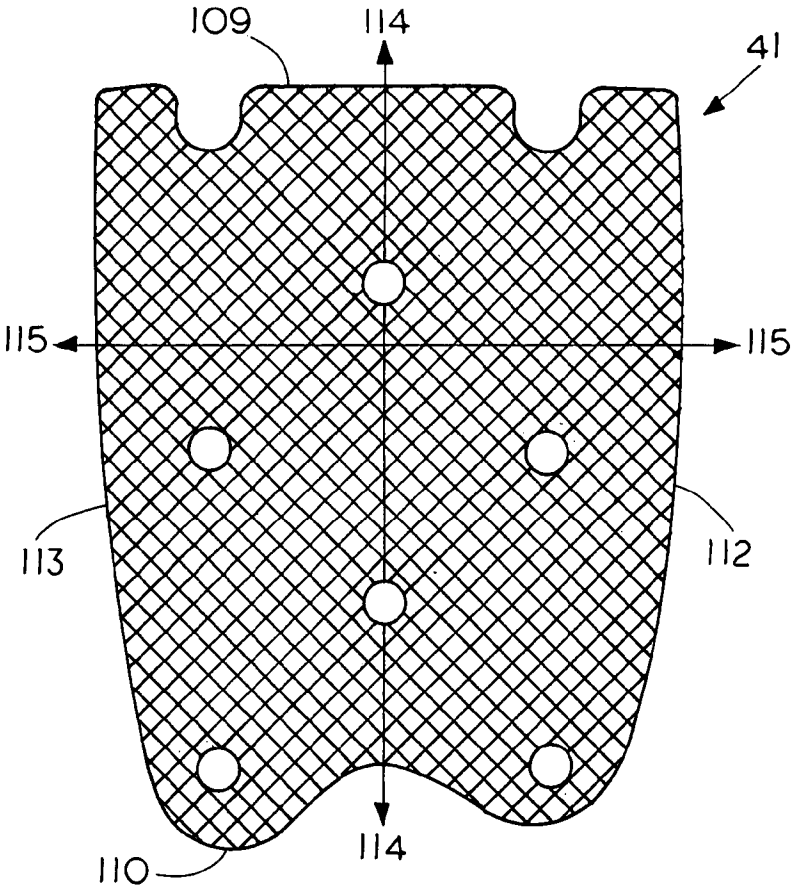
FIG. 38 is an anterior plan view of a textile material for possible use inside the bladder shown in FIG. 37.

FIG. 38 is an anterior plan view of a textile material 41 for possible use inside the bladder 28.4 shown in FIG. 37. Again, the textile material can consist of a woven and stitched fiberglass textile material such as VX 191 made by V2 Superior Composite Reinforcement Fabrics of 770 Lee Road 191, Auburn, Ala.

Figure 39:
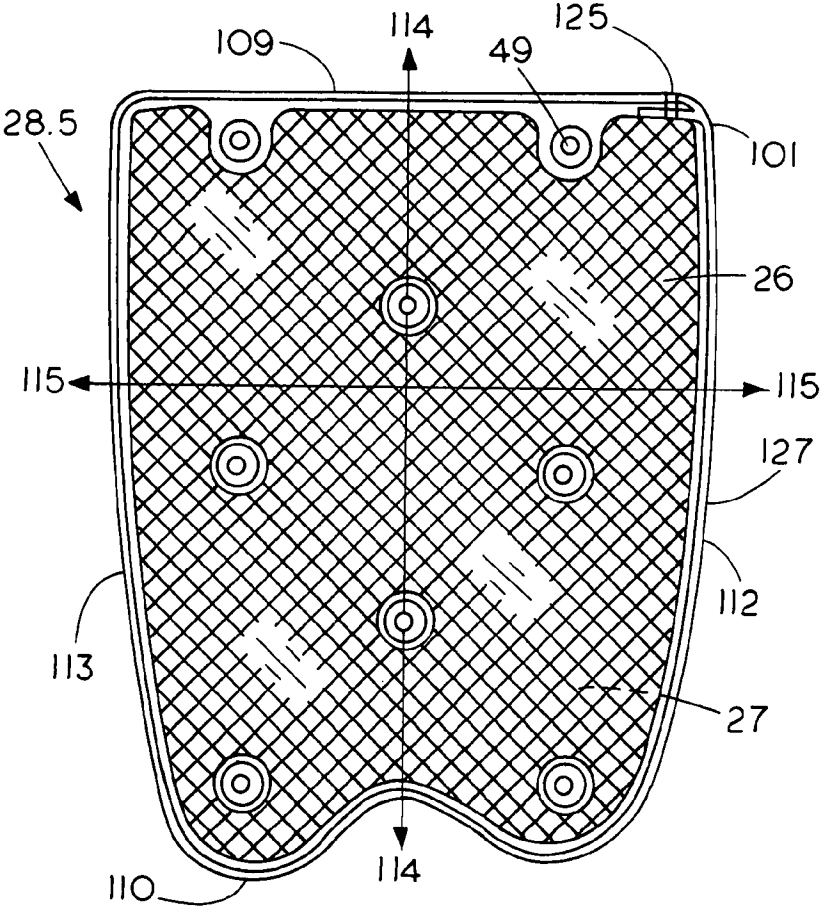
FIG. 39 is an anterior plan view of a bladder generally similar to that shown in FIG. 37 including the textile material shown in FIG. 38 therein.

FIG. 39 is an anterior plan view of a bladder 20.5 generally similar to that shown in FIG. 37 including the textile material 41 shown in FIG. 38 therein, and also including a light cure material 27, thus forming an impregnated textile material 55. Again, a bladder 28 can be formed by radio frequency welding together two relatively thin layers of film 26 having a thickness approximately between 5–20 mils. Shown are weld 101 areas including a sealing weld 125, and also a plurality of openings 49 for enhancing ventilation.

Figure 40:
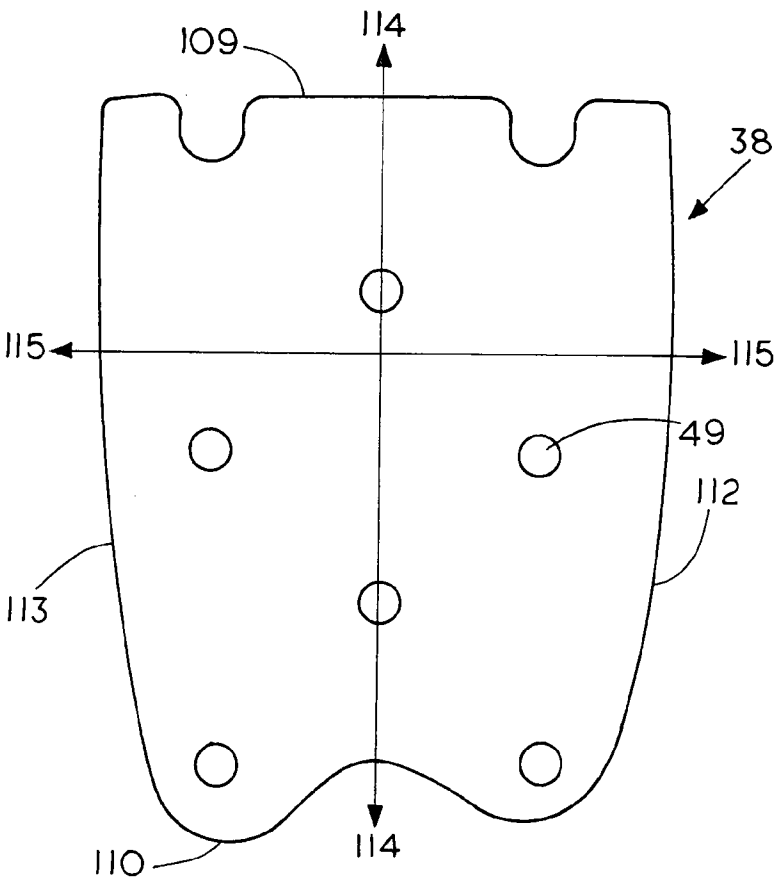
FIG. 40 is an anterior plan view of a foam material for possible use within a bladder similar to that shown in FIG. 37 or FIG. 39.

FIG. 40 is an anterior plan view of a foam material 38 including a plurality of openings 49 for possible use within a bladder 28.4 or 28.5 generally similar to those shown in FIG. 37 or FIG. 39. The foam material 38 can be made of polyurethane, ethylene vinyl acetate, natural or synthetic rubber, and the like.

Figure 41:
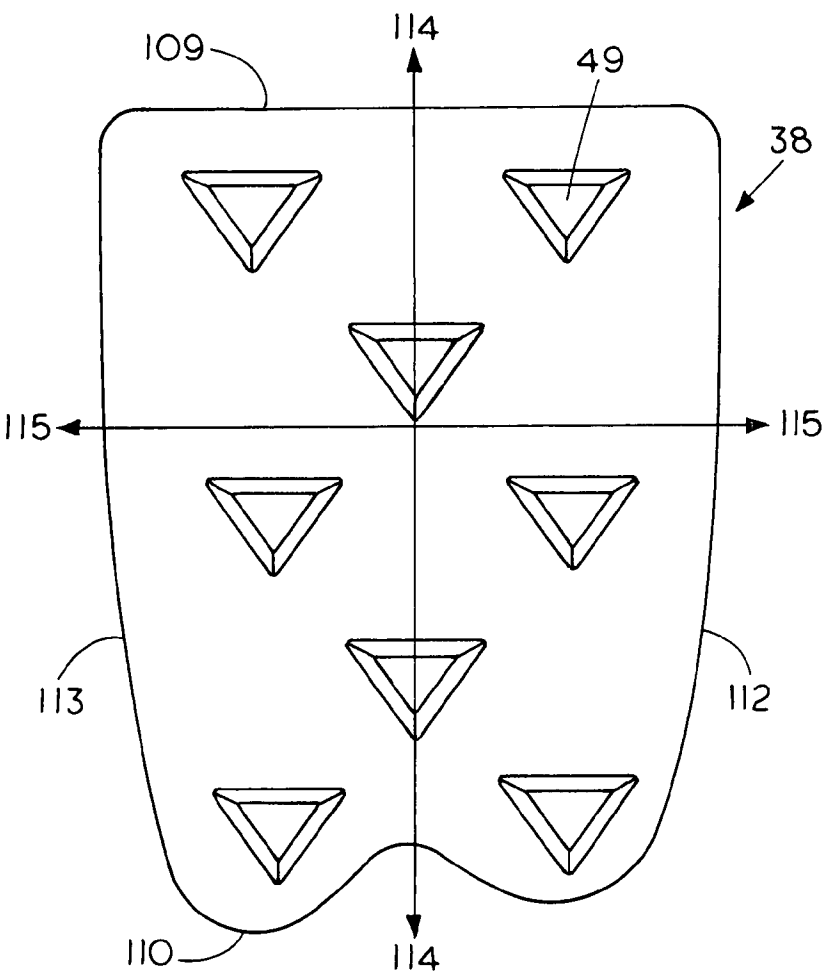
FIG. 41 is an anterior plan view of a foam material for possible exterior use in combination with a bladder similar to that shown in FIG. 37 or FIG. 39.

FIG. 41 is an anterior plan view of a foam material 38 including a plurality of openings 49 for possible exterior use in combination with a bladder 28.4 or 28.5 generally similar to those shown in FIG. 37 or FIG. 39. The foam material 38 can be made of polyurethane, ethylene vinyl acetate, natural or synthetic rubber, and the like.

Figure 42:
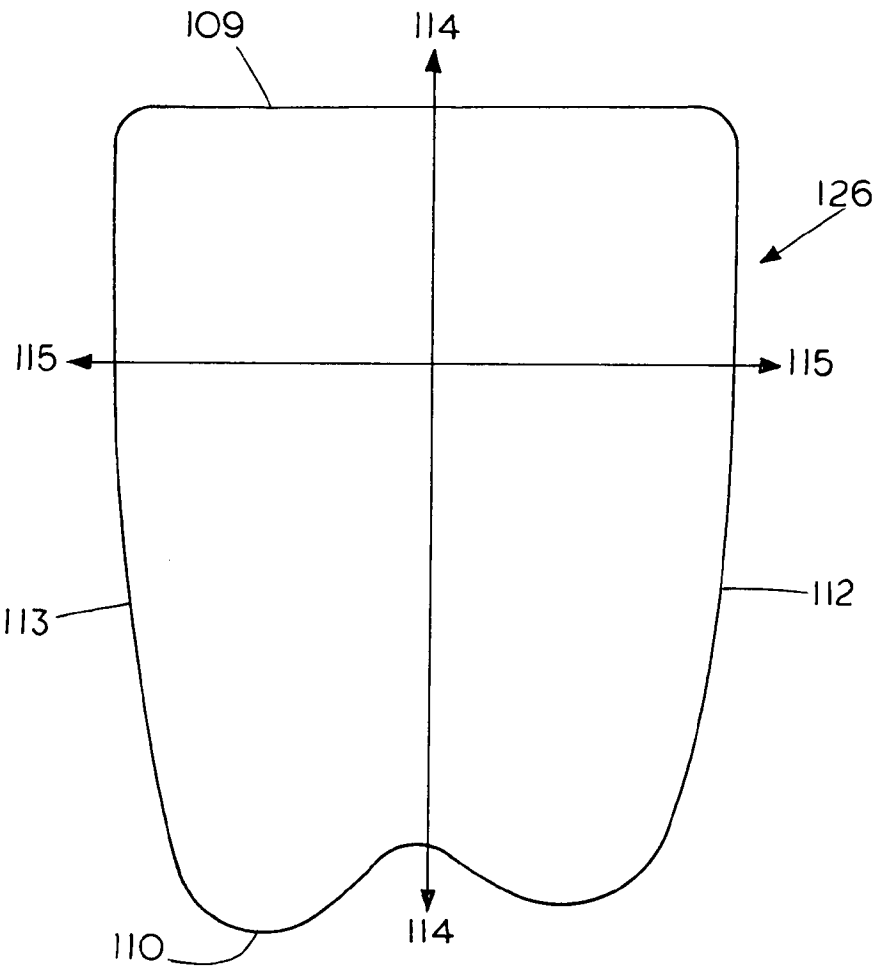
FIG. 42 is an anterior plan view of a reflective material for possible interior or external use in combination with a bladder similar to that shown in FIG. 37 or FIG. 39.

FIG. 42 is an anterior plan view of a reflective material 126 for possible interior or external use in combination with a bladder 28.4 or 28.5 generally similar to those shown in FIG. 37 or FIG. 39. The reflective material 126 can be made of aluminum foil, or alternately and as preferred, a relatively thin plastic film material including leafing grade aluminum particles therein.

Figure 43:
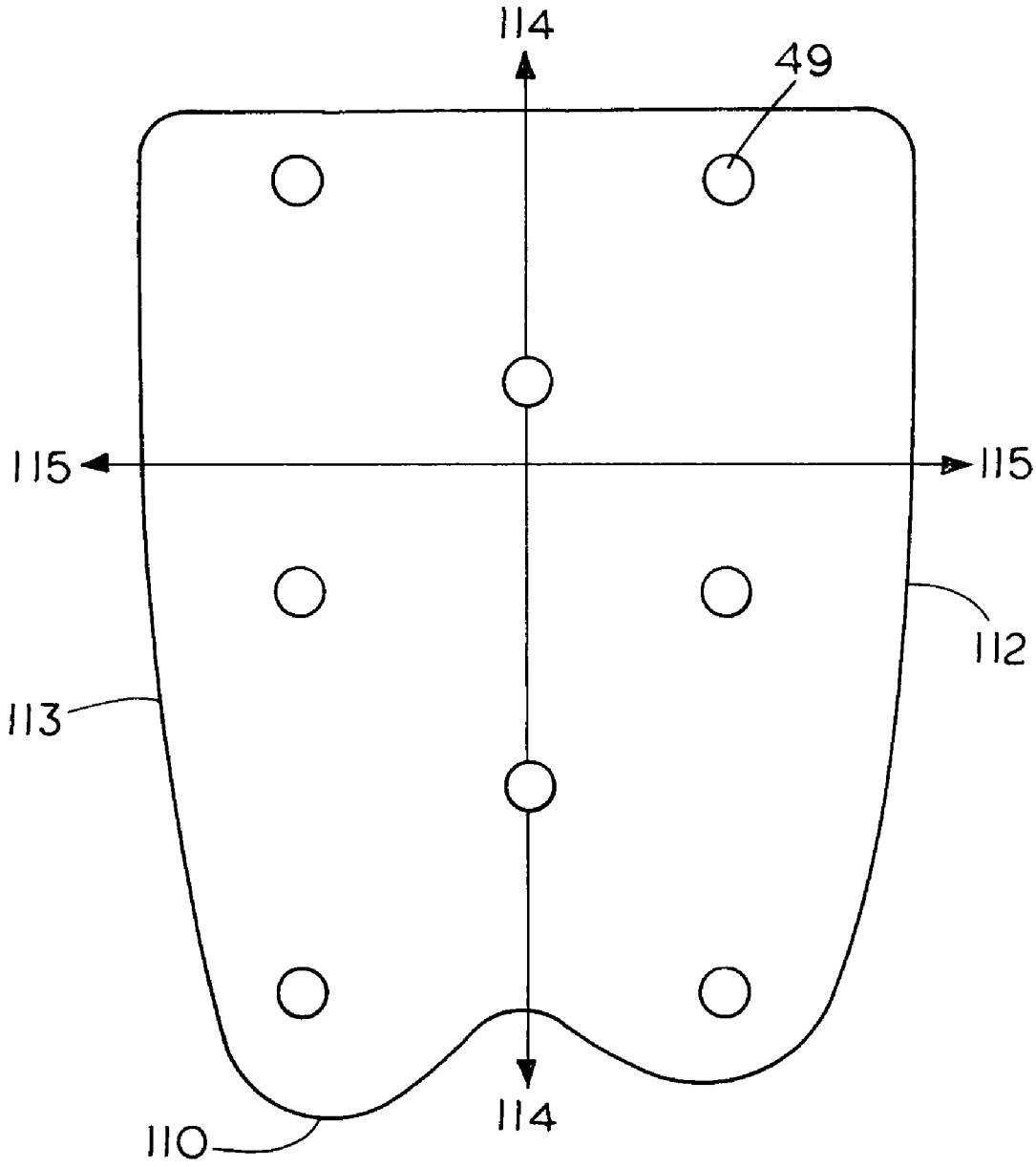
FIG. 43 is an anterior plan view of a reflective material generally similar to that shown in FIG. 42 for possible interior or external use in combination with a bladder similar to that shown in FIG. 37 or FIG. 39, but also having openings for ventilation.

FIG. 43 is an anterior plan view of a reflective material 126 generally similar to that shown in FIG. 42 for possible interior or external use in combination with a bladder 28.4 or 28.5 generally similar to those shown in FIG. 37 or FIG. 39, but also having openings 49 for ventilation.

Figure 44:
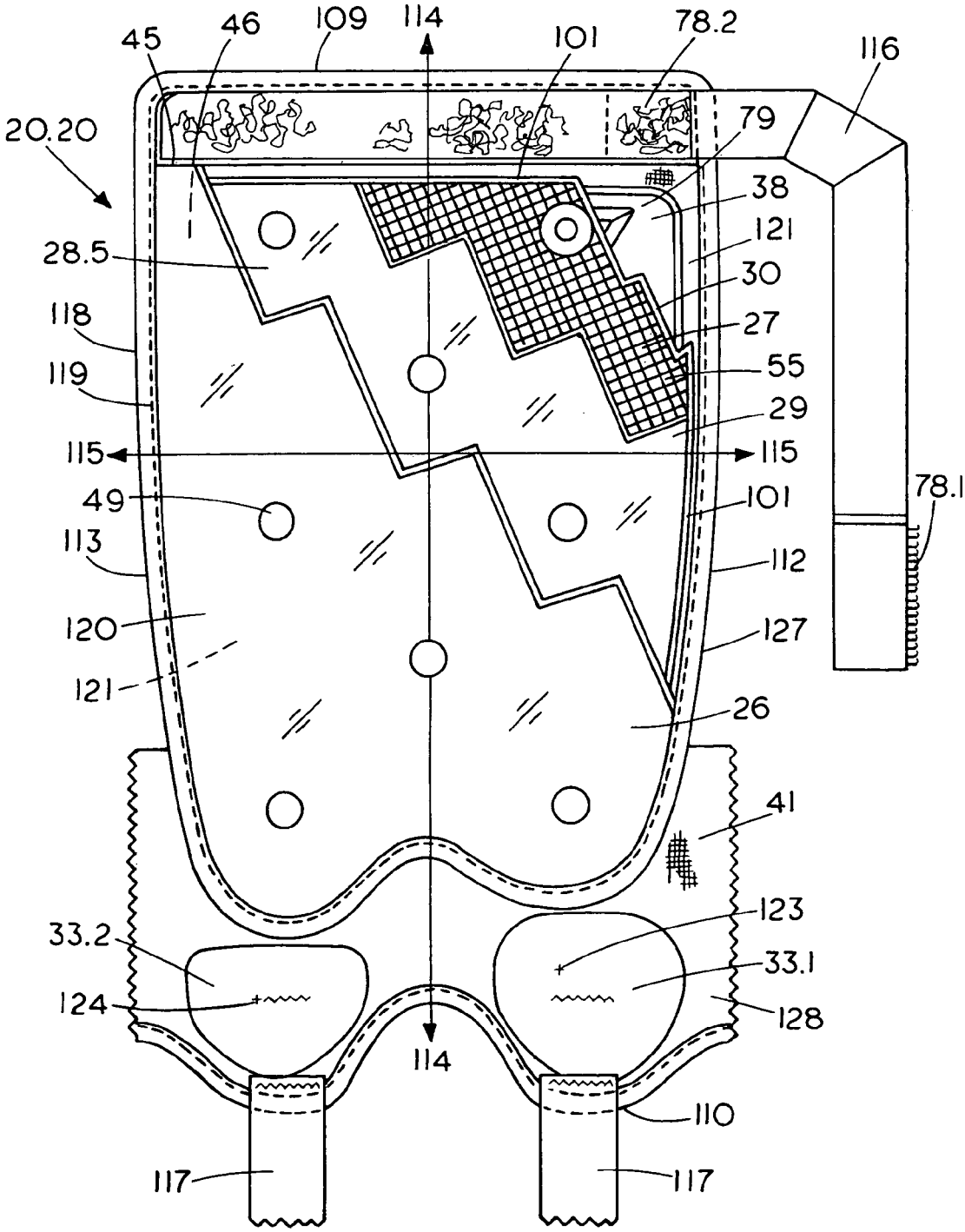
FIG. 44 is an anterior plan view of a shin guard with parts broken away to show the use of a foam material posterior of a bladder containing light cure material that is located within a pocket of the shin guard.

FIG. 44 is an anterior plan view of a shin guard 20.20 with parts broken away to show the use of a foam material 38 posterior of a bladder 28.5. The bladder 28.5 contains light cure material 37 and a textile material 41 impregnated with light cure material 27 thereby forming an impregnated textile material 55. The bladder 28.5 is shown located within a pocket 0.46 of the shin guard 20.20.

Figure 45:
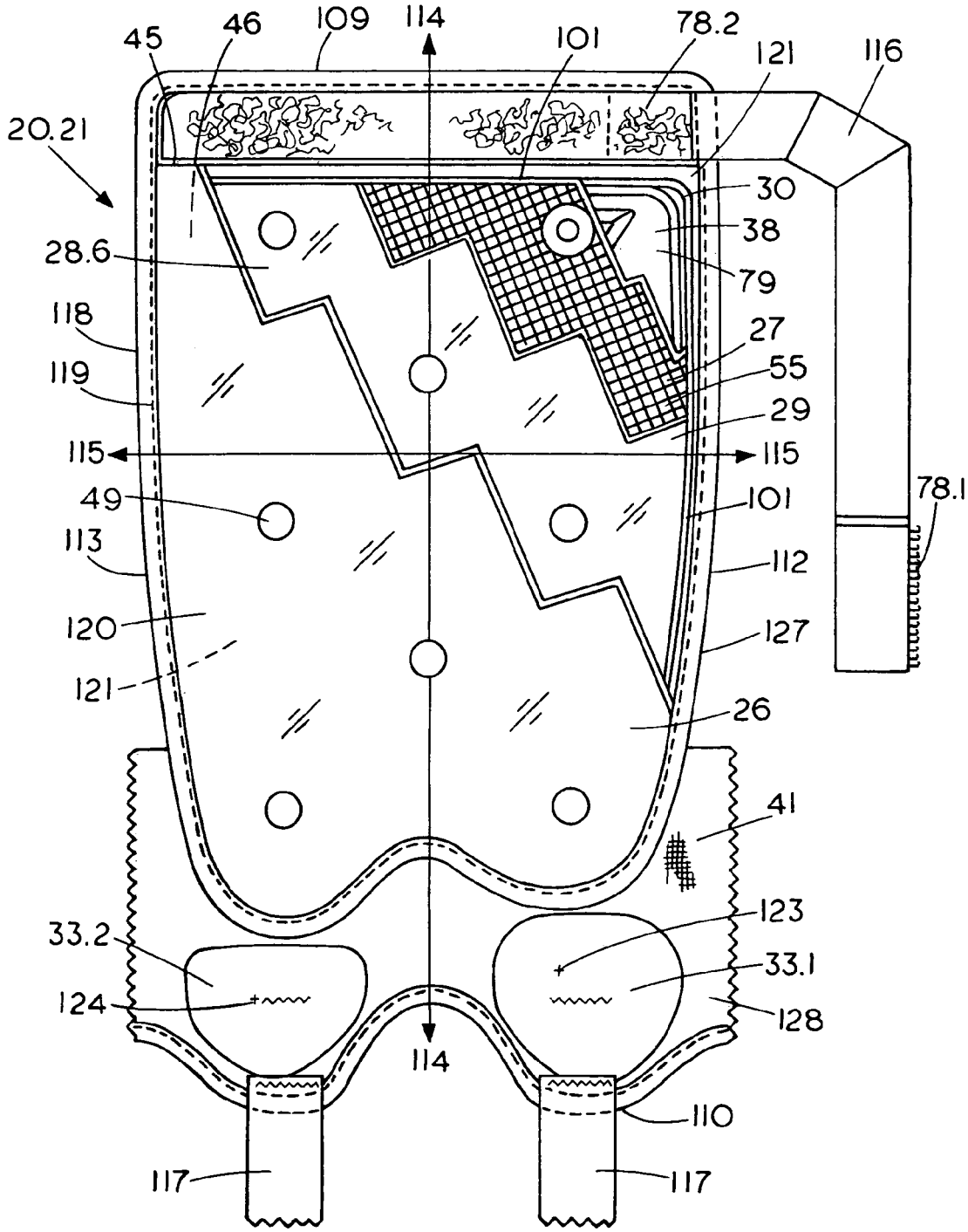
FIG. 45 is an anterior plan view of a shin guard with parts broken away to show the use of a foam material inside of a bladder containing light cure material that is located within a pocket of the shin guard.

FIG. 45 is an anterior plan view of a shin guard 20.21 with parts broken away to show the use of a foam material 38 inside of a bladder 28.6. The bladder 28.6 contains light cure material 37 and a textile material 41 impregnated with light cure material 27 thereby forming an impregnated textile material 55. The bladder 28.6 is shown located within a pocket 46 of the shin guard 20.21.

Figure 46:
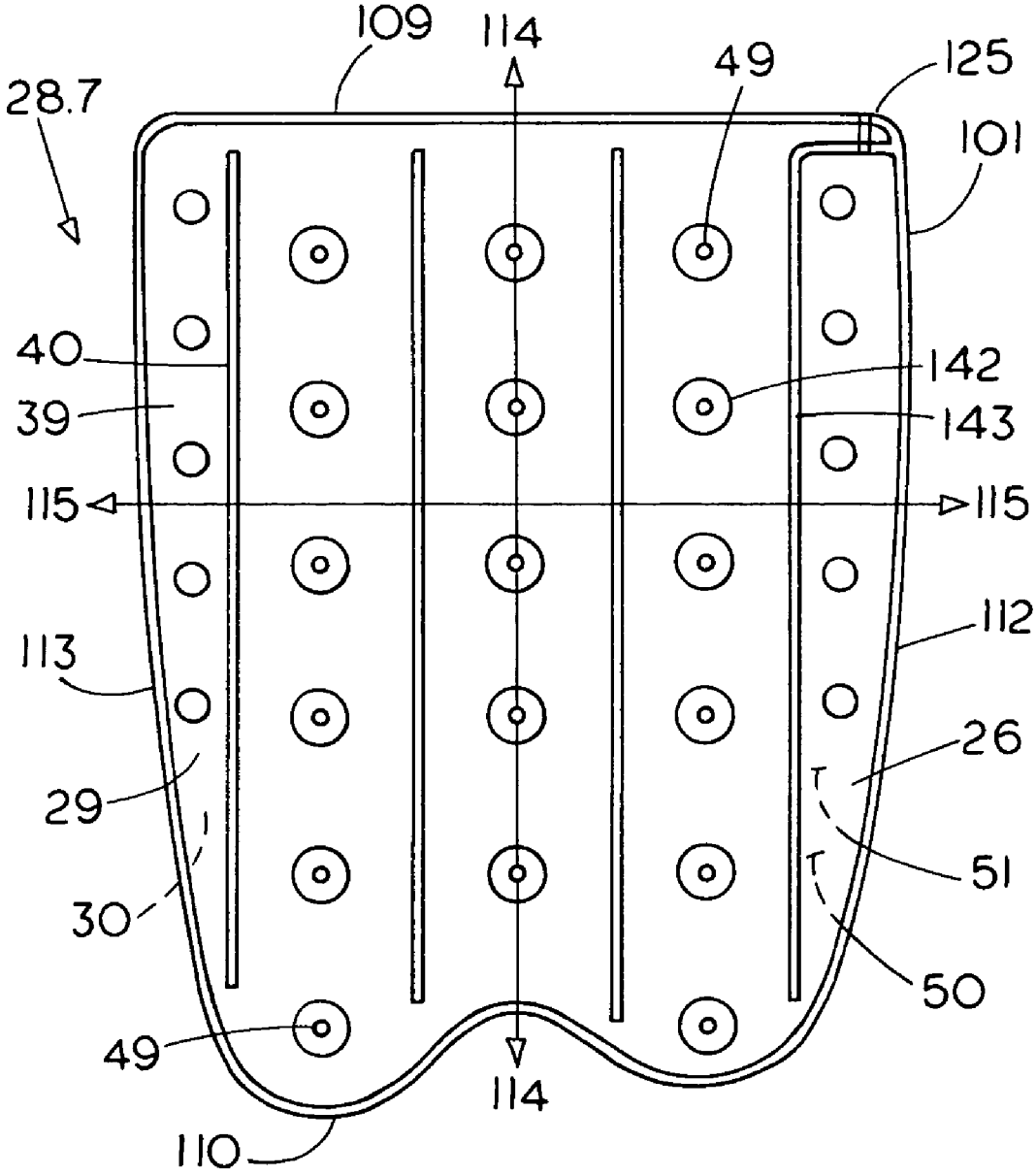
FIG. 46 is an anterior plan view of a fluid filled bladder for use with a shin guard generally similar to that shown in FIG. 30 or FIG. 31.

FIG. 46 is an anterior plan view of a fluid filled bladder 28.7 for use with a shin guard 20.13 or 20.14 generally similar to those shown in FIG. 30 or FIG. 31. The fluid filled bladder 28.7 can be filled with ambient air pressurized at atmospheric pressure, or alternatively, can be pressurized above atmospheric pressure. Alternatively, the fluid filled bladder 28.7 can include a select captive gas such a nitrogen, or a fluid in a liquid or viscous state. Again, gas filled bladders taught by Marion F. Rudy and licensed to Nike, Inc. include U.S. Pat. No. 5,543,194, U.S. Pat. No. 5,083,361, U.S. Pat. No. 5,042,176, U.S. Pat. No. 4,936,029, U.S. Pat. No. 4,906,502, U.S. Pat. No. 4,340,626, U.S. Pat. No. 4,287,250, U.S. Pat. No. 4,271,606, U.S. Pat. No. 4,219,945, and U.S. Pat. No. 4,183,156, all of these patents hereby being incorporated by reference herein. Other patents relating to plastic film for use in fluid filled bladders or the structure of fluid filled bladders assigned or licensed to Nike, Inc. include U.S. Pat. No. 5,592,706, U.S. Pat. No. 5,626,657, U.S. Pat. No. 5,755,001, U.S. Pat. No. 5,802,739, U.S. Pat. No. 5,832,630, U.S. Pat. No. 5,979,078, U.S. Pat. No. 5,993,585, U.S. Pat. No. 6,020,055, U.S. Pat. No. 6,082,025, U.S. Pat. No. 6,119,371, U.S. Pat. No. 6,127,026, U.S. Pat. No. 6,258,421, U.S. Pat. No. 6,321,465, U.S. Pat. No. 6,571,490, U.S. Pat. No. 6,457,262, U.S. Pat. No. 6,385,864, U.S. Pat. No. 6,374,514, U.S. Pat. No. 6,402,879, and U.S. Pat. No. 6,430,843, all of these patents hereby being incorporated by reference herein. Gas filled bladders or other cushioning mediums granted to Martyn Shorten and/or Joseph Skaja include U.S. Pat. No. 5,572,804, U.S. Pat. No. 5,976,451, and U.S. Pat. No. 6,029,962, all of these patents hereby being incorporated by reference herein. Gas filled bladders or pads taught by Byron Donzis include U.S. Pat. No. 5,235,715, U.S. Pat. No. 4,874,640, U.S. Pat. No. 4,513,449, U.S. Pat. No. 4,486,901, U.S. Pat. No. 4,453,271, U.S. Pat. No. 4,441,211, U.S. Pat. No. 4,370,754, and U.S. Pat. No. 4,217,705, all of these patents hereby being incorporated by reference herein. Teachings related to athletic equipment by J. C. Wingo include U.S. Pat. No. 5,036,761, U.S. Pat. No. 5,035,009, U.S. Pat. No. 5,029,341, U.S. Pat. No. 4,985,931, U.S. Pat. No. 4,926,503, and U.S. Pat. No. 4,872,216, all of these patents hereby being incorporated by reference herein.

Figure 47:
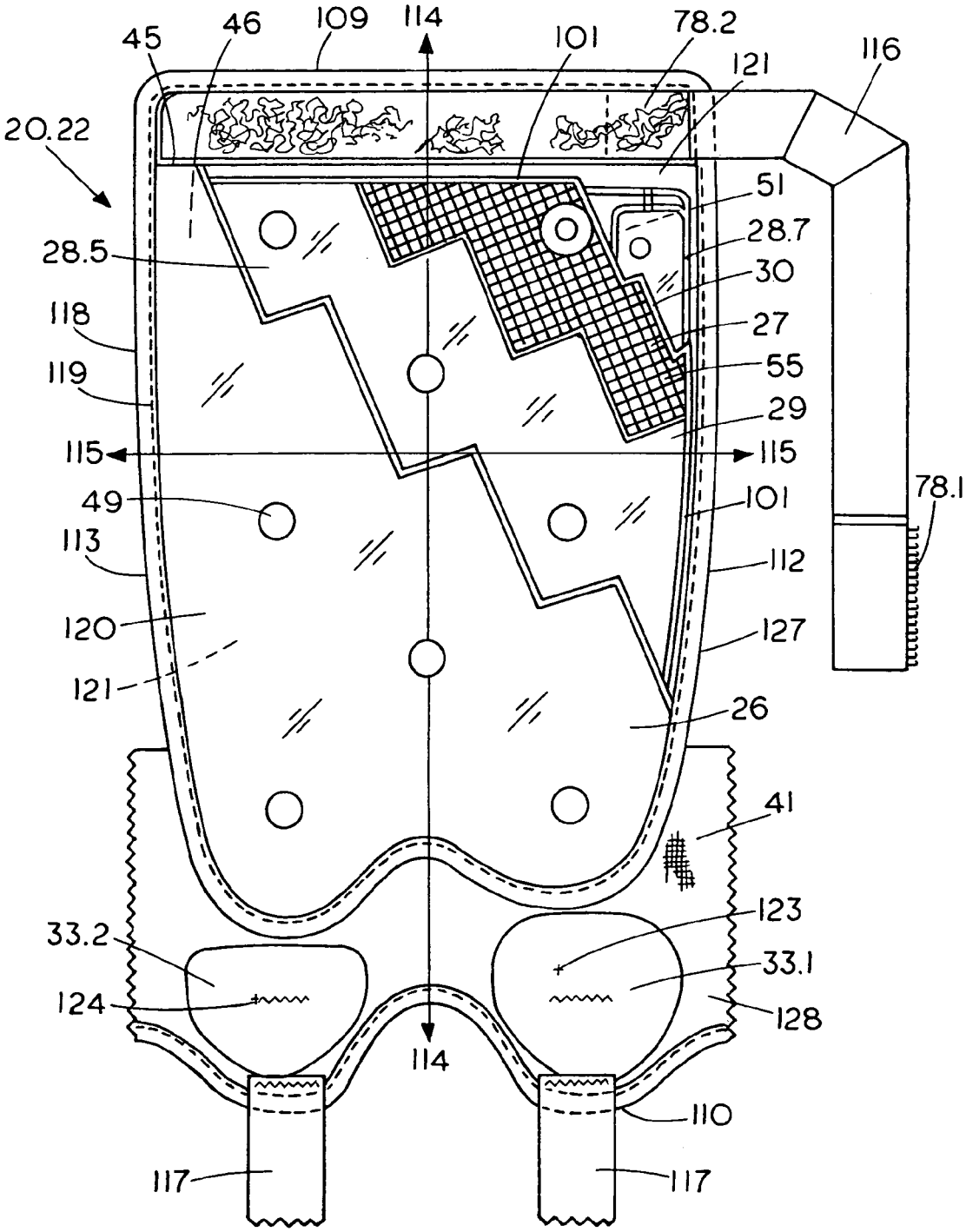
FIG. 47 is an anterior plan view of a shin guard with parts broken away to show the use of a fluid filled bladder posterior of a bladder containing light cure material that is located within a pocket of the shin guard.

FIG. 47 is an anterior plan view of a shin guard 20.22 with parts broken away to show the use of a fluid filled bladder 28.7 posterior of a bladder 28.5. The bladder 28.5 contains light cure material 37 and a textile material 41 impregnated with light cure material 27 thereby forming an impregnated textile material 55. The bladder 28.5 and also bladder 28.7 are shown located within a pocket 46 of the shin guard 20.22.

Figure 48:
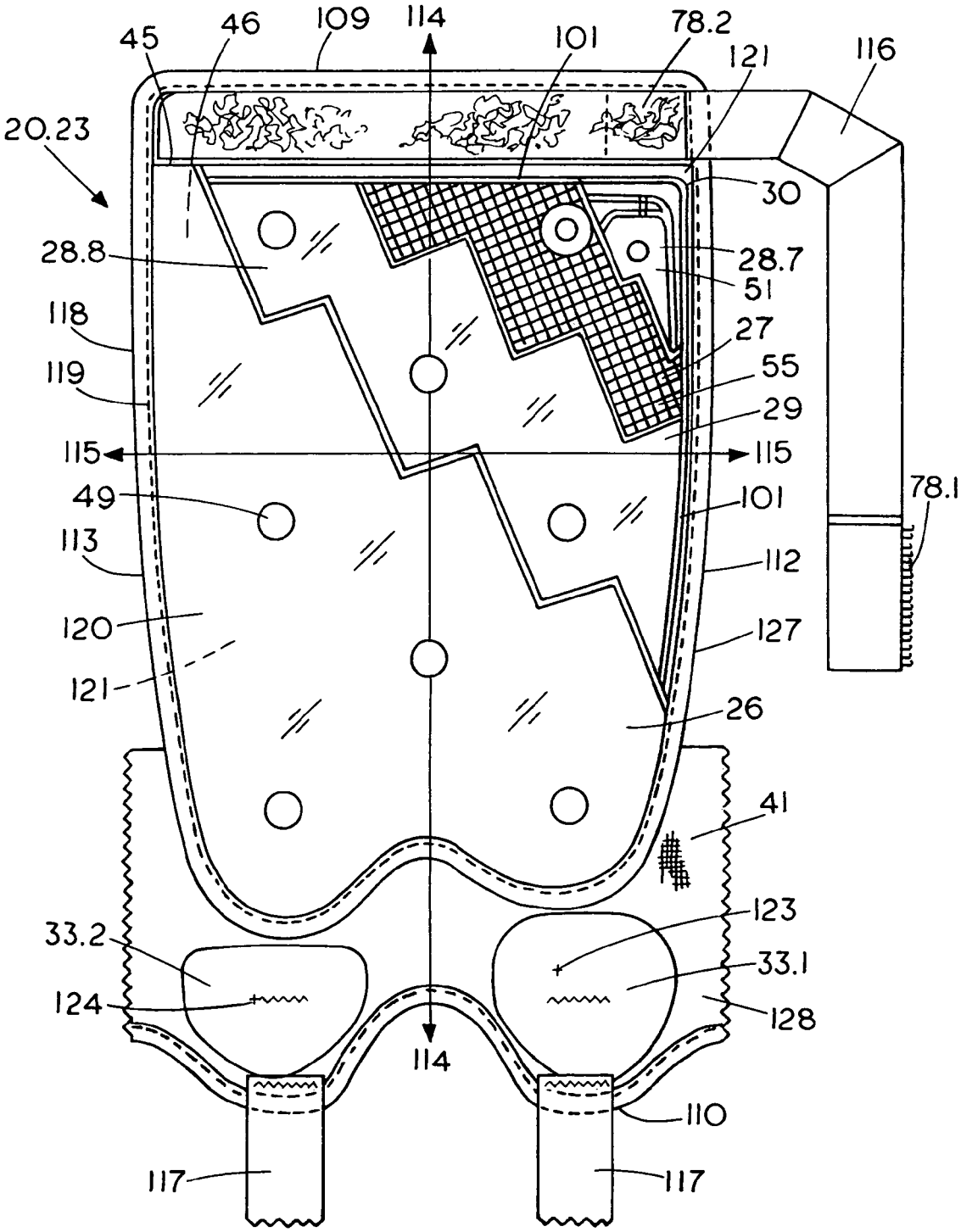
FIG. 48 is an anterior plan view of a shin guard with parts broken away to show the use of a fluid filled bladder inside of a bladder containing light cure material that is located within a pocket of the shin guard.

FIG. 48 is an anterior plan view of a shin guard 20.23 with parts broken away to show the use of a fluid filled bladder 28.7 inside of a bladder 28.8 containing a light cure material 27 and a textile material 41 impregnated with light cure material 27 thereby forming an impregnated textile material 55. The bladder 28.8 including bladder 28.7 are shown located within a pocket 46 of the shin guard 20.23.

Figure 49:
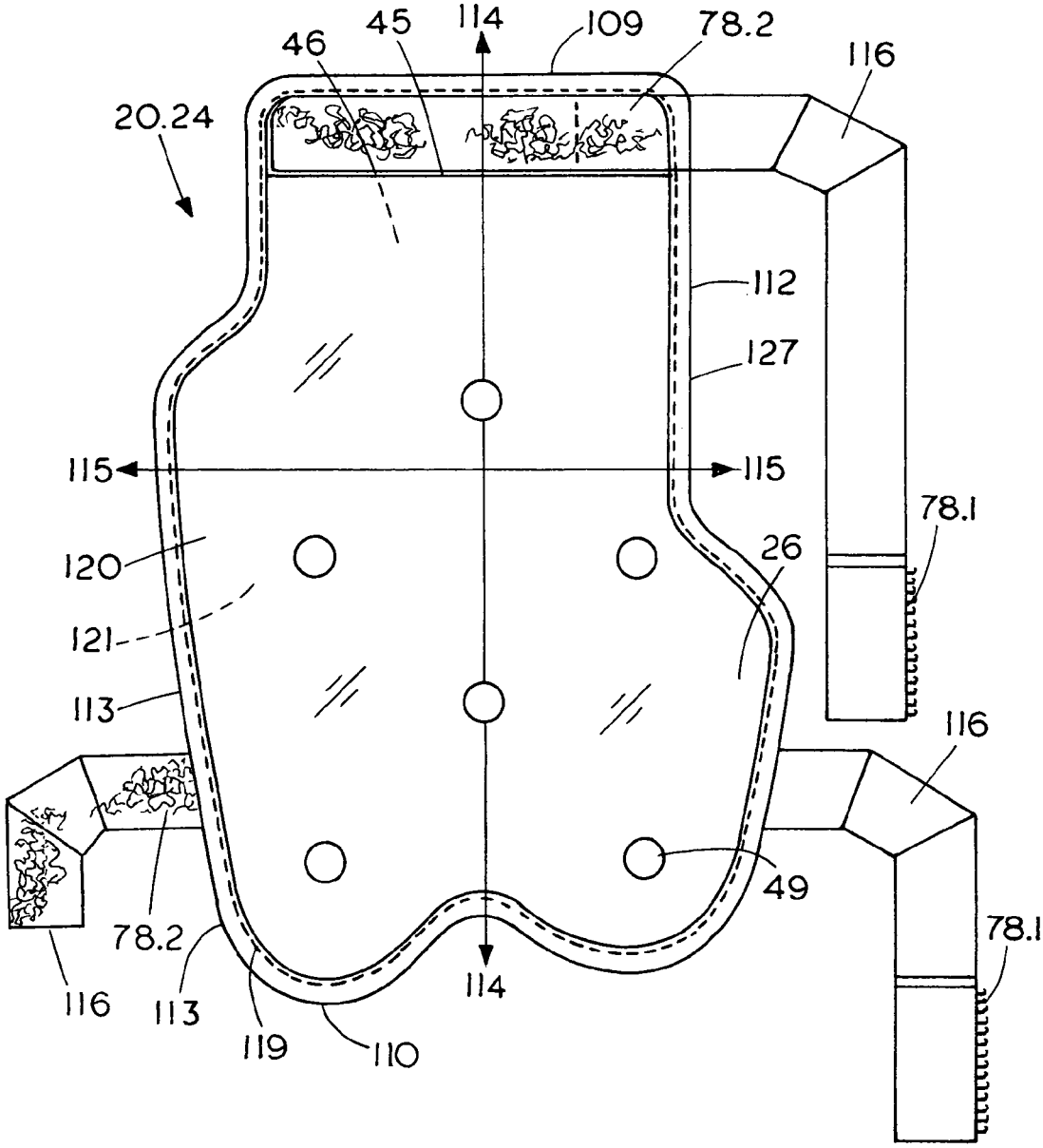
FIG. 49 is an anterior plan view of a shin guard including straps and having an asymmetrical shape near both the superior side and the inferior side as between the medial side and lateral side.

FIG. 49 is an anterior plan view of a shin guard 20.24 including a superior guard 127 portion and straps 116. The shin guard 20.24 has an asymmetrical shape near both the superior side 109 and inferior side 110 as between the medial side 112 and lateral side 113. The asymmetrical shape shown near the superior side 109 as between the medial side 112 and lateral side 113 can possibly enhance accommodation for a wearer's calf muscles, whereas the asymmetrical shape shown near the inferior side 110 as between the medial side 112 and lateral side 113 can possibly enhance accommodation for a wearer's malleoli.

Figure 50:
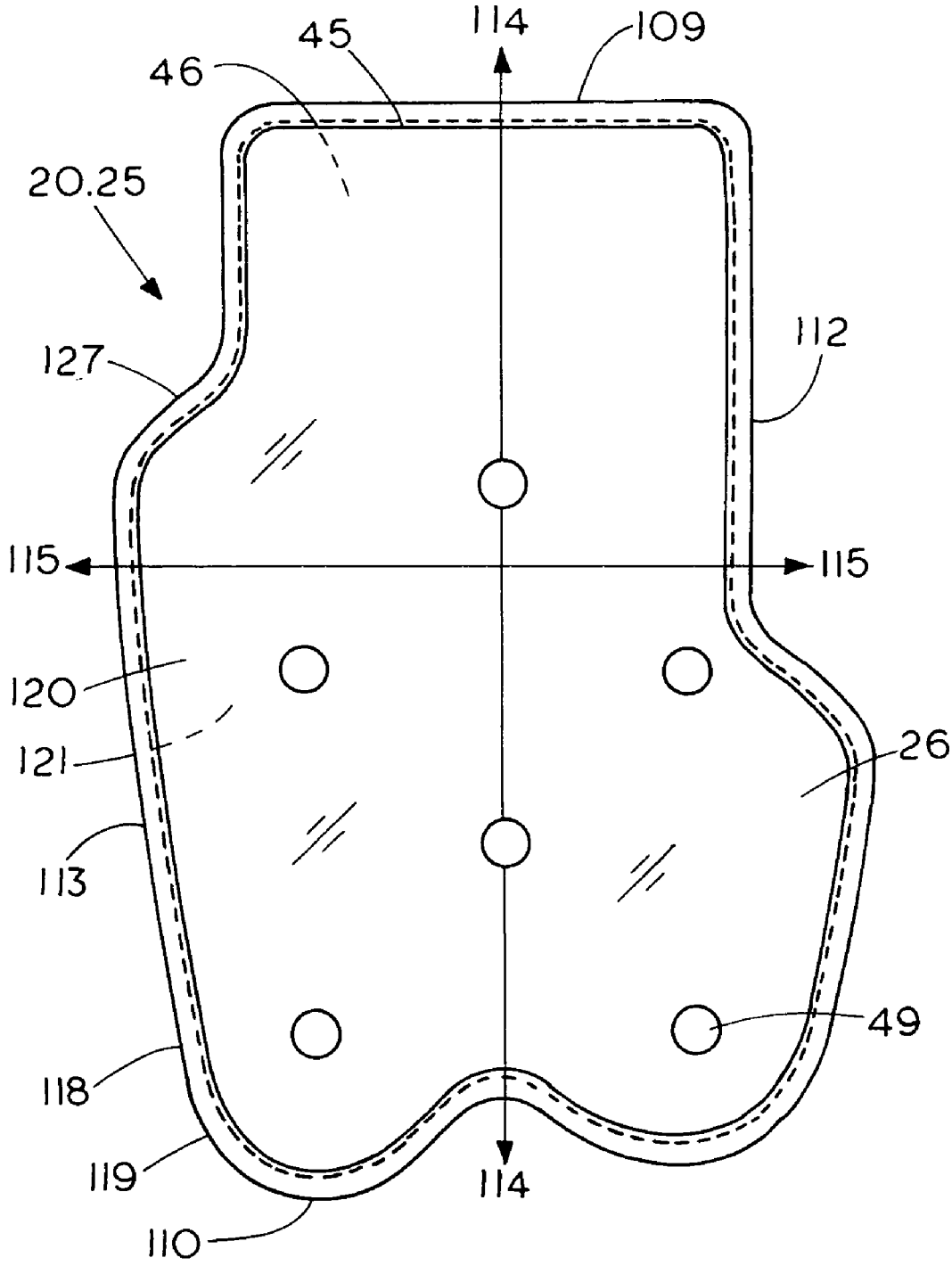
FIG. 50 is an anterior plan view of a shin guard generally similar to that shown in FIG. 49 having an asymmetrical shape near both the superior side and the inferior side as between the medial side and lateral side, but not including straps.

FIG. 50 is an anterior plan view of a shin guard 20.25 generally similar to that shown in FIG. 49 having an asymmetrical shape near both the superior side 109 and inferior side 110 as between the medial side 112 and lateral side 113, but not including straps 116. Again, the asymmetrical shape shown near the superior side 109 as between the medial side 112 and lateral side 113 can possibly enhance accommodation for a wearer's calf muscles, whereas the asymmetrical shape shown near the inferior side 110 as between the medial side 112 and lateral side 113 can possibly enhance accommodation for a wearer's malleoli.

Figure 51:
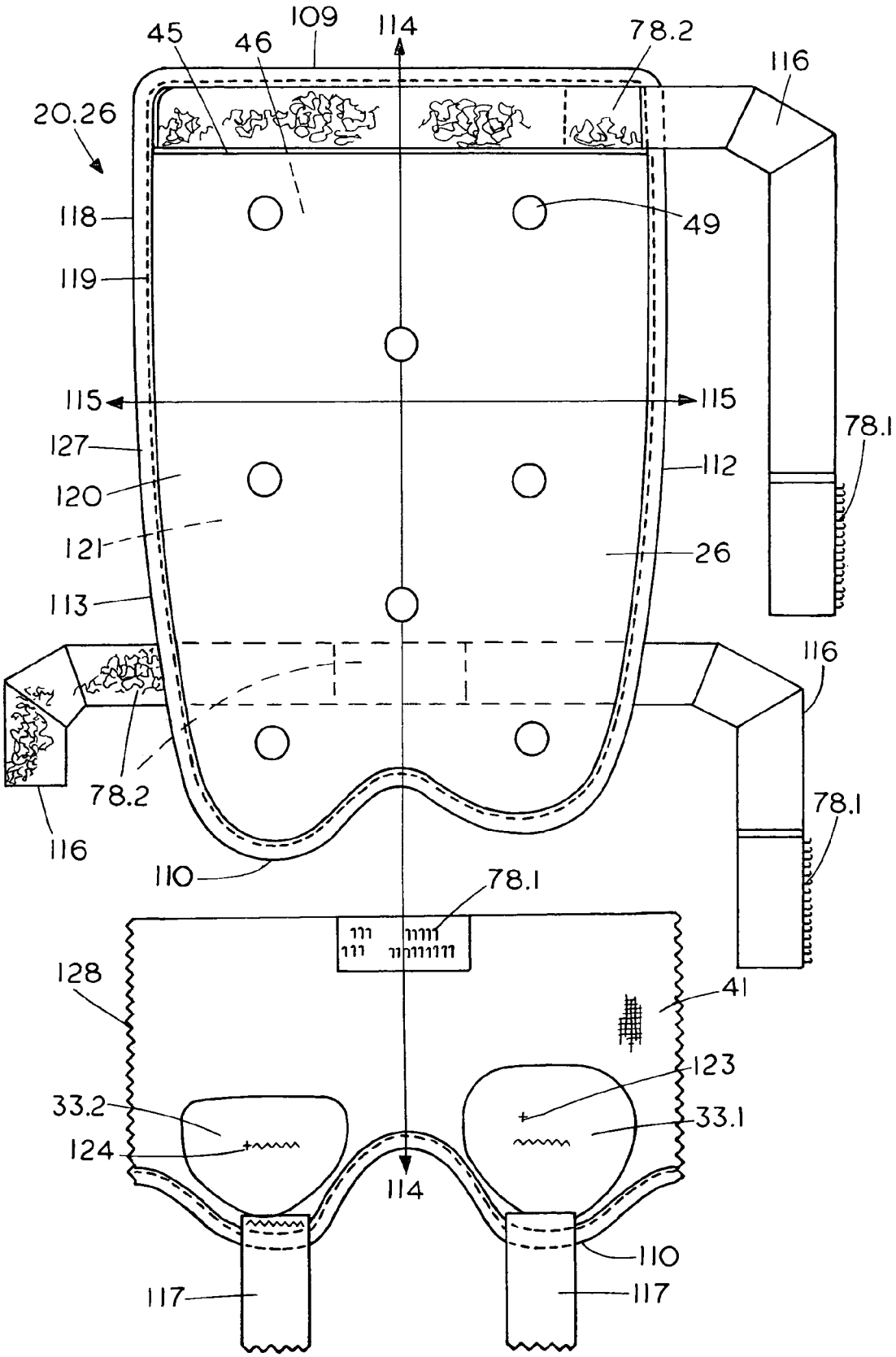
FIG. 51 is an exploded anterior plan view of a shin guard having a superior guard portion generally similar to that shown in FIG. 31, but including an inferior guard portion which can be selectively removed and replaced.

FIG. 51 is an exploded anterior plan view of a shin guard 20.26 having a superior guard 127 portion generally similar to that shown in FIG. 31 having an asymmetrical shape near the inferior side 110, and also an inferior guard 128 portion which can be selectively removed and repleced. This can facilitate washing of the inferior guard portion 128 which can include a textile material 41. This embodiment can also facilitate adjustment of the spacing and relative position between the superior guard 127 portion and inferior guard 128 portion for better accommodating the fit provided to an individual wearer, and also replacement of either portion of the shin guard 20.26.

Figure 52:
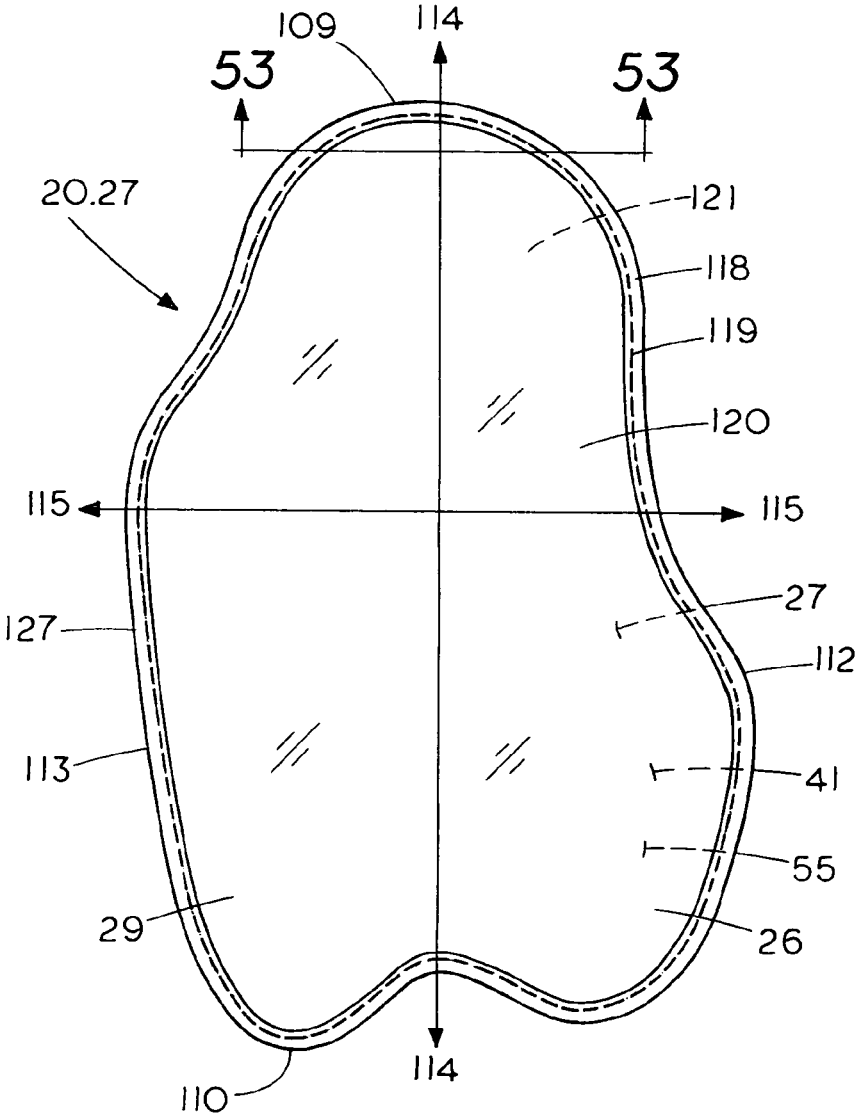
FIG. 52 is an anterior plan view of a shin guard having an asymmetrical shape near both the superior side and the inferior side as between the medial side and lateral side that does not include straps.

FIG. 52 is an anterior plan view of a shin guard 20.27 having an asymmetrical shape near both the superior side 109 and the inferior side 110 as between the medial side 112 and lateral side 113, and that does not include straps. Again, the asymmetrical shape shown near the superior side 109 as between the medial side 112 and lateral side 113 can possibly enhance accommodation for a wearer's calf muscles, whereas the asymmetrical shape shown near the inferior side 110 as between the medial side 112 and lateral side 113 can possibly enhance accommodation for a wearer's medial malleolus 123 and lateral malleolus 124.

Figure 53:
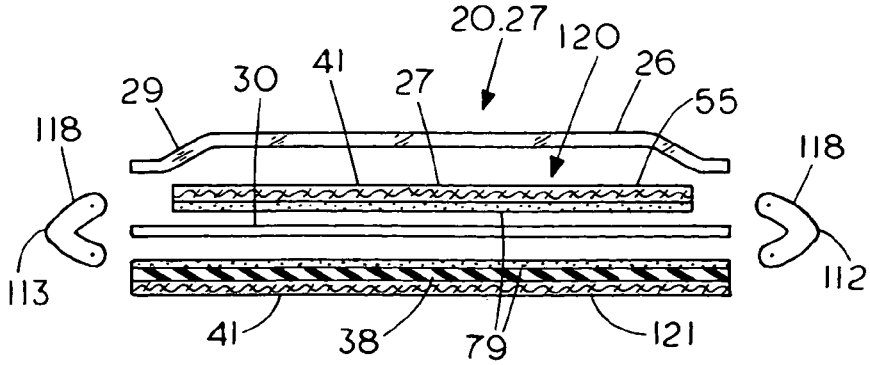
FIG. 53 is a cross-sectional and exploded view of one possible embodiment of the shin guard shown in FIG. 52.

FIG. 53 is a cross-sectional and exploded view of the shin guard 20.27 shown in FIG. 52. Shown is an outer layer 29 and an inner layer 30 of a bladder 28 which can be made of thermoplastic film 26 and sealed by radio frequency welding. A textile material 41 such as woven fiberglass having a thin double sided self-adhesive surface 79 such as double sided tape or a double sided foam tape affixed to a portion of its posteriormost side 121 can be affixed in registered position upon the inner layer 30 of film 26, and then the outer layer 29 of film 26 can be placed in registered position and the bladder 28 nearly completely sealed using radio frequency welding. A suitable amount of light cure material 27 sufficient to saturate a textile material 41, such as a woven or non-woven fiberglass material, can then be inserted into the bladder 28, thereby creating an impregnated textile material 55, and the bladder 28 can then be completely sealed. Alternatively, an impregnated textile material 55 such as a "prepreg" fiberglass material can simply be sealed within a bladder 28. Also shown in FIG. 53 is a textile material 41 which is affixed in functional relation to a foam material 38. The foam material 38 can include a self-adhesive surface 79 on its anteriormost side for affixing to the posteriormost side of the inner layer 30 of the bladder 28. Also shown on the medial side 112 and lateral side 113 is edge trim 118 which can be affixed by stitches 119, adhesives, welding, or other conventional means. When stitches 119 are used to affix the edge trim 118 they are so located as to pass through a portion of the film 26 that is not in communication with the interior of the bladder 28.

Figure 54:
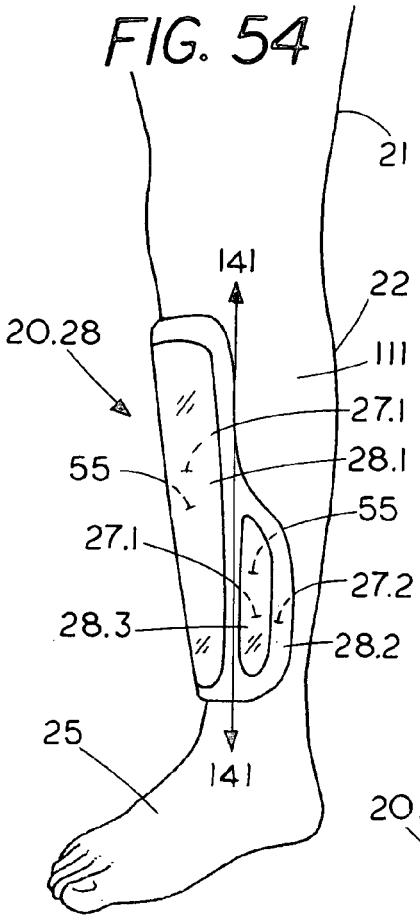
FIG. 54 is a perspective medial side view of a shin guard on a wearer showing the use of several bladders containing different light cure materials.

FIG. 54 is a perspective medial side view of a shin guard 20.28 somewhat similar to that shown in FIG. 6 on a wearer 21 showing the use of several bladders 28.1, 28.2, and 28.3 containing different light cure materials 27.1 and 27.2. Bladders 28.1, 28.2, and 28.3 can be formed individually, or alternatively, can be formed in a single unit having three different chambers as shown. A textile material 41 saturated with a light cure material 27.1 thereby forming an impregnated textile material 55 can be contained in bladders 28.1 and 28.3. The light cure material 27.1 used in bladders 28.1 and 28.3 can set and cure to form a relatively rigid material having a hardness equal to or greater than 75 Shore A. In contrast, the light cure material 27.2 used in bladder 28.2 can set and cure to form a relatively flexible material having a hardness less than 75 Shore A. Accordingly, a line of flexion 141 can be created as between bladders 28.1 and 28.3 due to the presence of a portion of bladder 28.2 therebetween that includes a relatively flexible light cure material 27.2. This can accommodate for flexion of a wearer's calf muscles 111 on the medial side 112, and also enhance the proper fit and retention of a shin guard 20.28 upon a wearer.

Figure 55:
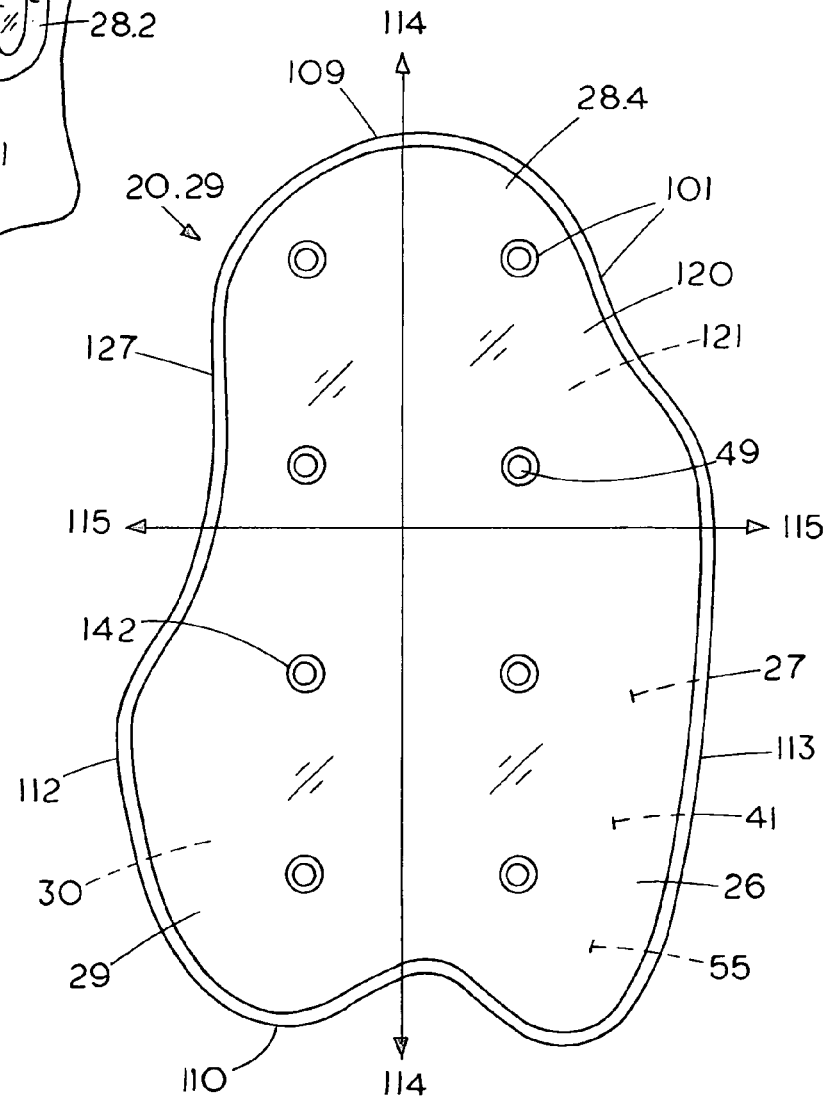
FIG. 55 is an anterior plan view of a shin guard including a fluid filled bladder on the posterior side and having an asymmetrical shape near both the superior side and the inferior side as between the medial side and lateral side.

FIG. 55 is an anterior plan view of a shin guard 20.29 having an asymmetrical shape near both the superior side 109 and the inferior side 110 as between the medial side 112 and lateral side 113. Again, the asymmetrical shape shown near the superior side 109 as between the medial side 112 and lateral side 113 can possibly enhance accommodation for a wearer's calf muscles, whereas the asymmetrical shape shown near the inferior side 110 as between the medial side 112 and lateral side 113 can possibly enhance accommodation for a wearer's medial malleolus 123 and lateral malleolus 124. The anterior side 120 of the anteriormost bladder 28.9 is made of a substantially transparent plastic film 26. Accordingly, the contents of bladder 28.9 can be visible from the anterior side 120, and the light cure material 27 can be caused to cure when exposed to light having a wavelength between 280 and 780 nanometers. The bladder 28.9 can simply contain a light cure material 27. Alternatively, the bladder 28.9 can include a light cure material 27 in combination with a textile material 41, thus forming an impregnated textile material 55, and/or the light cure material 27 can further include a fiber filler material 145 such as glass fiber.

Figure 56:
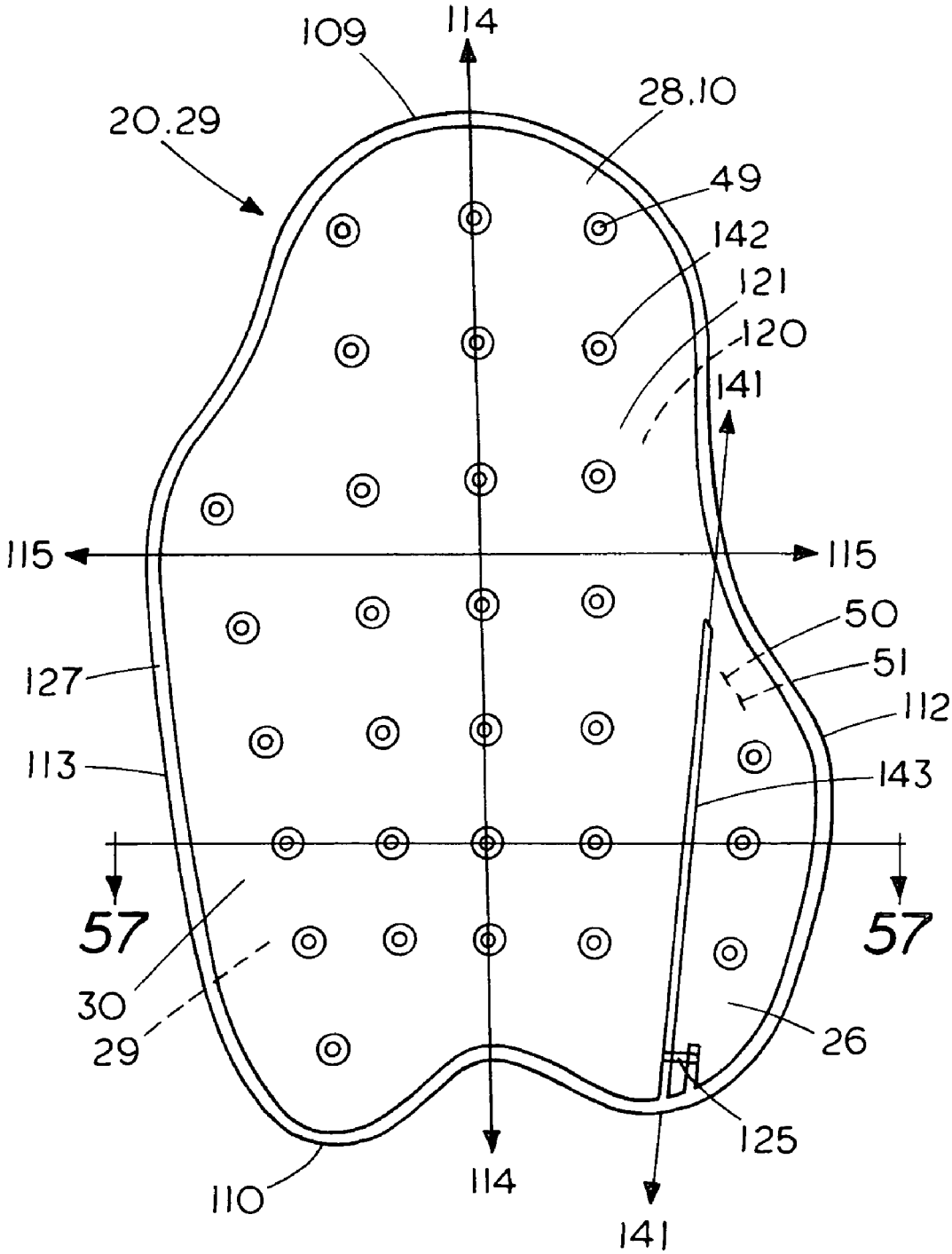
FIG. 56 is a posterior plan view of the shin guard including a fluid filled bladder shown in FIG. 55.

FIG. 56 is a posterior plan view of the shin guard including a fluid filled bladder shown in FIG. 55. The shin guard 20.29 can include a fluid filled bladder 28.10 on the posterior side 121 that includes a void 50 including a gas 51. The gas can be pressured at atmospheric pressure, or above atmospheric pressure. As shown, the fluid filled bladder 28.10 can include a weld 101 about the perimeter, but also a plurality of weld dots 142 and/or a weld line 143. The position of the weld dots 142 and/or weld line 143 can create a line of flexion 141. Further, the weld dots 142 can include an opening 49 therein for facilitating ventilation.

Figure 57:
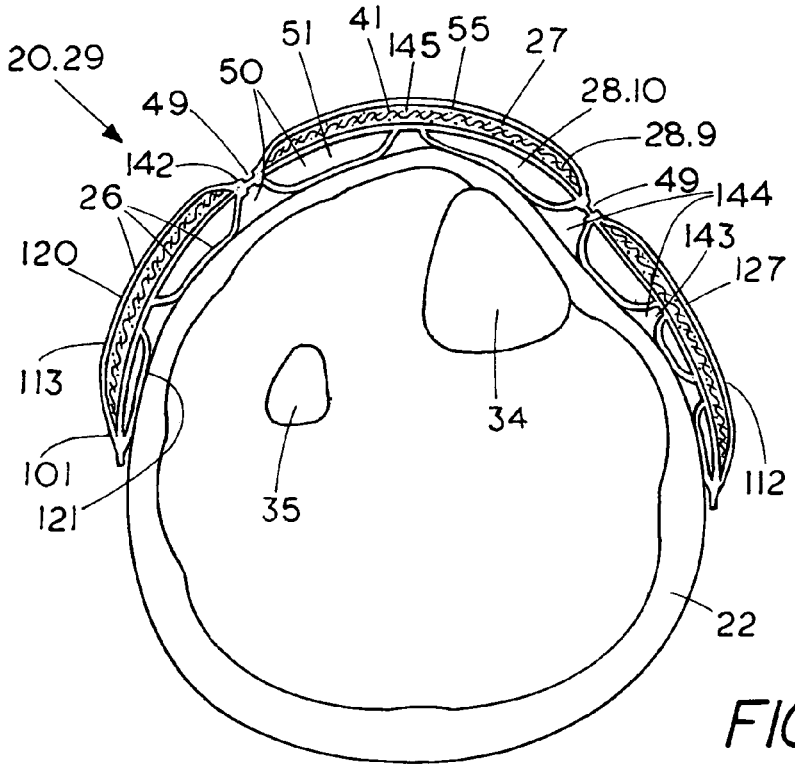
FIG. 57 is a transverse cross-sectional view of the shin guard including a fluid filled bladder shown in FIGS. 55 and 56, taken along line 57—57, and shown in position on a wearer's lower leg.

FIG. 57 is a transverse cross-sectional view of the shin guard 20.29 shown in FIGS. 55 and 56, taken along line 57—57 in FIG. 56. The shin guard 20.29 is shown in position on a wearer's lower leg 22. The wearer's lower leg 22 is shown in a transverse cross-sectional view generally similar to that shown in FIG. 3. As shown, the shin guard 20.29 can be made of three layers of plastic film 26 that are affixed together by conventional means such a radio frequency welding. This can sometimes be done in a single operation, or alternatively, the posteriormost and middle layer of plastic film can be affixed together first, and then the anteriormost layer of plastic film can be subsequently affixed. Again, the anteriormost bladder 28.9 can include a textile material 41 such as a woven, non-woven, or knitted fiberglass textile material which is impregnated with a light cure material 27 to form an impregnated textile material 55 and/or a fiber filler material 145 such as glass fiber, whereas the posteriormost fluid filled bladder 28.10 can include a void 50 containing a gas 51. Accordingly, when the light cure material 27 is caused to set and cure the shin guard 20.29 can provide a relatively hard medium for resisting impact events and point loads imparted to the anterior side 120, but at the same time provide a relatively soft cushioning medium capable of deflection and dampening on the posterior side 121. Moreover, as shown, the plurality of weld dots 142 and weld line 143 can also create voids 50 between the shin guard 20.29 and the wearer's 21 lower leg 22. The design and pattern of the weld dots 142 including openings 49 for ventilation and/or of the weld lines 143 can form generally longitudinal channels or ducts 144 for enhancing ventilation and dissipating both heat and humidity.

Figure 58:
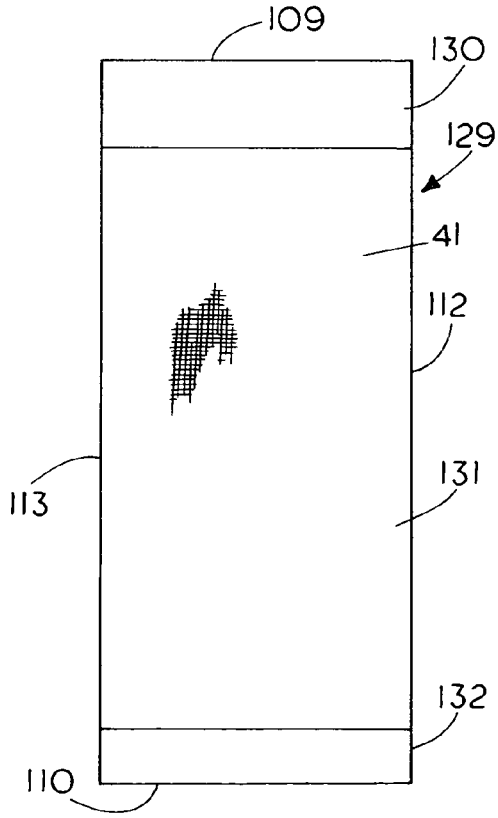
FIG. 58 is an anterior plan view of a sleeve for possible use with embodiments of a shin guard which do not include strap fastening means such as those shown in FIG. 50 and FIG. 52.

FIG. 58 is an anterior plan view of a sleeve 129 having a superior sleeve portion 130, a middle sleeve portion 131 and an inferior sleeve portion 132 for possible use with embodiments of a shin guard which do not include strap 116 fastening means such as shin guard 20.5 and shin guard 20.7 shown in FIGS. 50 and 52. For the purpose of placing a shin guard in the desired position upon a wearer when exposing the shin guard to light to cause the light cure material contained therein to set and cure, it can be advantageous for the sleeve 129 to be made of a white, translucent, or transparent textile material. In this regard, the use of fine knitted synthetic textile fibers that will not substantially block or absorb an ambient or artificial light source generally similar to those used in the manufacture of women's hosiery can be advantageous for use. It can be advantageous for the hosiery to be of the so-called "support" or sport variety hosiery as such commonly includes Lycra® or other elastic materials which exert sufficient tension when elongated as to secure the shin guard upon a wearer's leg. In particular, a sleeve 129 consisting of white knit support hosiery made by the Mayer/Berkshire Corporation of Wayne, N.J. can be advantageous for use. Alternatively, a textile material that permits substantial transmission of light such as those fabrics used in "tan-thru" swim suits made by SOLAR® Tan Thru Suits of Tampa, Fla. can be used.

Figure 59:
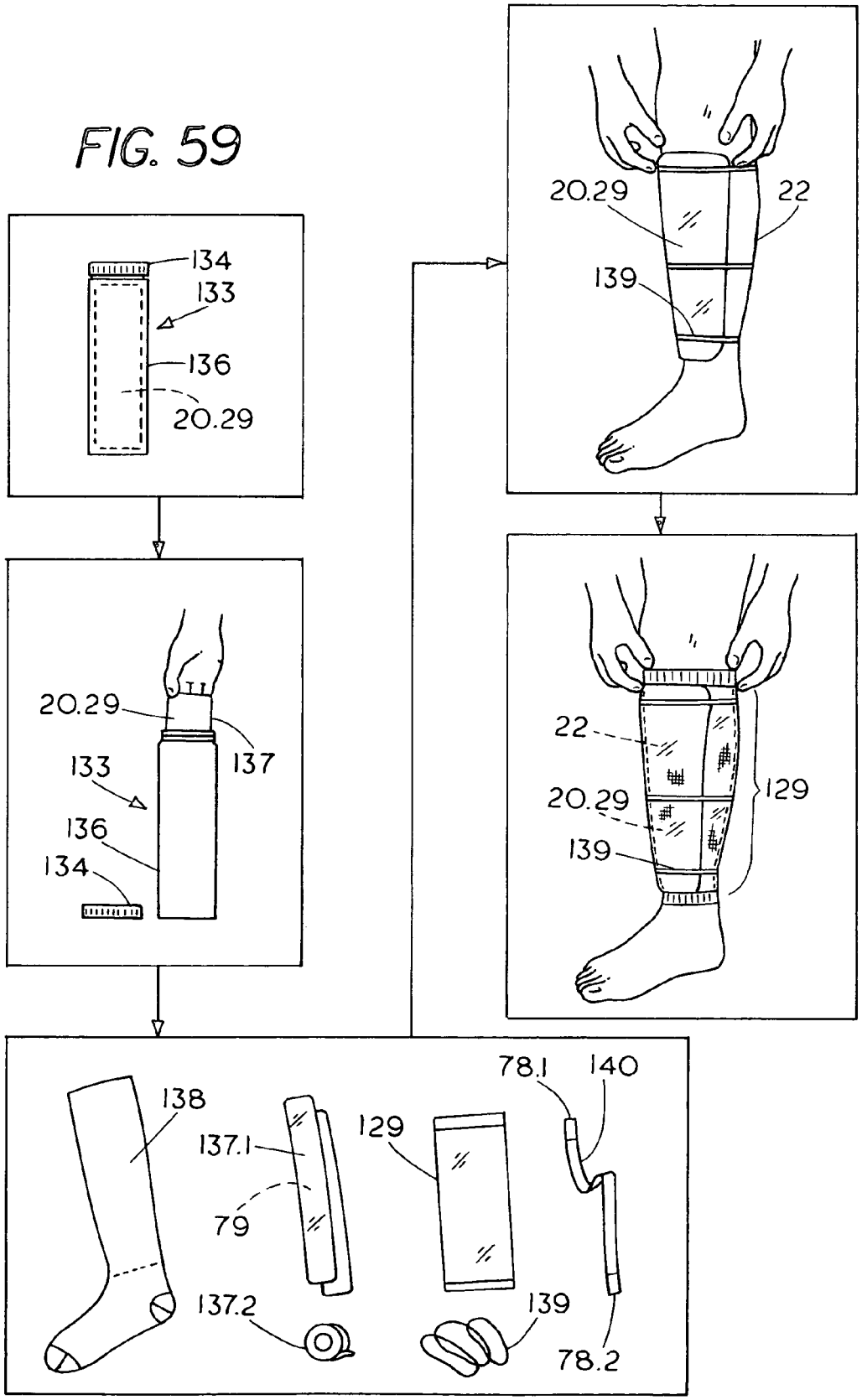
FIG. 59 is a flow diagram that shows at least one method of making a custom fit shin guard upon a wearer.

FIG. 59 is a flow diagram that shows at least one method of making a custom fit shin guard 20.29 upon a wearer. At the top of FIG. 59 in the first box is shown a bottle 133 having a cap 134. The bottle 133 including the cap 134 can be made of a dark colored high density polyethylene plastic and can thereby serve as a light barrier 136 for containing and protecting a shin guard 20.29 from exposure to a source of ultraviolet and/or visible light.

In the second box from the top of FIG. 59, the bottle 133 is shown at the left having been opened and an individual's hand is shown withdrawing the shin guard 20.29.

In the third box from the top of FIG. 59 is shown an athletic sock 138, a sleeve 129, rubber bands 139, a removable strap 140 including VELCRO® X hook and pile, strips of tape 137.1, and also a roll of tape 137.2. Any or all of these items can be used in partial or complete combination by an individual in order to help secure a shin guard 20.29 in functional relation upon a wearer.

In the fourth box from the top of FIG. 59 is shown a wearer applying a shin guard 20.29 to their lower leg 22 using several translucent or substantially transparent rubber bands 139 in order to temporarily hold the shin guard 20.29 in position.

In the fifth box from the top of FIG. 59 is shown a wearer applying a sleeve 129 to their lower leg 32 over a shin guard 20.29. The shin guard 20.29 is being temporarily held in place using several translucent or substantially transparent rubber bands 139 in order to hold the shin guard 20.29 in position.

Figure 60:
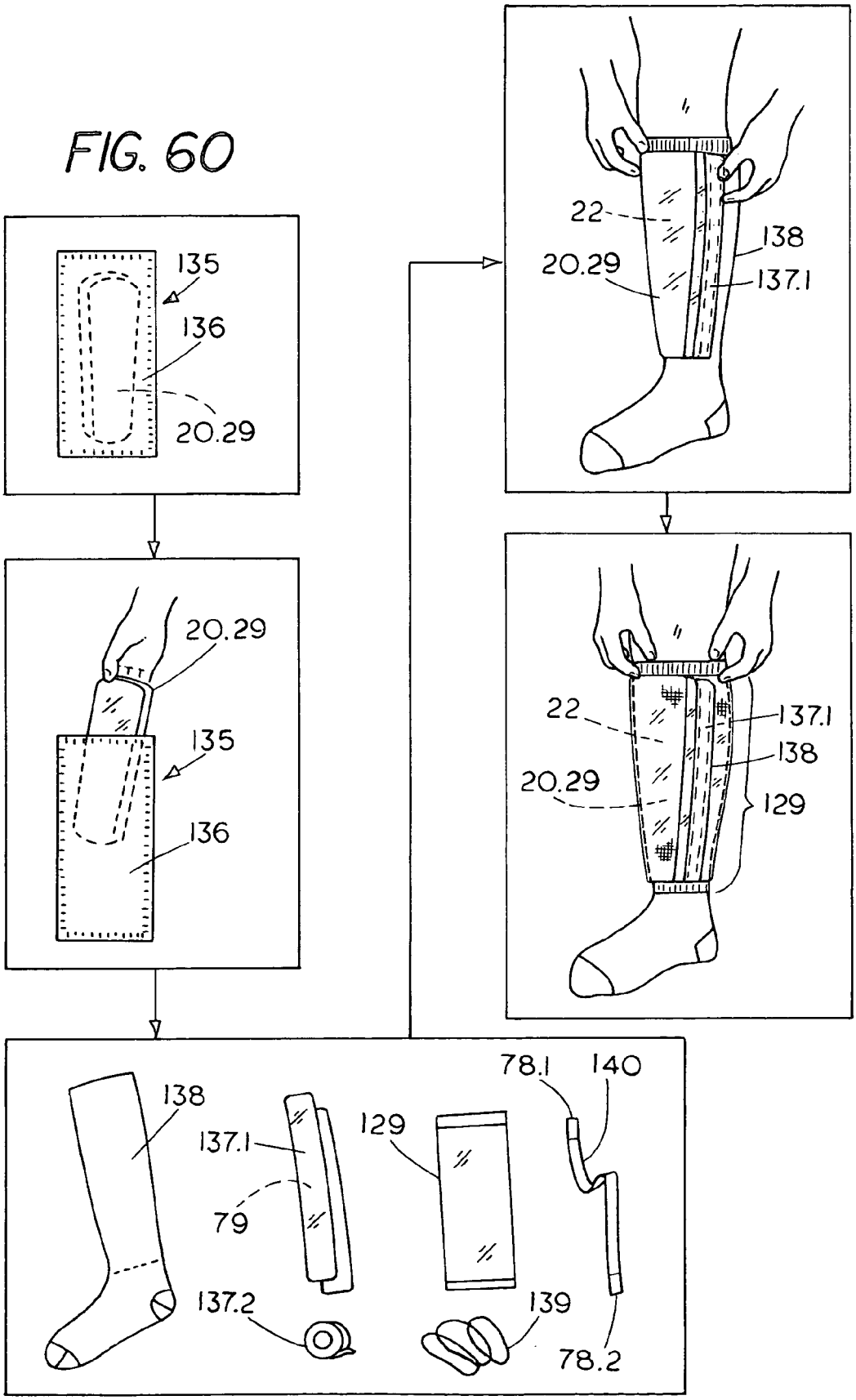
FIG. 60 is another flow diagram that shows at least one method of making a custom fit shin guard upon a wearer.

FIG. 60 is another flow diagram that shows at least one method of making a custom fit shin guard 20.29 upon a wearer 21. At the top of FIG. 60 in the first box is shown the alternate use of a bag 135 which serves as a light barrier 136 for containing and protecting a shin guard 20.29 from exposure to a source of ultraviolet and/or visible light. The bag 135 can include a thermoplastic metallic film such as one including leafing grade aluminum flakes, or the like, in order to create a light barrier 136 generally similar to those known in the packaging industry with respect to food preservation and also the protection of photographic film. In particular, a preferred package can be made using a flexible plastic thin film including metallic foil which is identified as PAKVf56T by IMPAK, Corporation of 2460 East 57th Street, Los Angeles, Calif.

In the second box from the top of FIG. 60, the bag 135 is shown at the right having been opened and an individual's hand is shown withdrawing the shin guard 20.29.

In the third box from the top of FIG. 60 is shown an athletic sock 138, a sleeve 129, rubber bands 139, a removable strap 140 including VELCRO® (M hook and pile, strips of tape 137.1, and also a roll of tape 137.2. Any or all of these items can be used in partial or complete combination by an individual in order to secure a shin guard 20.29 in functional relation upon a wearer.

In the fourth box from the top of FIG. 60 is shown a wearer applying a shin guard 20.29 to their lower leg 22 using several strips of substantially transparent tape 137.1 in order to temporarily affix the shin guard 20.29 in position to the wearer's athletic sock 138.

In the fifth box from the top of FIG. 60 is shown a wearer applying a sleeve 129 to their lower leg 32 over a shin guard 20.29. The shin guard 20.29 is also being temporarily held in place using several strips of substantially transparent tape 137.1 that are affixed to the wearer's athletic sock 138 in order to hold the shin guard 20.29 in position.

Figure 61:
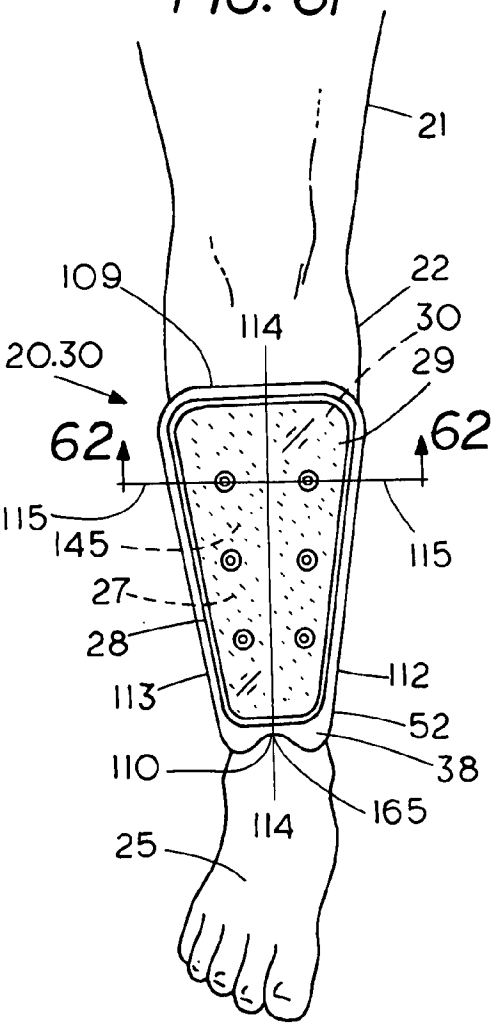
FIG. 61 is a perspective view of a shin guard including a bladder containing a light cure material and a fiber filler positioned on a wearer.

FIG. 61 is a perspective view of a shin guard 20.30 including a bladder 28 containing a light cure material 27 and a fiber filler material 145 positioned on the lower leg 22 of a wearer 21. The bladder 28 can be made using a thermoplastic film 26. The preferred film 26 for a bladder 28 is made of a polyurethane material and can range in thickness between 5–50 mils, depending upon the particular application. Suitable polyurethane films include MP 1880AE and MP 1890 AE having a thickness of 0.02 inches and having a Shore A hardness of 80–90, which are made by Deerfield Urethane, Inc. of Deerfield, Mass. However, other thermoplastic film materials can be suitable for use including those taught in the patents assigned to Nike, Inc. previously recited and incorporated by reference in this specification. Accordingly, two or more layers of film 26 can be sealed along any desired mating edges or portions to form a bladder 28 by using radio frequency welding, heat and pressure welding, adhesive, and the like. The bladder 28 can include a plurality of weld dots 142 which can further include a central opening 49 for permitting ventilation. The film 26 associated with bladder 28 can also be formed to a desired more complex three dimensional shape by vacuum molding, or alternatively by blow-molding or other conventional means known in the art. The outer layer 29 of the bladder 28 faces generally opposite the inner layer 30 of the bladder 28, the former being more distant and the latter being closest to the wearer's body. Preferably, at least the outer layer 29 of the bladder 28 is made of a substantially transparent thermoplastic film 26 that permits the transmission of light therethrough.

A light-cure material 27 in a substantially liquid or viscous state can be inserted and contained within the bladder 28 through a passage which can then be closed with a sealing weld. The preferred light cure materials 27 for use are made by San Rafael Coating of 700 Hawthorne Street, #A, Glendale, Calif. In particular, a light cure material made of an acrylated urethane and monomer blend known as SRC A-3, and another light cure material made of an acrylic oligomer and monomer blend epoxy known as SRC A-8 have been developed for use with the present invention. The preferred Ciba visible light photoinitiators for use in the light cure materials 27 include IRGACURE® 184, and in particular, IRGACURE® 784, and suitable Ciba ultraviolet light photoinitiators include IRGACURE® 369, and 819. Filler materials consisting of fine particles or flakes can also be included within a light cure material, and such particulate filler materials can consist of clay, talc, mica, soda lime borosilicate, sodium borosilicate, silica, aluminosilicate, fly ash, perlite, organic or inorganic microspheres, metal, steel, aluminum, titanium, zirconia, ceramics, boron carbide, silicone carbide, silicon nitride, aluminum nitride, and the like. However, the preferred filler materials for use in a light cure material consist of short or long fiber filler materials 145 such as glass fibers, carbon fibers, aramid fibers, or boron fibers, and the like. In particular, the preferred chopped strand glass fibers for use are identified as product type 3075 made by PPG Industries of Shelby, N.C. having a length of approximately 3.2 mm or ⅛ths inch. These glass fibers mix easily with the light cure material and can serve to reinforce and increase the stiffness of the guard or pad after the light cure material has been caused to set and cure.

In the present invention, the addition of a fiber filler material can be used to cause the stiffness and hardness of the mixture consisting of the light cure material and fiber filler material contained in a bladder to increase as desired, that is, after the light cure material has been caused to set and cure. Generally, in order to effect a significant difference in the exhibited physical and mechanical properties of a device of the present invention the volume of fiber filler material used should be at least ten percent of the total volume of the mixture of the light cure material and fiber filler material. However, over-loading the light cure material with fiber filler material such that the latter constitutes over 90 percent of the total volume of the mixture of the light cure material and fiber filler material can result in a decrease in exhibited stiffness and hardness. Accordingly, the use of a fiber filler material in the range between ten and ninty percent of the volume of the mixture consisting of the light cure material and fiber filler material contained within a bladder is normally preferred. The specific proportions of light cure material and fiber filler material which are advantageous for use can vary depending upon the light cure material and fiber filler material being used, and also the particular application.

A guard or pad can be contained in a closed container for storage or shipping such as ajar, box, bag, package or sealed pouch, and the like, that does not substantially permit the transmission of ultraviolet and visible light. Such a container can be said to be substantially impermeable or impenetrable to ultraviolet and visible light. In this regard, a package or sealed pouch including a thin plastic film including metallic foil can be advantageous for use. In particular, the preferred package can be made using a flexible plastic thin film including metallic foil which is identified as PAKVf56T by IMPAK, Corporation of 2460 East 57th Street, Los Angeles, Calif. When the shin guard 20.30 is removed from the package and donned by a wearer 21 exposure to a visible or ultraviolet light source such as sunlight, or alternatively, a suitable man-made light source will cause the light cure material 27 contained within the bladder 28 to cure and form substantially solid matter. The preferred artificial light source for use is a fluorescent lamp made by General Electric and identified as BIAX®F40/30BX/SPX50 which has exceptional brightness and sufficient spectral power in the blue portion of the visible light spectrum.

A bladder including a light cure material and fiber filler material can be used as a guard, and in particular, a shin guard. However, in a preferred embodiment of a shin-guard, the posterior or back side of the bladder 28 portion of the shin guard 20.30 is affixed to a piece of closed cell foam material 38, or alternatively, to a fluid-filled bladder such as one including a gas, which can then serve as a pad 52. Accordingly, the bladder 28 including a light cure material 27 and fiber filler material 145 can be used to create a substantially rigid protective shield or guard having a customized shape and permanent memory with regards to a wearer's anatomy, that is, when the light cure material is exposed to a suitable light source and caused to set and cure, whereas the foam material 38 or fluid filled bladder which is used for the pad 52 portion of the shinguard 20.30 can provide for deflection and attenuation of impact events. The bladder 28 can be secured to the pad 52 with the use of a double sided pressure sensitive self-adhesive material 79. The pressure sensitive adhesive materials preferred for use are hypoallergenic and made by the 3M company of St. Paul, Minn., and identified as medical double coated tapes and transfer adhesives product numbers 1509 and 9889.

Figure 62:
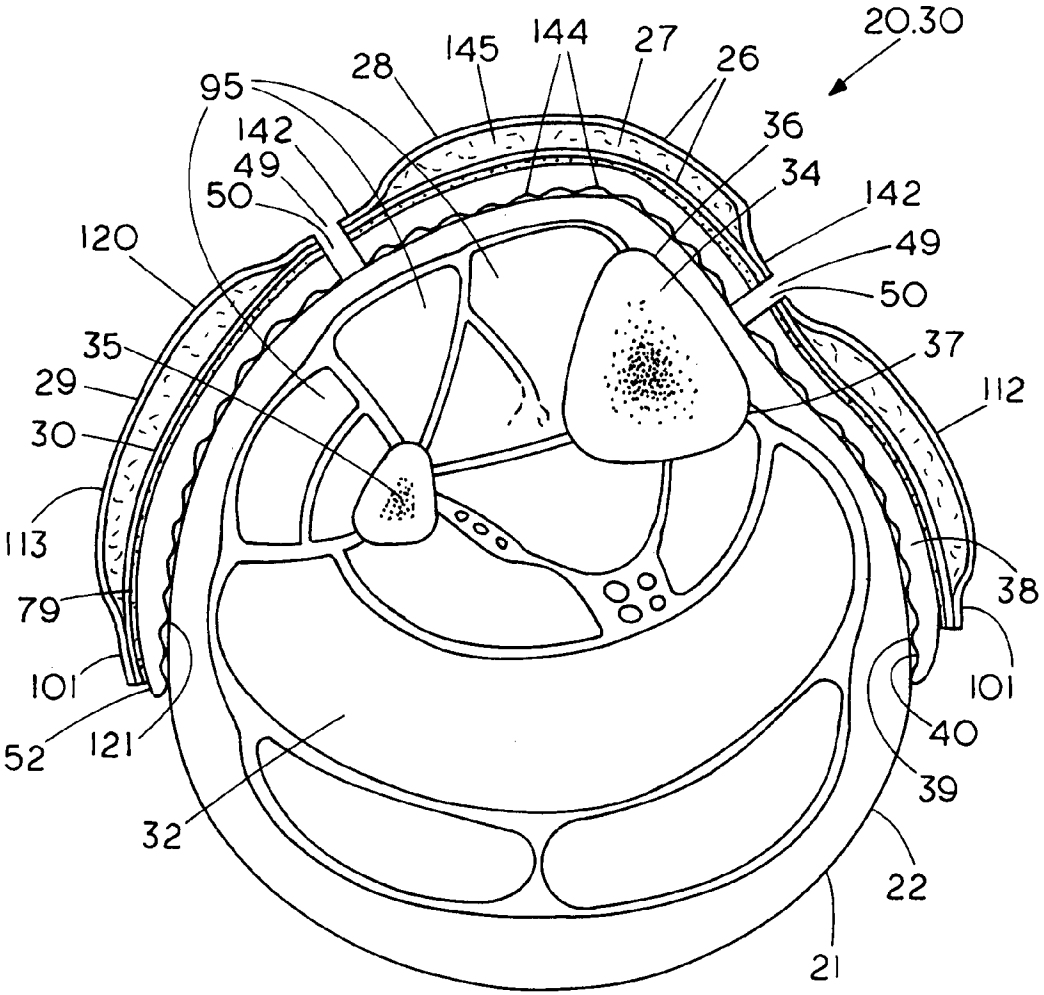
FIG. 62 is a cross-sectional view of the shin guard shown in FIG. 61 taken along line 62—62 and consistent with the transverse axis 115.

The preferred pad 52 for use in the shinguard 20.30 is made of a white closed cell polyethylene foam material 38 having a thickness in the range between ⅛ and ¼ inches. As shown in FIG. 62, the foam material 38 and pad 52 can include a plurality of vertically orientated peaks 39 and valleys 40 on the posterior or back side nearest the wearer's anatomy for the purpose of helping to prevent the shinguard 20.30 from slipping during use and soccer play, but also to provide for ventilation and evaporation of the wearer's sweat and moisture. As shown in FIG. 61, it is generally advantageous and preferred for the pad 52 to extend beyond the superior side 109, medial side 112, lateral side 113, and inferior sides 110 of the bladder 38, as this can prevent the edges of the substantially rigid cured light cure material contained in the bladder 28 portion of the shinguard 20.30 from making contact with the wearer's skin. Moreover, it can be advantageous for the pad 52 to extend more substantially beyond the inferior side 110 of the bladder 38 in order to help maintain the vertical position of the bladder 38 portion above the anterior junction between the wearer's lower leg and foot, and in particular, above the area associated with the tendons of the tibialis anterior, extensor digitorum longus, and extensor hallucis longus muscles which can protrude during flexion and soccer play. Moreover, it can be advantageous that the pad 52 include a relieved area or notch 165 on the inferior side 110 for accommodating the aforementioned anatomical structures, and also to help stabilize and secure the shinguard 20.30 upon a wearer.

FIG. 62 is a cross-sectional view of the shin guard 20.30 shown in FIG. 61 taken along line 62—62 which is also consistent with the transverse axis 115. As first shown in FIG. 3, some portions of the anatomy of the lower leg of a wearer are shown in FIG. 62. Shown in FIG. 62 are the inner layer 30 and the outer layer 29 of the thermoplastic film 26 forming the bladder 28 which are affixed together at their mating edges with welds 101. Further, two weld dots 142 including an opening 49 in the middle for permitting ventilation are also shown. In addition, the light cure material 27 including a multiplicity of glass fibers, that is, fiber filler material 145 is shown as being contained within the bladder 28. Moreover, also shown is a pad 52 which can be made of a closed cell polyethylene foam material 38 which can be affixed to the bladder 38 with the use of a pressure sensitive adhesive 79, such as the aforementioned medical tape made by 3M. As shown in FIG. 62, the pad 52 includes a plurality of vertically orientated peaks 39 and valleys 40 on the posterior or back side nearest the wearer's anatomy for the purpose of helping to prevent the shinguard 20.30 from slipping during use and soccer play, but also to provide for ventilation and evaporation of the wearer's sweat and moisture. It can be readily understood that a multiplicity of different guards or pads which are intended for application and use upon different parts of the human body can have a generally similar structure, and can also be made in a manner substantially similar to that which has been described in connection with FIGS. 61–62.

Figure 63:
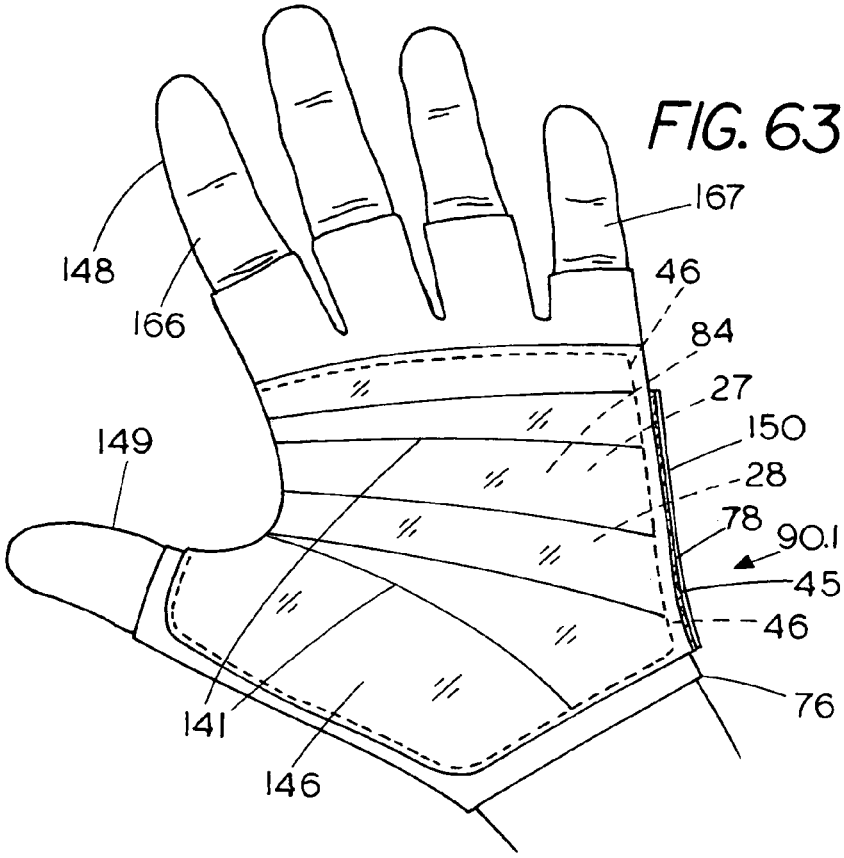
FIG. 63 is a perspective view of the palm side of a glove including an access point to an interior pocket.
Figure 64:
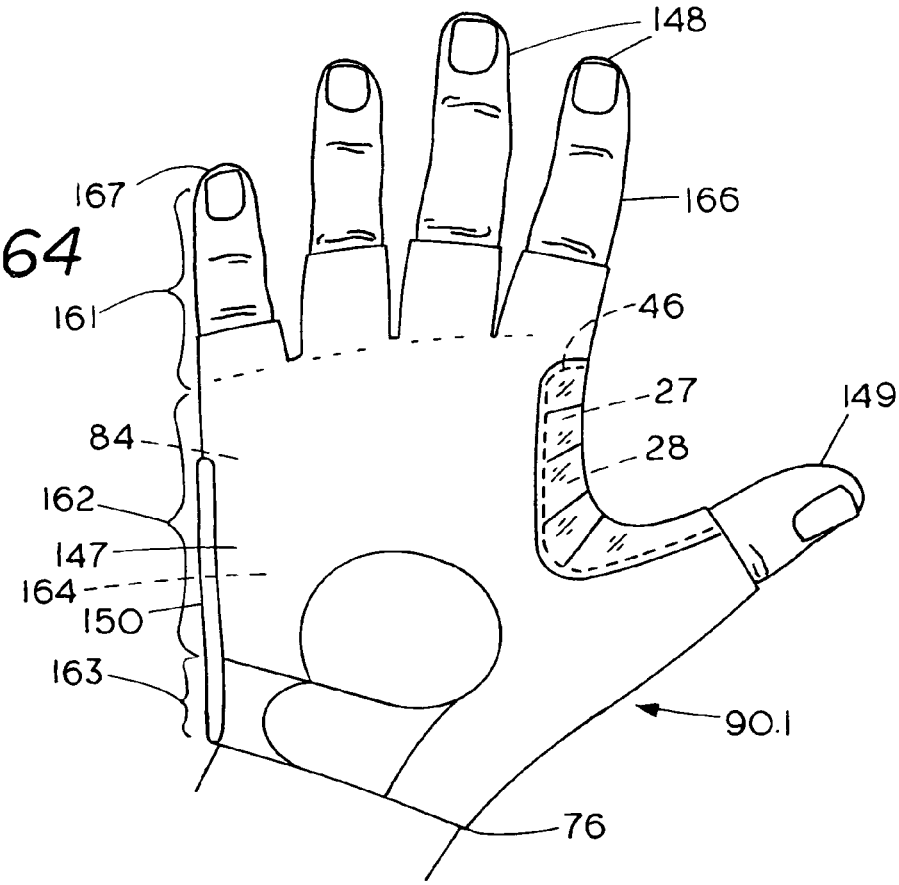
FIG. 64 is a perspective view of the backhand side of the glove shown in FIG. 63.

FIG. 63 is a perspective view of the palm side 146 of a glove 90.1 including an access point 45 to an interior pocket 46. As shown, the glove 90.1 includes several lines of flexion 141 in order to facilitate normal function of the hand 84. The glove 90.1 includes and provides for partial coverage of the fingers 148 and thumb 149, that is, it consists of so-called partial fingers, as opposed to providing full coverage of the fingers 148 and thumb 149, that is, one consisting of full fingers. As shown in FIGS. 63–64, the access point 45 to the interior pocket 46 is located adjacent the side of the hand 84 in the area of the carpal 163 and metacarpal bones 162, and in particular those associated with the so-called little or fifth finger and corresponding metacarpal bone 164. Accordingly, a bladder 28 containing a light cure material 27 can be inserted into the pocket 46 of the glove 90.1 by opening flap 150 which can then be secured in the closed position with the use of VELCRO® hook and pile. As taught elsewhere in the specification in connection with different embodiments of a guard or pad, if desired, a pad 52 can also be affixed to a bladder 28 for use in a glove 90.1 with the use of a pressure sensitive adhesive 79. The bladder 28 including the light cure material 27 can either be caused to set and cure in conformance with a wearer's hand outside of the glove 90.1 and then be inserted therein, or alternatively and as preferred, the bladder 28 can be caused to set and cure after having been inserted into a pocket 46 included in a glove 90.1 which is then donned and customized by a wearer. As shown in FIG. 65, the material used to make the outside portion of the pocket 46 exposed on the exterior of the glove 90.1 can then be made of a substantially translucent or transparent material 151.

FIG. 64 is a perspective view of the backhand side 147 of the glove 90.1 shown in FIG. 63. As shown, the bladder 28 including the light cure material 27 can extend into the area between the thumb 149 and the first or index finger 166. Also shown are the area of the phalangeal bones 161, the area of the metacarpal bones 162, and carpal bones 163 of the hand 84, and in particular, in the area of the hand adjacent to the fifth metacarpal bone 164 and fifth finger 167. The glove 90.1 having partial fingers shown in FIGS. 63–64 can be used for cycling, but also other activities. In general, the incorporation of a bladder 28 including a light cure material 27 in a glove 90 can serve one or more purposes including but not limited to customizing the size and fit of a glove, protecting the wearer's hand from blows, cuts, or extreme temperatures, providing cushioning for attenuating impact events, and enhancing the wearer's comfort and grip.

FIG. 65 is a perspective view of the palm side 146 of a glove 90.2 generally similar to that shown in FIG. 63, but including an alternate access point 45 to an interior pocket 46. As shown, the access point 45 is located adjacent to the wrist 76 and area of the carpal bones 163 of the hand 84. Many other access points to an internal pocket are possible, but FIGS. 63–65 show the two most preferred and alternate locations.

FIG. 66 is a perspective view of the palm side 146 of a full-fingered glove 90.3. As shown, the glove 90.3 can include an access point 45, pocket 46, and bladder 28 including light cure material 27 generally similar to that used in glove 90.1 shown in FIG. 63, but further includes greater coverage of the wrist 76 and also full coverage of the fingers 148 and thumb 149.

Figure 67:
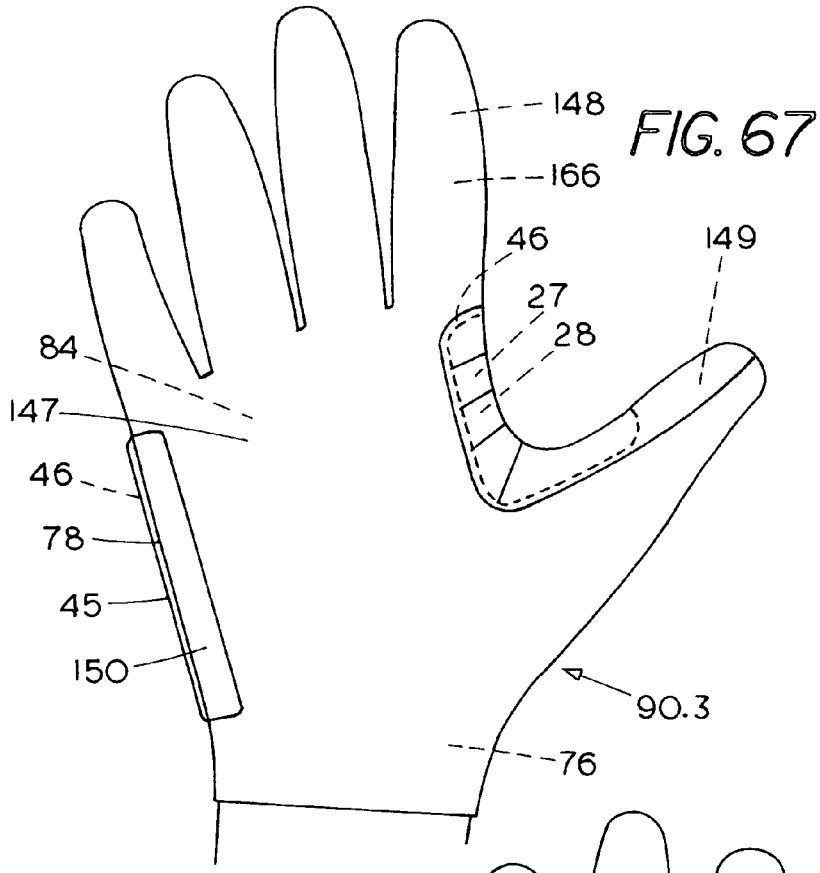
FIG. 67 is a perspective view of the backhand side of the full-fingered glove shown in FIG. 66.

FIG. 67 is a perspective view of the backhand side 147 of the full-fingered glove 90.3 shown in FIG. 66. As shown, the bladder 28 including the light cure material 27 can extend into the area between the thumb 149 and the first or index finger 166.

Figure 68:
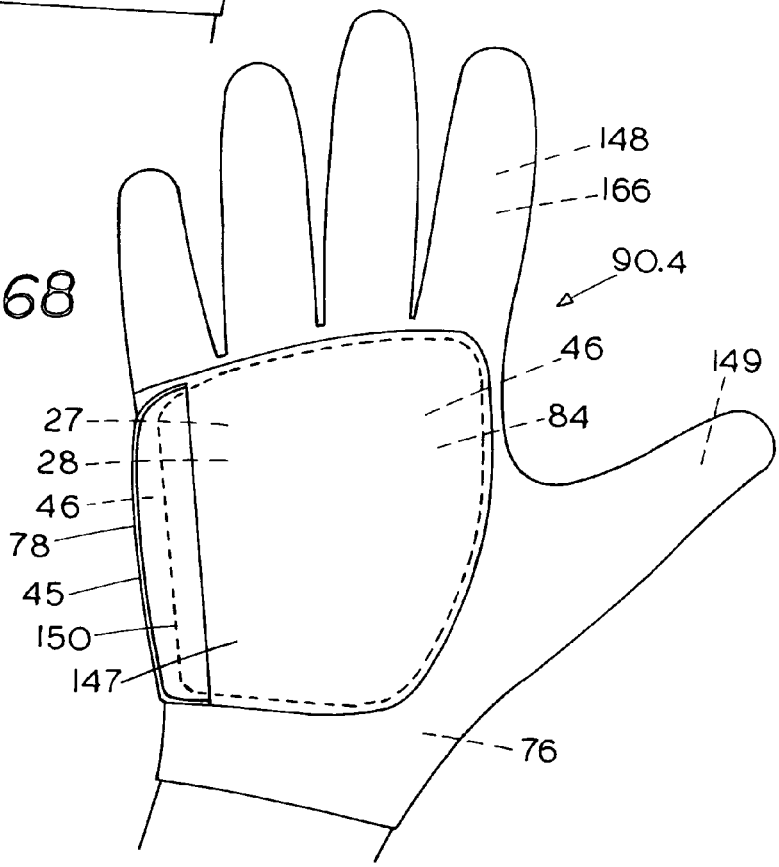
FIG. 68 is a perspective view of the backhand side of an alternate full-fingered glove.

FIG. 68 is a perspective view of the backhand side 147 of an alternate full-fingered glove 90.4. Again, the incorporation of a bladder 28 including a light cure material 27 in a glove 90 can serve one or more purposes including but not limited to customizing the size and fit of a glove, protecting the wearer's hand from blows, cuts, or extreme temperatures, providing cushioning for attenuating impact events, and enhancing the wearer's comfort and grip. For example, when a bladder 28 including a light cure material 27 which can set and cure to form a substantially rigid material is used with a glove similar to that shown in FIG. 68, the glove 90.4 can be suitable for protecting the exposed backhand of a batter when playing baseball. It can be readily understood that in other alternate embodiments, the bladder 28 forming a guard or pad 52 can extend more substantially such as ½, ¾ or full length to thereby protect a greater portion of one or more fingers 148 and/or the thumb 149 of a wearer's hand 146.

Figure 69:
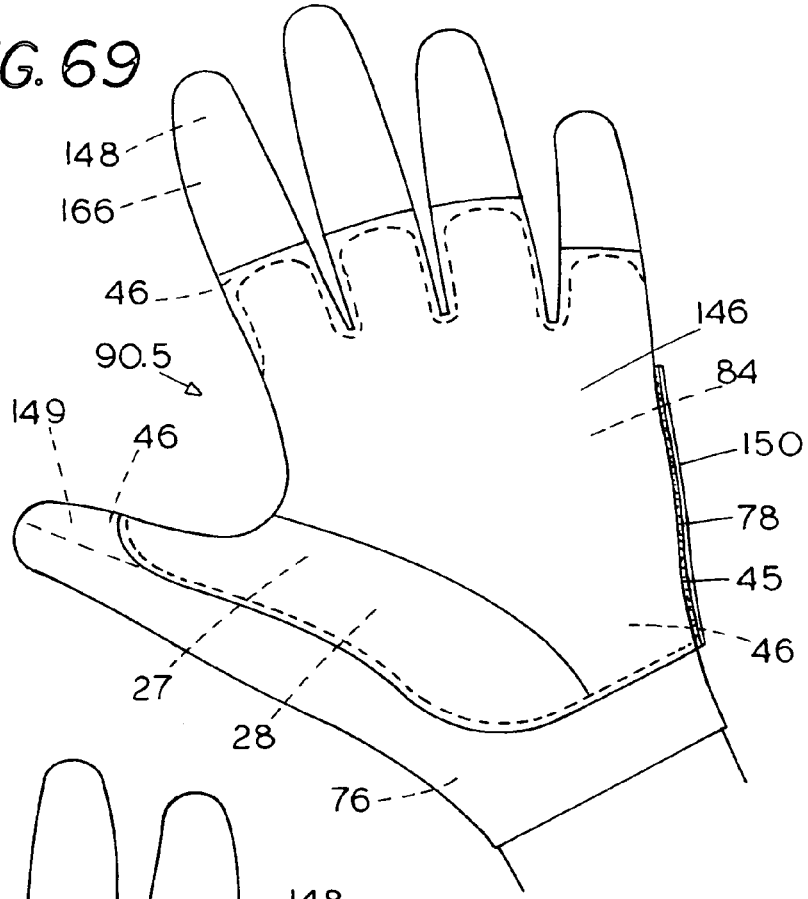
FIG. 69 is a perspective view of the palm side of an alternate full-fingered glove including a bladder forming a guard or pad which extends into the area of the fingers.

FIG. 69 is a perspective view of the palm side 146 of an alternate full-fingered glove 90.5 including a bladder 28 forming a guard or pad 52 which extends into the area of the fingers 148. It can be readily understood that in other alternate embodiments, the bladder 28 forming a guard or pad 52 can extend more substantially such as ¾ or full length to thereby protect a greater portion of one or more fingers 148 and/or the thumb 149 of a wearer's hand 146. A glove 90.5 generally similar to that shown in FIG. 69 can be used in many athletic sports such as golfing and batting, but also construction and industrial work.

Figure 70:
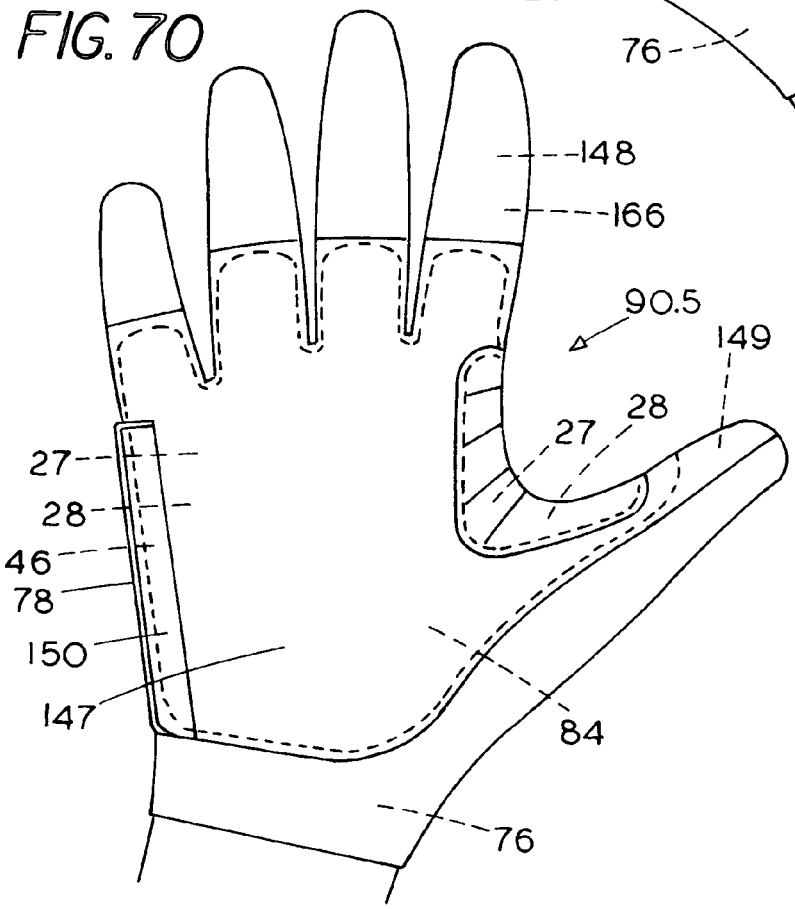
FIG. 70 is a perspective view of the backhand side of the alternate full-fingered glove shown in FIG. 69.

FIG. 70 is a perspective view of the backhand side 147 of the alternate full-fingered glove 90.5 shown in FIG. 69. As shown, the bladder 28 including the light cure material 27 can extend into the area between the thumb 149 and the first or index finger 166.

Figure 71:
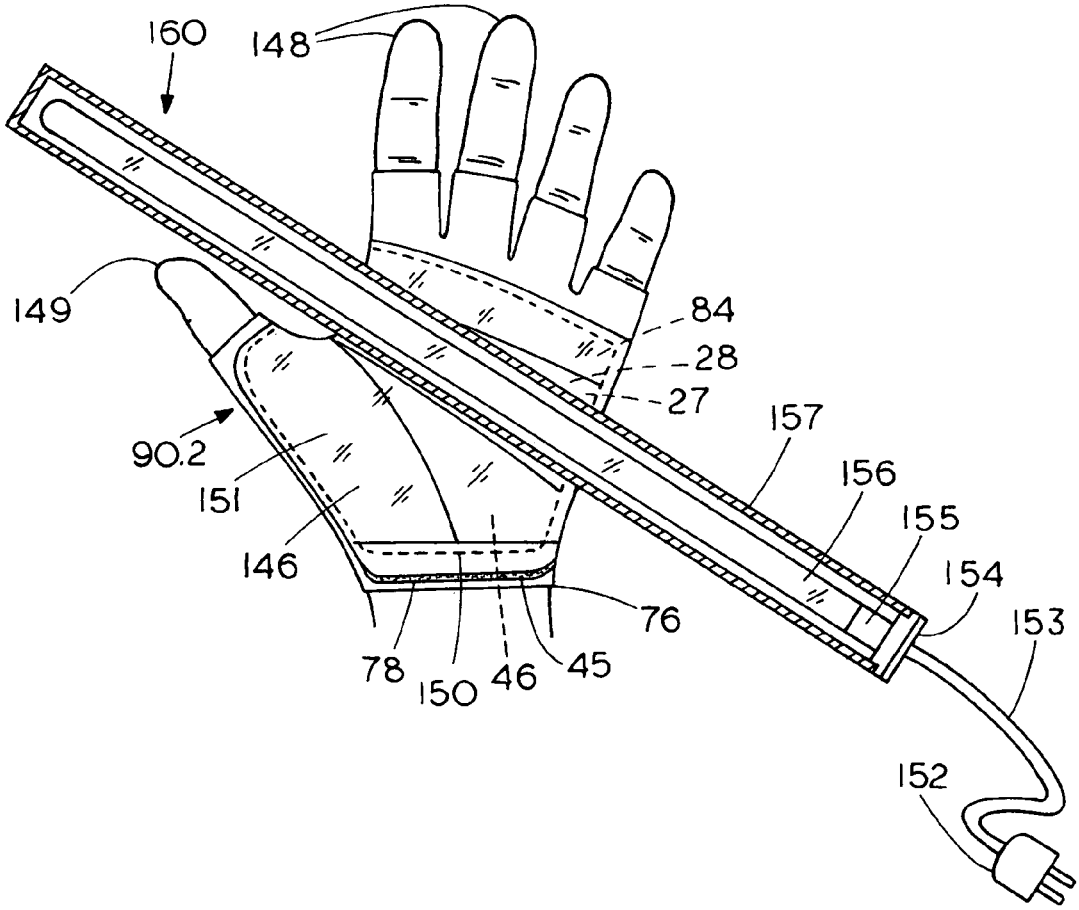
FIG. 71 is a perspective view of an artificial light source for causing the light cure material included in a glove to set and cure.

FIG. 71 is a perspective view of an artificial light source 160 for causing the light cure material 27 included in a glove 90.2 to set and cure. The artificial light source 160 can include a container or tube 157 further including a suitable light bulb or lamp 156, a lamp receptacle 155, a cap 154, an electric cord 153 and an electric plug 152. The container or tube 157 of the artificial light source 160 can be made in an appropriate shape for simulating an object, or wielded implement which is anticipated for use by the wearer, thus providing for a customized fit and grip. Alternatively, a bulb or lamp 156 having a suitable shape can simply be used for this purpose. For example, the container or tube 157 of an artificial light source 160 can be made in the shape of a bat for use with a baseball batting glove, or the shape of handlebars for use with a cycling glove, or alternatively in the shape of a hammer for use with a work glove by a construction worker. Moreover, the artificial light source 160 can also serve as a point of purchase display in a retail environment.

FIG. 72 is a perspective view of a splint or cast 159.1 for use in stabilizing and protecting a portion of a wearer's anatomy, and in particular, a limb. As shown, the splint or cast is applied over a substantial portion of the lower leg 22 of a wearer 21. However, it can be readily understood that alternate splints or casts can be made in a variety of sizes and shapes for specific use with different portions of a wearer's anatomy including but not limited to the head, neck, back and spine, shoulder, torso, hips, arms, hands, fingers, legs, knees, ankles, feet, and toes, and whether in various partial or complete combinations.

The structure of a splint or cast 159.1 and method of making the same can be generally similar to that taught in the present application with regards to various guards and pads. For example, the splint or cast 159.1 can include a bladder 28 containing a light cure material 27. If desired, an impregnated textile material 55 and/or a fiber filler material 145 can be further included within the bladder 28. The bladder 28 can be made using a thermoplastic film 26. The preferred film 26 for a bladder 28 is made of a polyurethane material and can range in thickness between 5–50 mils, depending upon the particular application. Suitable polyurethane films include MP 1880AE and MP 1890 AE having a thickness of 0.02 inches and having a Shore A hardness of 80–90, which are made by Deerfield Urethane, Inc. of Deerfield, Mass. However, other thermoplastic film materials can be suitable for use including those taught in the patents assigned to Nike, Inc. previously recited and incorporated by reference in this specification. Accordingly, two or more layers of film 26 can be sealed along any desired mating edges or portions to form a bladder 28 by using radio frequency welding, heat and pressure welding, adhesive, and the like. The bladder 28 can include a plurality of weld dots 142 which can further include a central opening 49 for permitting ventilation. The film 26 associated with bladder 28 can also be formed to a desired more complex three dimensional shape by vacuum molding, or alternatively by blow-molding or other conventional means known in the art. The outer layer 29 of the bladder 28 faces generally opposite the inner layer 30 of the bladder 28, the former being more distant and the latter being closest to the wearer's body. Preferably, at least the outer layer 29 of the bladder 28 is made of a substantially transparent thermoplastic film 26 that permits the transmission of light therethrough.

A light-cure material 27 in a substantially liquid or viscous state can be inserted and contained within the bladder 28 through a passage which can then be closed with a sealing weld. The preferred light cure materials 27 for use are made by San Rafael Coating of 700 Hawthorne Street, #A, Glendale, Calif. In particular, a light cure material made of an acrylated urethane and monomer blend known as SRC A-3, and another light cure material made of an acrylic oligomer and monomer blend epoxy known as SRC A-8 have been developed for use with the present invention. The preferred Ciba visible light photoinitiators for use in the light cure materials 27 include IRGACURE® 184, and in particular, IRGACURE® 784, and suitable Ciba ultraviolet light photoinitiators include IRGACURE® 369, and 819. Filler materials consisting of fine particles or flakes can also be included within a light cure material, and such particulate filler materials can consist of clay, talc, mica, soda lime borosilicate, sodium borosilicate, silica, aluminosilicate, fly ash, perlite, organic or inorganic microspheres, metal, steel, aluminum, titanium, zirconia, ceramics, boron carbide, silicone carbide, silicon nitride, aluminum nitride, and the like. However, the preferred filler materials for use in a light cure material consist of short or long fiber filler materials 145 such as glass fibers, carbon fibers, aramid fibers, or boron fibers. In particular, the preferred chopped strand glass fibers for use are identified as product type 3075 made by PPG Industries of Shelby, N.C. having a length of approximately 3.2 mm or ⅛ths inch. These glass fibers mix easily with the light cure material and can serve to reinforce and increase the stiffness of the splint or cast 159 after the light cure material has been caused to set and cure. The bladder 28 of a splint or cast 159.1 can alternatively, or in some cases can additionally contain, as may be desired in some applications, a textile material 41 which is in contact with the light cure material 27 contained therein, thus forming an impregnated textile material 55.

A splint or cast 159.1 can be contained in a closed container for storage or shipping such as ajar, box, bag, package or sealed pouch, and the like, that does not substantially permit the transmission of ultraviolet and visible light. Such a container can be said to be substantially impermeable or impenetrable to ultraviolet and visible light. In this regard, a package or sealed pouch including a thin plastic film including metallic foil can be advantageous for use. In particular, the preferred package can be made using a flexible plastic thin film including metallic foil which is identified as PAKVf56T by IMPAK, Corporation of 2460 East 57th Street, Los Angeles, Calif. When the splint or cast 159.1 is removed from the package and donned by a wearer 21 exposure to a visible or ultraviolet light source such as sunlight, or alternatively, a suitable man-made light source will cause the light cure material 27 contained within the bladder 28 to cure and form substantially solid matter. The preferred artificial light source for use is a fluorescent lamp made by General Electric and identified as BIAX® F40/30BX/SPX50 which has exceptional brightness and sufficient spectral power in the blue portion of the visible light spectrum.

The bladder 28 including a light cure material which can further include a fiber filler material 145 and/or an impregnated textile material 55 can form substantially all of the structure of a splint or cast 159.1. However, in some applications, it can be advantageous to affix the posterior or back side of the bladder 28 portion of the splint or cast 159.1 to a piece of closed cell foam material 38, or alternatively, to a fluid-filled bladder such as one including a gas, which can then serve as a pad 52. Accordingly, the bladder 28 containing a light cure material 27 which can further include a fiber filler material 145 and/or an impregnated textile material 55 can be used to create the substantially rigid protective outer portion of splint or cast 159.1 having a customized shape and permanent memory with regards to a wearer's anatomy, that is, when the light cure material is exposed to a suitable light source and caused to set and cure, whereas the foam material 38 or fluid filled bladder which is used for the pad 52 portion of the splint or cast 159.1 can provide for the wearer's comfort, but also some deflection and attenuation of impact events. The bladder 28 can be secured to the pad 52 with the use of a double sided pressure sensitive self-adhesive material 79. The pressure sensitive adhesive materials preferred for use are hypoallergenic and made by the 3M company of St. Paul, Minn., and identified as medical double coated tapes and transfer adhesives product numbers 1509 and 9889.

The preferred pad 52 for use in a splint or cast 159.1 is made of a white closed cell polyethylene foam material 38 having a thickness in the range between ⅛ and ¼ inches. As shown in FIG. 62, the foam material 38 and pad 52 can include a plurality of vertically orientated peaks 39 and valleys 40 on the posterior or back side nearest the wearer's anatomy for the purpose of helping to prevent a splint or cast 159.1 from slipping during use, but also to provide for ventilation and evaporation of the wearer's sweat and moisture. As shown in FIG. 72, it is generally advantageous and preferred for the pad 52 to extend beyond the ends such as the superior side 109, and inferior side 110 of the bladder 38, as this can prevent the edges of the substantially rigid cured light cure material 27 contained in the bladder 28 portion of the splint or cast 159.1 from making contact with the wearer's skin. Moreover, in the specific application for a wearer's lower leg 22 as shown in FIG. 72, it can be advantageous for the pad 52 to extend more substantially beyond the inferior side 110 of the bladder 38 in order to help maintain the vertical position of the splint or guard 159.1 above the anterior junction between the wearer's lower leg and foot, and in particular, above the area associated with the tendons of the tibialis anterior, extensor digitorum longus, and extensor hallucis longus muscles which can protrude during flexion. Moreover, it can be advantageous that the pad 52 include a relieved area or notch 165 on the inferior side 110 for accommodating the aforementioned anatomical structures, and also to help stabilize and secure the splint or cast 159.1 upon a wearer.

A cross-sectional view of a splint or cast 159.1 can generally resemble the structure of the shin guard 20.30 shown in FIG. 62, but other structures and configurations are possible. However, in contrast with prior art splints and casts which have used coated or impregnated textile materials including either moisture or light cure polymeric materials which can be made to set and cure to form substantially rigid solid matter, the present application teaches completely enclosing the light cure materials for use in making a splint or cast within a bladder. This makes storage and use of a preferred splint or cast fast, easy, and convenient. Both the wearer and also an individual who may be applying the splint or cast are thereby prevented from coming into direct contact with the light cure material. Accordingly, the method of applying the splint or cast to a wearer does not create a mess, and the light cure material cannot become contaminated. Moreover, the splint or cast can be applied easily and rapidly in an emergency situation in the field even when faced with adverse weather or inhospitable environmental conditions, that is, provided that a natural light source such as visible or ultraviolet light from the sun, or alternatively, an appropriate artificial light source is available for use. For this reason, the splint or cast taught in the present invention can be advantageous for use by civilian and military emergency medical response personnel.

As shown in FIG. 72, the inner layer 30 and outer layer 29 of the thermoplastic film 26 forming a bladder 28 for use in making a splint or cast 159.1 can be affixed together at their mating edges with welds 101. Further, a plurality of weld dots 142 including an opening 49 in the middle for permitting ventilation are also shown in FIG. 72. In addition, the light cure material 27 includes a multiplicity of glass fibers, that is, a fiber filler material 145 is also contained within the bladder 28. Moreover, also shown is a pad 52 which can be made of a closed cell polyethylene foam material 38 which can be affixed to the bladder 38 with the use of a pressure sensitive adhesive 79, such as the aforementioned medical tapes made by 3M. As illustrated previously in FIG. 62 in connection with shinguard 20.30, a pad 52 for use in a splint or cast 159.1 can also similarly include, if desired, a plurality of vertically or longitudinally orientated peaks 39 and valleys 40 on the posterior or back side nearest a wearer's anatomy for providing comfort, but also to provide for ventilation and evaporation of the wearer's sweat and moisture. As shown in FIG. 72, the splint or cast 159.1 can include closure means such as VELCRO® hook and pile 78. Alternatively, or in addition, a splint or cast 159.1 can include a removable peel-ply protective layer which can be removed to expose an underlying pressure sensitive self-adhesive surface for securing portions of a splint or cast 159.1 together in a desired position. Alternatively, or in addition, other conventional closure means can be used to secure a splint or cast 159.1 in position including but not limited to adhesive tape, elastic bands, a sleeve, at least one strap, laces, or rope.

Shown in FIG. 73 is an alternate embodiment of a splint or cast 159.2 for stabilizing and protecting a portion of a wearer's anatomy. The splint or cast 159.2 is shown in position on a wearer's arm 168, and in particular, the wearer's 21 forearm 85. The splint or cast 159.2 is generally similar in structure to that shown and recited in FIG. 72. However, the use of closure means consisting of at least one pressure sensitive self-adhesive surface 79 including a removable peel-ply protective layer 169 is shown in FIG. 73. The incorporation of at least one pressure sensitive self-adhesive surface 79 can be used to secure portions of a splint or cast 159.2 together in a desired position.

It can be readily understood that many of the materials, structures, articles, and methods disclosed herein, and their equivalents, can be used various combinations. While the above detailed description of the invention contains many specificities, these should not be construed as limitations on the scope of the invention, but rather as exemplifications of several preferred embodiments thereof. Many other variations are possible. Accordingly, the scope of the invention should be determined not by the embodiments discussed or illustrated, but by the appended claims and their legal equivalents.

I claim:

1. A device for protecting a portion of a wearer's anatomy comprising a bladder containing a light cure material including a fiber filler material, said light cure material being caused to set and cure when exposed to light having a wavelength in the range between 280–780 nanometers.

2. The device according to claim 1, wherein said fiber filler material comprises a fiber filler material-taken from the select group of fiber filler materials consisting of aramid fiber, boron fiber, carbon fiber, glass fiber, polyester fiber, and polyethylene fiber.

3. The device according to claim 1, wherein said fiber filler material comprises glass fiber.

4. The device according to claim 1, wherein said fiber filler material comprises in the range between ten and ninety percent of the volume of the mixture comprising said light cure material and said fiber filler material contained within said bladder.

5. The device according to claim 1, further comprising a textile material.

6. The device according to claim 1, further comprising a plurality of openings for providing ventilation.

7. The device according to claim 1, further comprising a foam material.

8. The device according to claim 7, wherein said foam material further comprises a plurality of peaks and valleys.

9. The device according to claim 7, further including an anterior side and a posterior side, wherein said bladder is secured to said foam material, and said bladder substantially comprises said anterior side and said foam material substantially comprises said posterior side of said device.

10. The device according to claim 1, further comprising a pressure sensitive adhesive.

11. The device according to claim 1, further comprising at least one strap.

12. The device according to claim 1, further comprising hook and pile.

13. The device according to claim 1, further comprising a gas contained within said bladder.

14. The device according to claim 1, wherein said device comprises a guard for protecting a portion of a wearer's anatomy.

15. The device according to claim 14, wherein said guard comprises a shin guard.

16. The device according to claim 1, wherein said device comprises a guard for protecting a portion of a wearer's anatomy taken from the select group of guards consisting of finger guards, hand guards, wrist guards, forearm guards, elbow guards, arm guards, biceps guards, shoulder guards, head guards, helmets, neck guards, back guards, hip guards, torso guards, rib guards, leg guards, thigh guards, knee guards, shin guards, ankle guards, foot guards, splints, casts, and body armor.

17. The device according to claim 1, wherein said device comprises a pad for protecting a portion of a wearer's anatomy.

18. The device according to claim 1, wherein said device comprises a pad for protecting a portion of a wearer's anatomy taken from the select group of finger pads, hand pads, glove pads, wrist pads, forearm pads, elbow pads, arm pads, biceps pads, shoulder pads, head pads, helmet pads, chin strap pads, neck pads, back pads, hip pads, torso pads, rib pads, leg pads, thigh pads, knee pads, shin pads, ankle pads, foot pads, prosthesis pads, splint pads, cast pads, and body armor pads.

19. The device according to claim 1, said bladder containing said light cure material including said fiber filler material comprising an anterior bladder, said device further including a posterior bladder containing a gas, said anterior bladder and said posterior bladder configured in an overlapping relationship.

20. A device for protecting a portion of a wearer's anatomy comprising an anterior bladder and a posterior bladder, said anterior bladder containing a light cure material including a fiber filler material, said light cure material being caused to set and cure when exposed to light having a wavelength in the range between 280–780 nanometers, and said posterior bladder containing a gas, said anterior bladder and said posterior bladder configured in an overlapping relationship.

21. A method of making a device for protecting a portion of a wearer's anatomy comprising a bladder containing a light cure material including a fiber filler material, said light cure material being caused to set and cure when exposed to light having a wavelength in the range between 280–780 nanometers, comprising:

opening a package which is substantially impenetrable to said light and removing said device;

placing said device in position upon a wearer; and exposing said device to said light causing said light cure material to set and cure.

22. A device for conforming to a portion of a wearer's anatomy comprising a bladder containing a light cure material which can be caused to set and cure when exposed to light having a wavelength in the range between 280–780 nanometers.

23. The device according to claim 22, wherein said device comprises an article of apparel.

24. The device according to claim 22, wherein said device comprises an article of apparel for protecting a portion of a wearer's anatomy taken from the select group of apparel consisting of guards, pads, helmets, casts, gloves, and body armor.

25. The device according to claim 22, said bladder further comprising a textile material impregnated with said light cure material.

26. The device according to claim 25, wherein said device comprises an article of apparel for protecting a portion of a wearer's anatomy taken from the select group of apparel consisting of guards, pads, helmets, casts, gloves, and body armor.

27. The device according to claim 22, said light cure material further including a fiber filler material.

28. The device according to claim 27, wherein said device comprises an article of apparel for protecting a portion of a wearer's anatomy taken from the select group of apparel consisting of guards, pads, helmets, casts, gloves, and body armor.

* * * * *